US007857020B2

(12) United States Patent
McDaniel

(10) Patent No.: US 7,857,020 B2
(45) Date of Patent: Dec. 28, 2010

(54) JIG APPARATUS

(75) Inventor: Steven D. McDaniel, Humboldt, TN (US)

(73) Assignee: Black & Decker Inc., Newark, DE (US)

( * ) Notice: Subject to any disclaimer, the term of this patent is extended or adjusted under 35 U.S.C. 154(b) by 405 days.

(21) Appl. No.: 11/704,226

(22) Filed: Feb. 9, 2007

(65) Prior Publication Data

US 2007/0131305 A1 Jun. 14, 2007

Related U.S. Application Data

(63) Continuation-in-part of application No. 11/399,316, filed on Apr. 7, 2006, now Pat. No. 7,434,604, which is a continuation-in-part of application No. 11/186,408, filed on Jul. 21, 2005, now Pat. No. 7,455,089.

(60) Provisional application No. 60/592,734, filed on Jul. 30, 2004, provisional application No. 60/664,053, filed on Mar. 22, 2005.

(51) Int. Cl.
*B27C 5/00* (2006.01)

(52) U.S. Cl. ..... 144/144.1; 144/144.51; 144/145.1; 409/130

(58) Field of Classification Search ..... 144/144.1, 144/144.41, 144.51, 145.1; 409/125, 130; 33/562, 566

See application file for complete search history.

(56) References Cited

U.S. PATENT DOCUMENTS

| | | | |
|---|---|---|---|
| 18,838 | A | 12/1857 | Babbs et al. |
| 266,042 | A | 10/1882 | Merz |
| 475,544 | A | 5/1892 | Dobbie |
| 478,544 | A | 7/1892 | Cordesman et al. |
| 610,272 | A | 9/1898 | Lindwall |
| 1,262,743 | A | 4/1918 | Bronson |
| 1,432,121 | A | 10/1922 | Prickett |
| 1,466,312 | A | 8/1923 | Morcom |
| 1,483,966 | A | 2/1924 | Collins |
| 1,532,467 | A | 4/1925 | Barnett |
| 1,670,074 | A | 5/1928 | Mathez |
| 1,679,074 | A | 7/1928 | Carter |
| 1,751,816 | A | 3/1930 | Hunter |

(Continued)

FOREIGN PATENT DOCUMENTS

| | | | |
|---|---|---|---|
| DE | 879012 | | 6/1953 |
| DE | 3430496 | A1 | 2/1986 |
| DE | 3517146 | A1 | 11/1986 |
| DE | 4016834 | A1 | 11/1991 |
| DE | 4403534 | A1 | 8/1995 |
| DE | 19715422 | A1 | 10/1998 |

(Continued)

OTHER PUBLICATIONS

Vermont American, Industrial Dovetail Jig, Model # 23461, Manual No. 45LCN-72, Aug. 1999, USA.

(Continued)

*Primary Examiner*—Shelley Self

(57) ABSTRACT

A jig apparatus for aiding in the formation of a variety of mechanically interconnecting structures or joints in workpieces. The jig apparatus may include a base and a template mounting system for adjustably positioning a template with respect to the base. A securing system for securing a workpiece in a desired position may be included. The jig apparatus may also include a repeatable template positioning system. Additionally, a quick-change template guide system may be used with a router and template for removing material from a workpiece. A router bit positioning system for aiding in establishing a pre-determined bit depth may be included.

20 Claims, 54 Drawing Sheets

U.S. PATENT DOCUMENTS

| | | | | | |
|---|---|---|---|---|---|
| 1,841,043 | A | | 1/1932 | Moore | |
| 1,863,032 | A | | 6/1932 | Seelinger | |
| 2,036,348 | A | | 4/1936 | Miller | |
| 2,080,859 | A | | 5/1937 | Drapak et al. | |
| 2,260,784 | A | | 10/1941 | Morton | |
| 2,299,602 | A | | 10/1942 | Teague | |
| 2,607,375 | A | | 8/1952 | Gillespie et al. | |
| 2,651,847 | A | | 9/1953 | Sacrey | |
| 2,660,803 | A | | 12/1953 | Sacrey | |
| 2,764,191 | A | | 9/1956 | Hartmann | |
| 2,843,167 | A | | 7/1958 | Rushton | |
| 2,890,730 | A | | 6/1959 | Gottlieb | |
| 3,057,383 | A | | 10/1962 | Waite | |
| 3,099,299 | A | | 7/1963 | Gilfry | |
| 3,109,466 | A | | 11/1963 | Jones | |
| 3,232,327 | A | | 2/1966 | Baranczyk | |
| 3,301,287 | A | | 1/1967 | Edwards | |
| 3,424,450 | A | | 1/1969 | Atkins | |
| 3,442,309 | A | | 5/1969 | Jentsch | |
| 3,450,001 | A | | 6/1969 | Fortune | |
| 3,700,344 | A | | 10/1972 | Grumbach | |
| 3,709,088 | A | | 1/1973 | Pitzer | |
| 3,800,840 | A | | 4/1974 | McCord, Jr. | |
| D232,298 | S | | 8/1974 | Jones | |
| 3,827,468 | A | | 8/1974 | Markham | |
| 3,834,435 | A | | 9/1974 | McCord, Jr. | |
| 3,841,368 | A | | 10/1974 | Ritter | |
| 3,878,875 | A | | 4/1975 | McCord, Jr. | |
| D242,211 | S | | 11/1976 | Parise | |
| D242,212 | S | | 11/1976 | Parise | |
| D246,523 | S | | 11/1977 | Bartlett | |
| 4,093,394 | A | | 6/1978 | Adams | |
| 4,095,633 | A | | 6/1978 | Kimball et al. | |
| 4,127,153 | A | | 11/1978 | Cipollone | |
| 4,163,465 | A | | 8/1979 | Strong | |
| 4,168,730 | A | | 9/1979 | Keller | |
| D255,359 | S | | 6/1980 | Bartlett | |
| 4,281,694 | A | | 8/1981 | Gorman | |
| 4,319,615 | A | | 3/1982 | Ditmanson | |
| 4,373,562 | A | | 2/1983 | Vernon | |
| 4,382,728 | A | | 5/1983 | Anderson et al. | |
| 4,403,534 | A | | 9/1983 | Altendorf et al. | |
| 4,405,004 | A | | 9/1983 | Dicke | |
| 4,407,344 | A | | 10/1983 | Dicke | |
| D272,038 | S | | 1/1984 | Dicke | |
| 4,428,408 | A | * | 1/1984 | Grisley | 144/144.51 |
| 4,438,977 | A | | 3/1984 | Chapel | |
| 4,445,277 | A | | 5/1984 | Keefe | |
| 4,462,440 | A | | 7/1984 | Dolfi | |
| 4,478,264 | A | | 10/1984 | Miller et al. | |
| 4,479,523 | A | | 10/1984 | Petterson et al. | |
| 4,498,245 | A | | 2/1985 | Mayor | |
| 4,542,776 | A | | 9/1985 | Kehoe | |
| 4,575,059 | A | | 3/1986 | Blaine | |
| 4,593,735 | A | | 6/1986 | Wirth, Jr. | |
| 4,595,040 | A | | 6/1986 | Glisman | |
| 4,603,717 | A | | 8/1986 | Thomas | |
| 4,607,434 | A | | 8/1986 | Francis | |
| 4,607,673 | A | | 8/1986 | McCord, Jr. | |
| 4,630,656 | A | | 12/1986 | Collins | |
| 4,630,657 | A | | 12/1986 | Obradovich | |
| 4,644,985 | A | | 2/1987 | Weaver | |
| 4,648,433 | A | | 3/1987 | Wolff | |
| D289,337 | S | | 4/1987 | Fitzwater | |
| 4,655,445 | A | | 4/1987 | Morse | |
| 4,688,612 | A | | 8/1987 | Kessel et al. | |
| 4,693,288 | A | | 9/1987 | Buechele et al. | |
| 4,735,531 | A | | 4/1988 | Boerckel et al. | |
| 4,750,536 | A | | 6/1988 | Grisley | |
| 4,763,706 | A | * | 8/1988 | Rice et al. | 144/136.1 |
| 4,763,707 | A | | 8/1988 | Hounshell | |
| 4,776,374 | A | | 10/1988 | Charlebois | |
| 4,787,430 | A | | 11/1988 | Miyamoto | |
| 4,787,432 | A | | 11/1988 | Williams | |
| 4,805,505 | A | | 2/1989 | Cantlin | |
| 4,809,755 | A | | 3/1989 | Pontikas | |
| 4,843,728 | A | | 7/1989 | Francis | |
| 4,850,763 | A | | 7/1989 | Jack et al. | |
| 4,860,809 | A | | 8/1989 | Cotton et al. | |
| 4,863,151 | A | | 9/1989 | Justesen | |
| 4,871,002 | A | | 10/1989 | Turner | |
| 4,875,510 | A | * | 10/1989 | Muellers | 144/145.2 |
| D306,506 | S | | 3/1990 | Houser | |
| 4,905,745 | A | | 3/1990 | Jaegar | |
| 4,911,213 | A | | 3/1990 | Le Bleu | |
| 4,930,221 | A | | 6/1990 | Taylor | |
| 4,934,422 | A | | 6/1990 | Hempy et al. | |
| 4,942,912 | A | | 7/1990 | Gakhar et al. | |
| 4,965,943 | A | | 10/1990 | Adams | |
| 4,965,966 | A | | 10/1990 | Braasch | |
| 4,966,507 | A | | 10/1990 | Hanks | |
| 4,977,938 | A | | 12/1990 | Greeson | |
| 4,995,435 | A | | 2/1991 | Godfrey | |
| 5,016,691 | A | | 5/1991 | Bernier | |
| 5,052,454 | A | | 10/1991 | Meinhardt | |
| 5,056,966 | A | | 10/1991 | Lee | |
| 5,067,537 | A | | 11/1991 | Offner | |
| 5,076,742 | A | | 12/1991 | Lee et al. | |
| 5,090,461 | A | | 2/1992 | Gakhar et al. | |
| 5,094,279 | A | | 3/1992 | Dickey et al. | |
| 5,114,265 | A | | 5/1992 | Grisley | |
| 5,123,463 | A | | 6/1992 | Grisley | |
| 5,139,062 | A | | 8/1992 | Keller | |
| 5,143,132 | A | | 9/1992 | Keller | |
| 5,154,214 | A | | 10/1992 | Hagerman | |
| 5,156,508 | A | | 10/1992 | Grisley | |
| 5,174,693 | A | | 12/1992 | Lee et al. | |
| 5,184,372 | A | | 2/1993 | Mache | |
| 5,199,477 | A | | 4/1993 | Keller | |
| 5,203,389 | A | | 4/1993 | Goodwin | |
| D335,942 | S | | 5/1993 | Furcron | |
| 5,222,997 | A | | 6/1993 | Montgomery | |
| D342,747 | S | | 12/1993 | Garcia | |
| 5,273,090 | A | | 12/1993 | Klemma | |
| 5,284,331 | A | | 2/1994 | Lee et al. | |
| 5,285,831 | A | | 2/1994 | Woolgar | |
| 5,285,832 | A | | 2/1994 | Gibson | |
| 5,289,861 | A | | 3/1994 | Hedrick | |
| 5,305,812 | A | | 4/1994 | Ferencsik | |
| D348,195 | S | | 6/1994 | Higgins et al. | |
| 5,318,082 | A | | 6/1994 | Von Hollen | |
| 5,325,899 | A | | 7/1994 | Kochling | |
| 5,337,641 | A | | 8/1994 | Duginske | |
| 5,345,983 | A | | 9/1994 | De Abreu | |
| 5,396,937 | A | * | 3/1995 | Clausen | 144/135.2 |
| 5,421,384 | A | | 6/1995 | Nuwordu | |
| 5,423,357 | A | | 6/1995 | Szymanski | |
| 5,423,360 | A | | 6/1995 | Taylor et al. | |
| 5,452,751 | A | | 9/1995 | Engler, III et al. | |
| 5,458,171 | A | | 10/1995 | Ward | |
| 5,492,160 | A | | 2/1996 | McCracken | |
| 5,494,089 | A | | 2/1996 | Lubbe | |
| 5,513,437 | A | | 5/1996 | Whyte | |
| 5,533,556 | A | | 7/1996 | Whitney | |
| 5,562,208 | A | | 10/1996 | Hasler et al. | |
| 5,564,483 | A | | 10/1996 | Sacchi | |
| 5,584,328 | A | | 12/1996 | Grisley | |
| 5,598,878 | A | | 2/1997 | Wirth, Jr. et al. | |
| 5,617,909 | A | | 4/1997 | Duginske | |
| 5,630,455 | A | | 5/1997 | Julien | |
| 5,647,707 | A | | 7/1997 | Poulin | |
| 5,692,861 | A | | 12/1997 | Stottmann | |
| 5,694,992 | A | | 12/1997 | Kikuchi | |
| 5,694,994 | A | | 12/1997 | Engler, III et al. | |

| | | | |
|---|---|---|---|
| 5,697,415 | A | 12/1997 | Kozyrski et al. |
| 5,711,356 | A | 1/1998 | Grisley |
| 5,738,470 | A | 4/1998 | Sugita |
| 5,738,966 | A | 4/1998 | Okuno et al. |
| 5,779,407 | A | 7/1998 | Tucker et al. |
| 5,807,033 | A | 9/1998 | Benway |
| 5,809,631 | A | 9/1998 | Poulin |
| 5,813,807 | A | 9/1998 | Rogers |
| 5,816,300 | A | 10/1998 | Rogers |
| 5,823,239 | A | 10/1998 | Smith |
| 5,832,977 | A | 11/1998 | Hampton |
| 5,853,035 | A | 12/1998 | Rose |
| 5,862,848 | A | 1/1999 | Beall |
| 5,868,183 | A | 2/1999 | Kozyrski et al. |
| 5,893,402 | A | 4/1999 | Darling |
| 5,908,061 | A | 6/1999 | Blichmann |
| 5,918,652 | A | 7/1999 | Tucker |
| 5,931,208 | A | 8/1999 | Gifkins |
| 6,012,497 | A | 1/2000 | Stottmann |
| 6,032,706 | A | 3/2000 | Lear |
| 6,039,095 | A | 3/2000 | Newman |
| 6,041,837 | A | 3/2000 | Hanson |
| 6,050,559 | A | 4/2000 | de Souza |
| 6,061,921 | A | 5/2000 | Adams et al. |
| 6,065,913 | A | 5/2000 | Rogers |
| 6,068,036 | A | 5/2000 | Cassidy |
| 6,076,575 | A | 6/2000 | Harkness |
| 6,116,303 | A | 9/2000 | Hampton |
| 6,116,826 | A | 9/2000 | Benway |
| 6,138,372 | A | 10/2000 | Newman |
| 6,148,879 | A | 11/2000 | Liao |
| 6,158,487 | A | 12/2000 | Licari |
| 6,182,371 | B1 | 2/2001 | Newman |
| 6,206,060 | B1 | 3/2001 | Blake |
| 6,289,956 | B1 | 9/2001 | Shriver |
| 6,315,017 | B1 | 11/2001 | Stottmann |
| 6,357,194 | B1 | 3/2002 | Jones, Jr. |
| 6,363,982 | B1 | 4/2002 | Nixon, Jr. |
| 6,374,878 | B1 | 4/2002 | Mastley et al. |
| 6,401,772 | B1 | 6/2002 | Beitl |
| 6,422,276 | B1 | 7/2002 | Kevan |
| 6,470,930 | B1 | 10/2002 | Stottmann |
| 6,499,224 | B1 | 12/2002 | Asick |
| 6,516,842 | B1 | 2/2003 | Chang |
| 6,588,468 | B1 | 7/2003 | Tucker et al. |
| 6,607,016 | B2 | 8/2003 | Jones |
| D481,402 | S | 10/2003 | Jenkins et al. |
| 6,675,849 | B1 | 1/2004 | Lackley |
| 6,679,659 | B1 | 1/2004 | Lasch et al. |
| 6,705,810 | B1 | 3/2004 | Sugita |
| 6,736,173 | B1 | 5/2004 | Grisley et al. |
| RE38,612 | E | 10/2004 | Tucker et al. |
| 6,799,615 | B2 | 10/2004 | Smith |
| 6,834,730 | B2 | 12/2004 | Gass et al. |
| 6,851,900 | B2 | 2/2005 | Tillemans et al. |
| 6,899,152 | B2 | 5/2005 | Godfrey |
| 6,926,477 | B2 | 8/2005 | Allemann et al. |
| D512,893 | S | 12/2005 | Cowan |
| D538,986 | S | 3/2007 | Ingram |
| 7,434,604 | B2 * | 10/2008 | McDaniel et al. ..... 144/48.5 |
| 7,455,089 | B2 * | 11/2008 | McDaniel et al. ..... 144/144.1 |
| 2001/0011564 | A1 | 8/2001 | Darling |
| 2002/0066497 | A1 | 6/2002 | Froggatt |
| 2003/0041709 | A1 | 3/2003 | Jones |
| 2003/0047239 | A1 | 3/2003 | Baculy |
| 2003/0073395 | A1 | 4/2003 | Faccin et al. |
| 2003/0145705 | A1 | 8/2003 | Miller |
| 2003/0159758 | A1 | 8/2003 | Smith |
| 2003/0172993 | A1 | 9/2003 | Godfrey |
| 2003/0196726 | A1 | 10/2003 | Tucker et al. |
| 2003/0230359 | A1 | 12/2003 | Schroeder |
| 2004/0050451 | A1 | 3/2004 | Dahlhoff |
| 2004/0126197 | A1 | 7/2004 | Allemann et al. |
| 2004/0149112 | A1 | 8/2004 | Snell |
| 2004/0206865 | A1 | 10/2004 | Chang |
| 2004/0250880 | A1 | 12/2004 | Dement |
| 2005/0022899 | A1 | 2/2005 | Chang |
| 2005/0056344 | A1 | 3/2005 | Freidlund |
| 2005/0056345 | A1 | 3/2005 | Duginske |
| 2005/0115639 | A1 | 6/2005 | Bagnall |
| 2005/0161357 | A1 | 7/2005 | Allan et al. |
| 2005/0236069 | A1 | 10/2005 | O'Brien |
| 2006/0138722 | A1 | 6/2006 | Webster et al. |
| 2006/0174681 | A1 | 8/2006 | Espinosa |
| 2006/0283524 | A1 | 12/2006 | McDaniel et al. |

FOREIGN PATENT DOCUMENTS

| | | | |
|---|---|---|---|
| DE | 19715424 | A1 | 10/1998 |
| EP | 0320869 | A2 | 12/1987 |
| FR | 2843167 | A1 | 7/2003 |
| GB | 2238752 | A | 6/1991 |
| WO | WO 02/057058 | A2 | 7/2002 |

OTHER PUBLICATIONS

Vermont American, Dovetail Fixture Kit, Owner's Manual Model No. 23460, Feb. 1996, USA.

Fusso Machinery Corp., Easy-to-Operate Dovetail Machine, http://fusso.trustpass.alibaba.com/product/10770195/Easy_to_Operate_Dovetail_Machine.html, p. 2-3, (printed Nov. 17, 2005).

Akeda DC User Manual, © 2002-2005 Akeda Jigs Incorporated; Akeda Canada, P.O. Box 700, The Old Laughing Creek Steam Works, Brackendale BC, V0N 1H0, Canada; www.akeda.com; 26 pages.

Porter-Cable, Instruction Manual, Dovetail Jig, Models 4210 & 4212, May 27, 2005.

Porter-Cable, Omnijig Dovetail Machine, Parts List for 5116 Type 1, © 2005.

One (1) image of Porter-Cable Model 517, Lock Face Templet; Porter-Cable Corporation, 4825 Highway 45 North, Jackson, TN 38305; Porter-Cable Catalog, PC-912, p. 137, 1995; 1 page.

One (1) image of Porter-Cable Model 517, Lock Face Templet; Porter-Cable Corporation, 4825 Highway 45 North, Jackson, TN 38305; http://media.ptg-online.com/20040310083334_517_72dpi_500.jpg; 1 page.

One (1) image of Porter-Cable Model 59381, Hinge Butt Templet Kit; Porter-Cable Corporation, 4825 Highway 45 North, Jackson, TN 38305 ; Porter-Cable Catalog, PC-912, p. 134, 1995; 1 page.

Three (3) images of Modern Woodworking by Willis H. Wagner; Illustrating use of Rockwell Model 521, Stair Templet With Clamp Devices; © 1980 The Goodheart-Willcox Co., Inc., pp. 252-253; 3 pages.

Trend MT Jig Review, http://benchmark.20m.com/reviews/TrendMortiseJig/TrendMT_Jig Review.html; Nov. 9, 2005; 5 pages.

Leigh Versus Akeda Dovetail Jig, http://benchmark.20m.com/articles/LeighVersusAkeda.html; Nov. 9, 2005; 8 pages.

Katie Jig System brochure; Hampton House Inc., P.O. Box 7103, Greenwood, IN 46142-6421; http://www.katijig.com/KJ8PG.pdf; U.S. Patent Nos. 5,832,977 and 6,116,303; Nov. 9, 2005; 8 pages.

The Katie Jig Manual, © 1997-2000 Hampton House, Inc. Hampton House Inc., P.O. Box 7103, Greenwood, IN 46142-6421; http://www.katijig.com; U.S. Patent No. 5,832,977; Nov. 9, 2005; 34 pages.

Porter-Cable Dovetail Machine, Parts List; Model 4112; Parts List No. 900488-0011; © 2000 Porter-Cable Corporation, 4825 Highway 45 North, Jackson, TN 38305; 1 page.

Porter-Cable Dovetail Fixture/Jig Instruction Manual, Model 4112; Part No. 900487-09-12-03; © 2003 Porter-Cable Corporation, 4825 Highway 45 North, Jackson, TN 38305; 15 pages.

Porter-Cable Omnijig Dovetail Machine Parts List; Model 7116; Parts List No. 876389-002; © 2000 Porter-Cable Corporation, 4825 Highway 45 North, Jackson, TN 38305; 3 pages.

International Searching Authority, Invitation to Pay Additional Fees and Communication Relating to the Results of the Partial International Search, May 13, 2008 (4 pages).

* cited by examiner

JIG APPARATUS

CROSS REFERENCE

The present is a continuation-in-part application of U.S. patent application Ser. No. 11/399,316, filed Apr. 7, 2006, now U.S. Pat. No. 7,434,604, which application is a continuation-in-part of U.S. patent application Ser. No. 11/186,408, filed Jul. 21, 2005, now U.S. Pat. No. 7,455,089, which application claims priority under 35 U.S.C. §119(e) to U.S. Provisional Patent Application Ser. No. 60/592,734, filed on Jul. 30, 2004, and to U.S. Provisional Patent Application Ser. No. 60/664,053, filed on Mar. 22, 2005, each application being hereby incorporated by reference in its entirety.

FIELD OF THE INVENTION

The present invention generally relates to the field of woodworking and joinery. More particularly, embodiments of the present invention relate to a jig apparatus used to aid in the formation of one or more types of joint.

BACKGROUND OF THE INVENTION

The ability of a craftsperson to form fine joinery is often the true measure of the person's woodworking skill. Poorly fitting joints may detract from a project's aesthetics and functionality, especially for fine cabinetry. Proper fit and assembly often require a high level of skill or a large time commitment on behalf of a novice woodworker. To aid in the process, a woodworker will often employ a jig or form to assist in proper joint formation. Prior jigs tend to be complex to set-up, making it difficult to understand how adjustments impact the finished workpiece. Prior jigs often lack efficient methods for reestablishing settings used in forming commonly made joinery, such as dovetails, box joints, and mortise and tenon joints. Rather than attempting to use a complex or non-intuitive jig, novice woodworkers may avoid forming fine joints, instead selecting a simpler joint such as a butt joint. Expert woodworkers may become frustrated with the set-up time required for the jig device.

Typical jig devices may lack the ability to form a wide variety of joints. As a result, a woodworker may need multiple devices. For example, a user may own one jig for making dovetail joints used in drawers and cabinets and an entirely separate jig for forming the mortise and tenon joints needed to assemble a table leg and rail. In addition to the expense, these devices may consume valuable workshop space.

While some devices permit the formation of multiple joint types, such as through dovetails, half-blind dovetails and box joints, the user may be forced to accept a lower quality joints due to difficulty or error in set-up. The user may also be required to spend non-productive time conducting test cuts to ensure the desired fit. For example, in a half-blind dovetail, if a router bit does not extend the correct distance into a workpiece, the resulting joint may be too loose or too tight. Other joints face similar issues that affect the fit and finish of the joint and the overall quality of the finished product.

Prior jigs do not offer convenient workpiece positioning and securing. For example, when forming half-blind dovetails in a single pass (when both the pins and tails are formed in a single operation), the workpieces are offset from each other along the length of the joint. The offset accounts for the spacing between pins/tails so that the workpieces correctly align in the finished joint. Prior jigs may not have a convenient way to accurately provide this offset.

Once properly positioned, a workpiece must be firmly secured to prevent inadvertent movement during a shaping or cutting operation. Clamps or other securing devices with both coarse and fine adjustment are advantageous in securing a workpiece. However, prior art devices may not include a convenient method or apparatus for coarse and fine adjustment.

Joints are typically formed with workpieces either at right angles, as in dovetail joints, or parallel, as in some mortise and tenon joints. If a craftsperson desires to form a joint at some other angle, the craftsperson may be forced to hand form the joint or purchase/construct a separate jig to accommodate the desired angle.

Dust and debris generated by operation of a router may get caught between the router sub-base plate and the template or may find their way into various other portions of the router or jig. The user may need to halt operations and spend non-productive time removing the dust and debris.

Therefore, it would be desirable to provide a jig apparatus configured for efficient, intuitive set-up. It would also be advantageous to provide a jig apparatus capable of accurately forming a variety of quality joints at various angles and offsets without the drawbacks experienced in the prior art.

SUMMARY OF THE INVENTION

Accordingly, the present invention is directed to a jig apparatus for utilization in forming a variety of corresponding interconnecting structures for forming joinery between wooden workpieces.

In an aspect of the invention, a jig apparatus base having an intermediate zone configured to minimize or prevent inadvertent contact between a bit and the base is disclosed. An intermediate zone is constructed in the base to provide a void adjacent a cutting interface of a router bit in a workpiece that is secured to the jig apparatus. Suitable constructions include angled or stepped interfaces between a first side of the base and a second side of the base. Additionally, a recess or void may be constructed in the base between the first and second sides for preventing inadvertent contact.

In an additional aspect of the invention, a template mounting system is discussed. In embodiments, suitable template mounting systems include opposing slotted brackets attached to a template and received by a threaded lock-down knob system. In further embodiments, a mounting bracket includes an elongate rail for receiving a template including an aperture or channel corresponding to the rail. A template mounting system in accordance with the present aspect may permit the utilization of a single template having multiple guides so as to provide increased versatility. The mounting system may allow for adjustable positioning with respect to a jig base having a first side and a second side orthogonally aligned to each other.

In a further aspect of the present invention, a visual alignment system may be included in the jig apparatus for assisting the user in proper alignment of the template with the workpiece and base. In embodiments, a visual indicia or marker such as a scribed line may be included on a template for visual alignment with an edge of the workpiece or the abutment of workpieces to be shaped.

In another aspect of the present invention, a clamp assembly securing mechanism is disclosed. An exemplary clamp assembly may include a slideable mounting block positioned on a threaded rod extending outwardly from the base. A threaded knob may be utilized to secure the mounting block along the rod. A lock bar is pivotally coupled to the mounting block. The lock bar may be formed or include an eccentric portion or cam portion for securing a workpiece disposed between the base and the lock bar. An engaging plate may be disposed between the lock bar and the workpiece in order to provide even application of force to the workpiece.

In an additional aspect of the present invention, a router bit positioning system is described. The router bit positioning system may promote efficient positioning of the depth of a router bit, or the extent to which a router bit extends beyond a router base plate. A bit stop may be mounted to the base, a tab extending from the template, or a dedicated housing. The bit stop may be fixed at a pre-selected depth commonly implemented to offset distance or allow for adjustment such as by utilizing a threaded rod, screw or the like.

In a further aspect of the invention, a removable assembly may be included for forming mortise and tenon joints. The mortise and tenon assembly may attach to the jig base and have two parts, a base assembly and a finger assembly. The finger assembly may have adjustable rails and fingers to form different sizes of mortise and tenon joints. The base assembly may pivot with respect to the finger assembly allowing the user to form joints at variable angles. The mortise and tenon assembly may include set-up guides to aid in accurately adjusting the finger assembly.

In an additional embodiment of the invention, the mortise and tenon base assembly may be integrally formed with the base such that the jig apparatus comprises a template having a guide surface, a first workpiece support surface, a first clamp assembly adapted to secure a workpiece against the first workpiece support surface, a second workpiece support surface, and a second clamp assembly adapted to secure a workpiece against the second workpiece support surface, wherein the second workpiece support surface is pivotally connected to the base. In this manner, the jig apparatus could be used to form mortise and tenon, dovetail, and other joints at an angle other than ninety degrees.

In another aspect of the present invention, a variable spacing router collar system may be included for varying the spacing or the distance between an included router bit and the template guide surface being traced. A generally cylindrical collar body may be secured to a router base or sub-base via a threaded locking ring engaging threading included on an outer surface of the collar body. A kit or series of outer sleeves and/or collar bodies having differing outside diameters may be attached about a portion of the collar body through a magnetic interaction or an intermediate elastomeric O-ring to effectuate different spacings. Alternatively, separate, varying-sized guides may be attached to the router base using a quick-change system. A mounting ring (with female threads) may be inserted through, and attached to the bottom of the router base. Template guides having male threads matched to the female threads of the mounting ring can be quickly and easily screwed into the mounting ring. The template guides may include tabs cut into the lower end of each guide so an appropriate wrench can tighten or loosen the guide.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The accompanying drawings, which are incorporated in and constitute a part of this specification, illustrate embodiments of the invention. In the drawings.

DETAILED DESCRIPTION OF THE DRAWINGS

The following description is intended to convey a thorough understanding of the invention by providing a number of specific embodiments and details involving a jig apparatus. It is understood, however, that the invention is not limited to these specific embodiments and details, which are exemplary only. It is further understood that one possessing ordinary skill in the art, in light of known systems and methods, would appreciate the use of the invention for its intended purposes and benefits in any number of alternative embodiments.

While the described embodiments are generally directed to an apparatus in which a user manipulates a hand-held router with respect to a fixed workpiece, principles of the present invention may be equally applicable to an apparatus that uses a fixed cutter, such as in a router table. It is the intention of this disclosure to encompass and include such variation.

Figure 2:
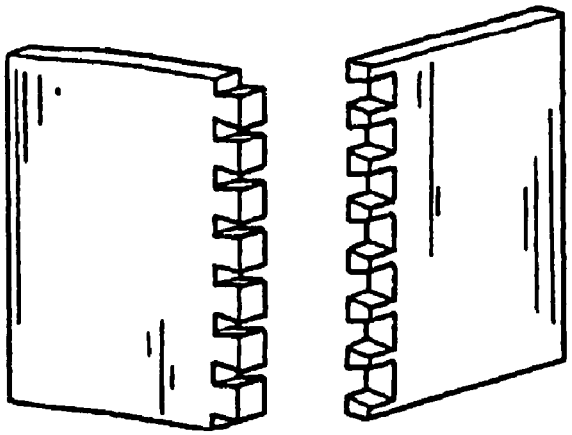
FIG. 2 is a general illustration of a resultant through dovetail joint formed in two workpieces.
Figure 3:
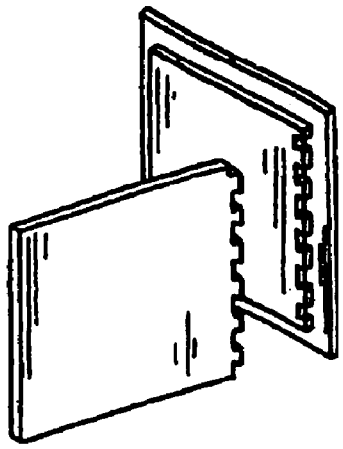
FIG. 3 is a general illustration of a resultant half-blind recessed dovetail joint formed in two workpieces.
Figure 4:
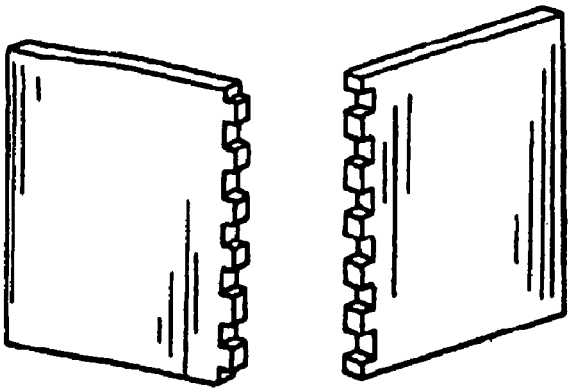
FIG. 4 is a general illustration of a resultant box joint formed in two workpieces.
Figure 5:
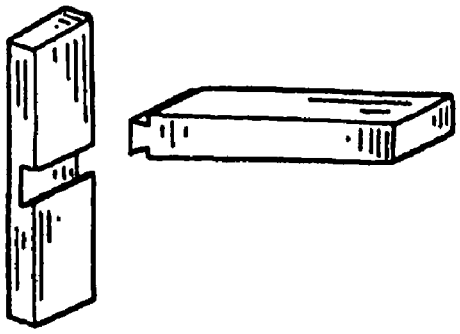
FIG. 5 is a general illustration of a resultant sliding tapered dovetail formed in two workpieces.
Figure 6:
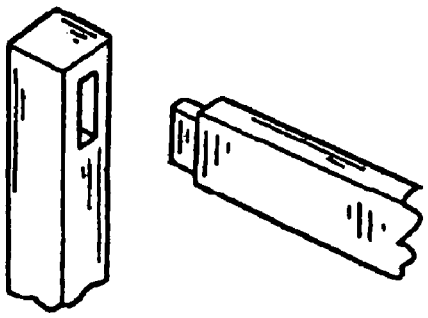
FIG. 6 is a general illustration of a resultant mortise and tenon joint formed in two workpieces.
Figure 7:
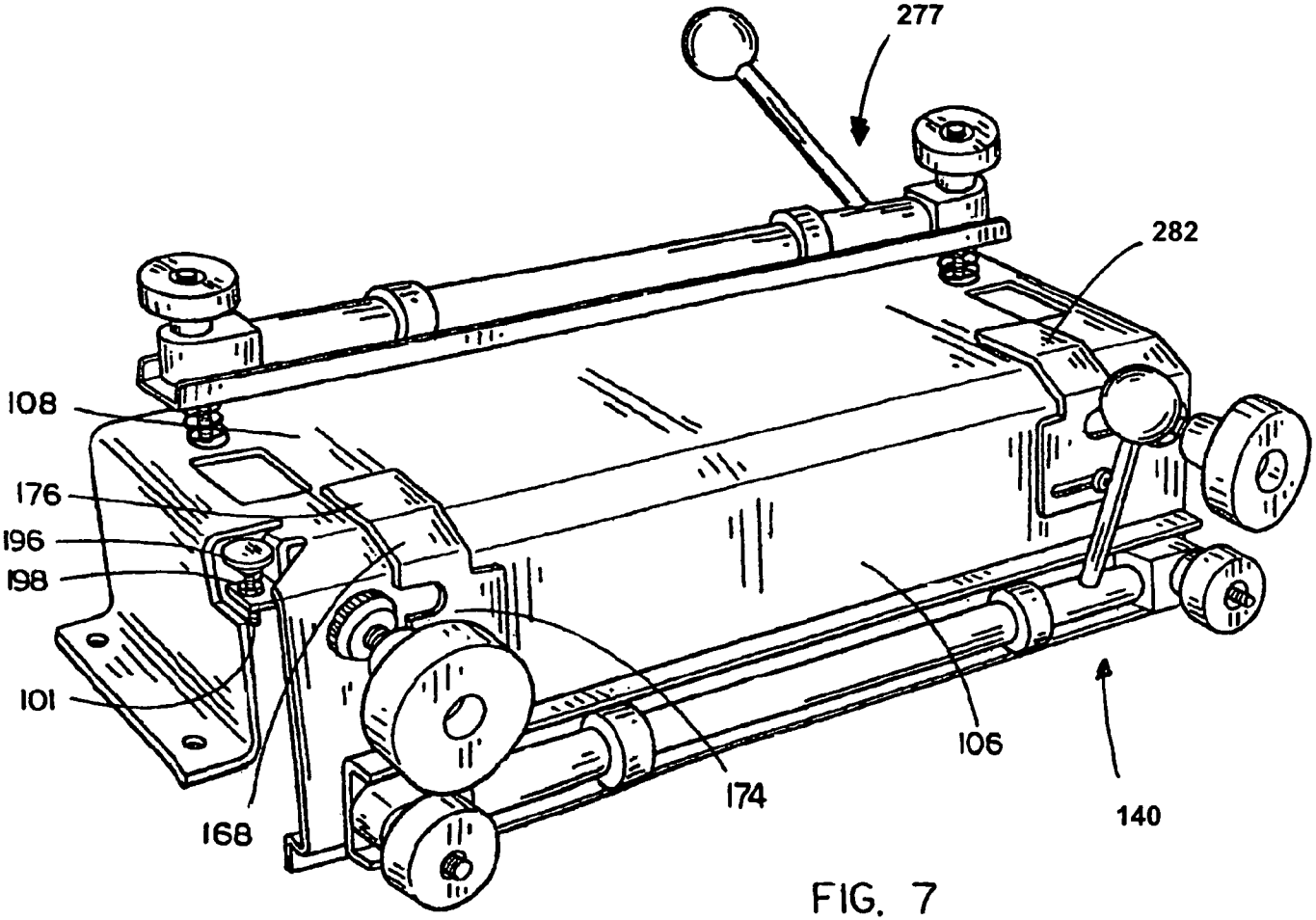
FIG. 7 is an isometric view of a jig apparatus of FIG. 1, wherein the template is not present.

Referring to FIGS. 2 through 6, while not inclusive, representative joints formed in workpieces include: FIG. 2 illustrating a typical through dovetail joint, wherein the pins/tails (having linear angled sides) are observable along both sides of the connection; FIG. 3 illustrating a half-blind dovetail joint, wherein the joint is generally observable from one side (in the present instance the half-blind dovetail is recessed towards the interior of one of the workpieces such as by rabbeting material from the edge of the workpiece); FIG. 4 illustrating a box joint, wherein the pins/tails (having linear sides which are generally perpendicular to the end of the workpiece) are observable along both sides of the connection; FIG. 5 illustrating a sliding tapered dovetail having a tongue/groove with a generally trapezoidal shape; and FIG. 6 illustrating a mortise and tenon, wherein the a generally rectilinear tongue is inserted into a blind generally rectilinear recess. Those of skill in the art will appreciate that the foregoing descriptions and the accompanying figures are only generally illustrative as some curvature, or other variation, may occur due to operation of a rotating bit generally following a template.

Figure 1:
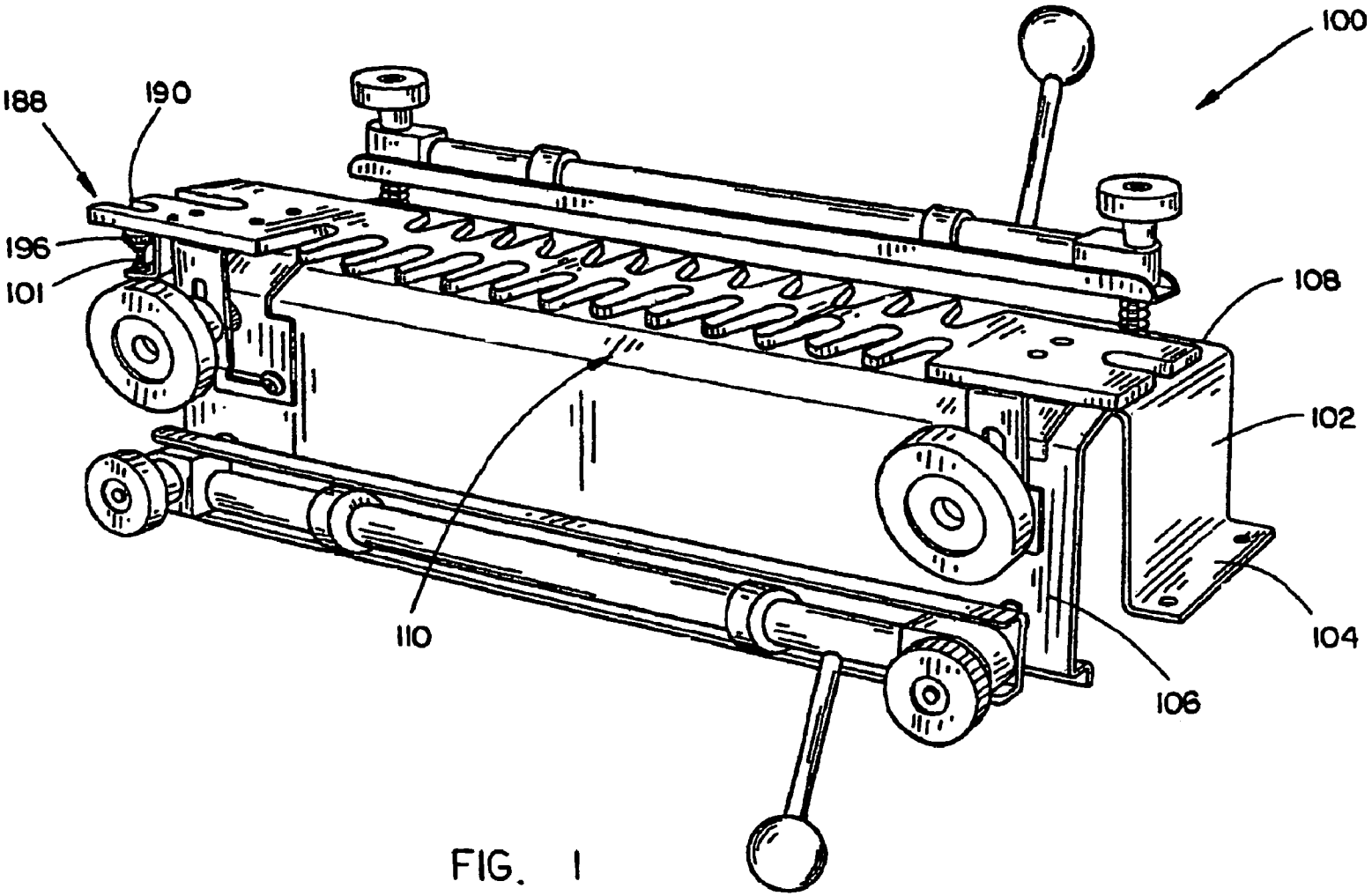
FIG. 1 is an isometric view of a jig apparatus in accordance with an aspect of the invention.

Referring to FIG. 1, the jig apparatus 100 includes a base 102. The base 102 is formed by bending a sheet of metal, having appropriate rigidity, durability, and other characteristics, into a generally rectangular configuration. Suitable materials include steel, aluminum alloys, and the like. The base may alternatively be formed from other materials or by other methods such as plastics, cast and/or machined metal, extruded aluminum, or any other material having sufficient rigidity and durability. The base 102 includes a flange 104. The flange may be used together with a clamp or other fastener to attach the apparatus along an edge of a workbench or other suitable support surface. An embodiment of the base 102 includes a front face 106 and a top face 108 substantially perpendicular to the front face. With the jig apparatus attached to a mounting surface, the top face 108 forms a substantially horizontal surface of the jig, and the front face 106 forms a substantially vertical surface of the jig.

Figure 8A:
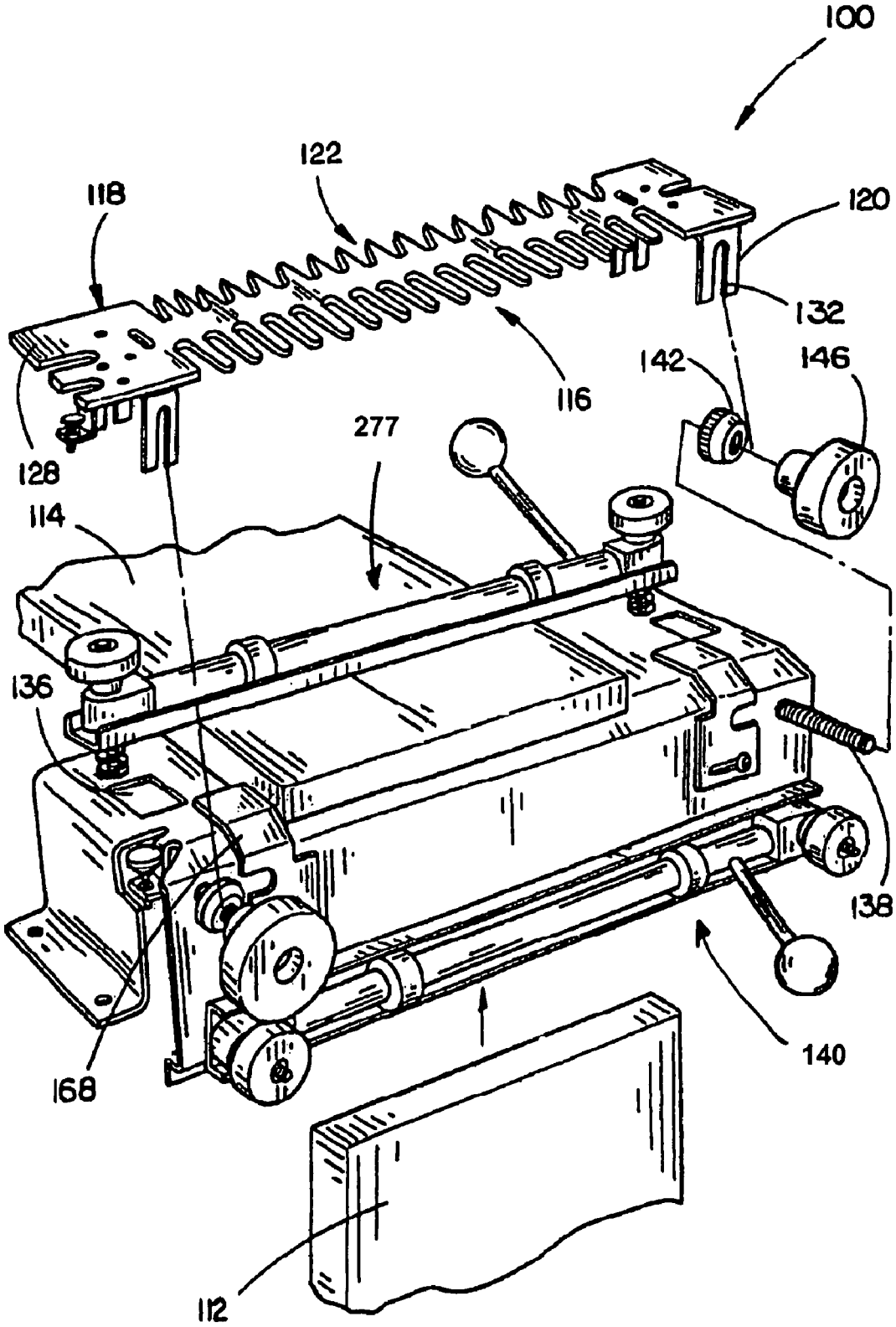
FIG. 8A is an exploded view of a jig apparatus of FIG. 1 further illustrating placement of example workpieces.
Figure 8B:
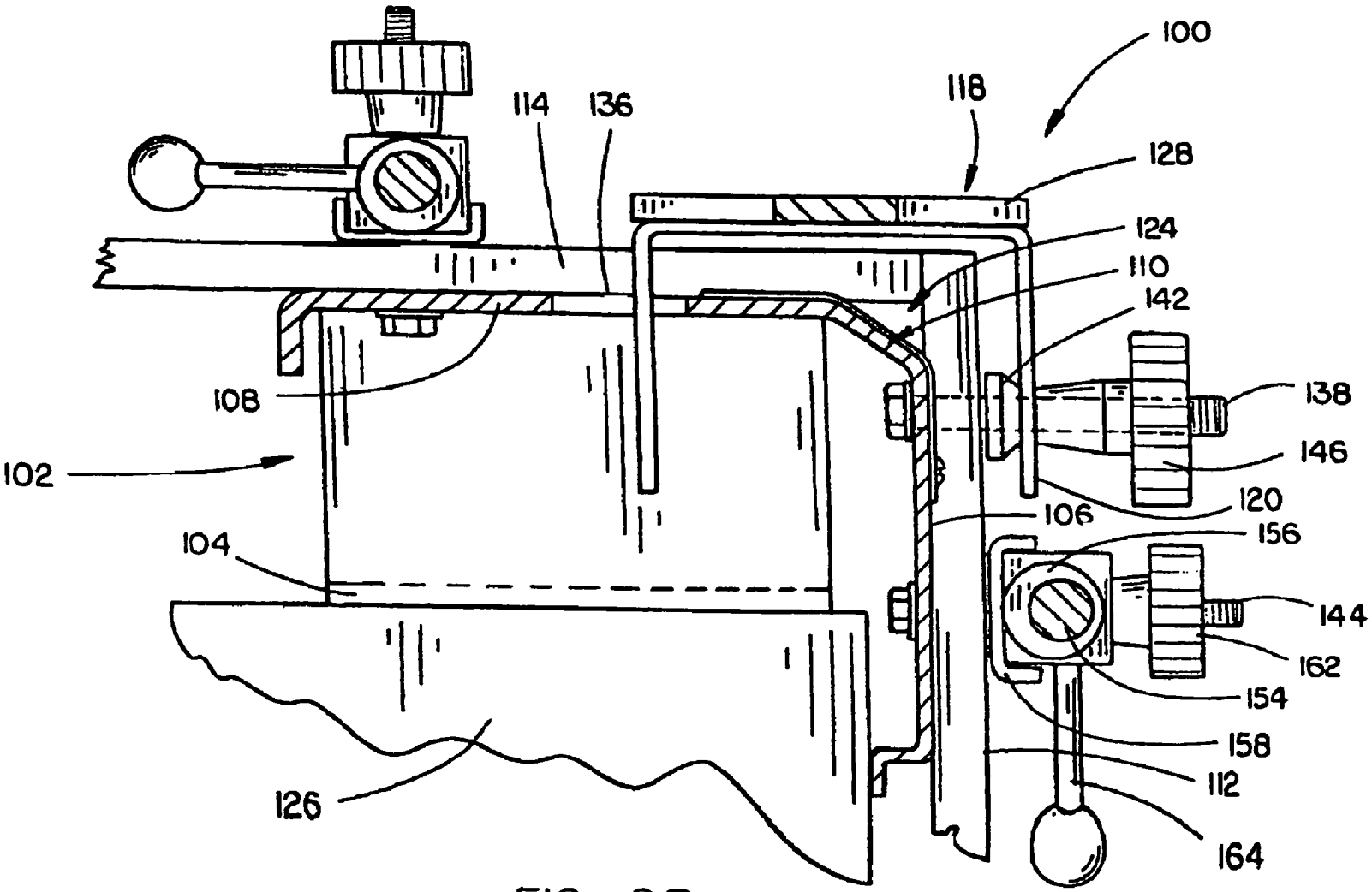
FIG. 8B is a cross-sectional view of a jig apparatus including example positioned workpieces.

As shown in FIG. 8B, the front face 106 of the base may extend below the edge of the support surface 126 permitting a portion of the jig to contact a front edge of the support surface 126 thereby orientating the jig 100 and minimizing movement of the jig on the support surface.

Referring to FIGS. 7, 8A, 8B and 11, an embodiment of the jig apparatus further includes a clamping system designed to secure one or more boards or workpieces and minimize workpiece slippage during cutting or shaping. The clamping system secures the workpieces in either or both of a vertical position against the front face 106 of the base or a horizontal position across the top face 108 of the base. The clamping system uses one or more clamp assemblies 140, 277. A first clamp assembly 140 secures a workpiece 112 vertically against the front face 106 of the base 102 by sandwiching the workpiece between the front face and the clamp assembly 140, and a second clamp assembly secures a workpiece 114 horizontally against the top face 108 of the base by sandwiching the workpiece between top face and the clamp assembly 277. The clamp assembly permits efficient coarse and fine adjustment in order to permit rapid workpiece securing.

Figure 11:
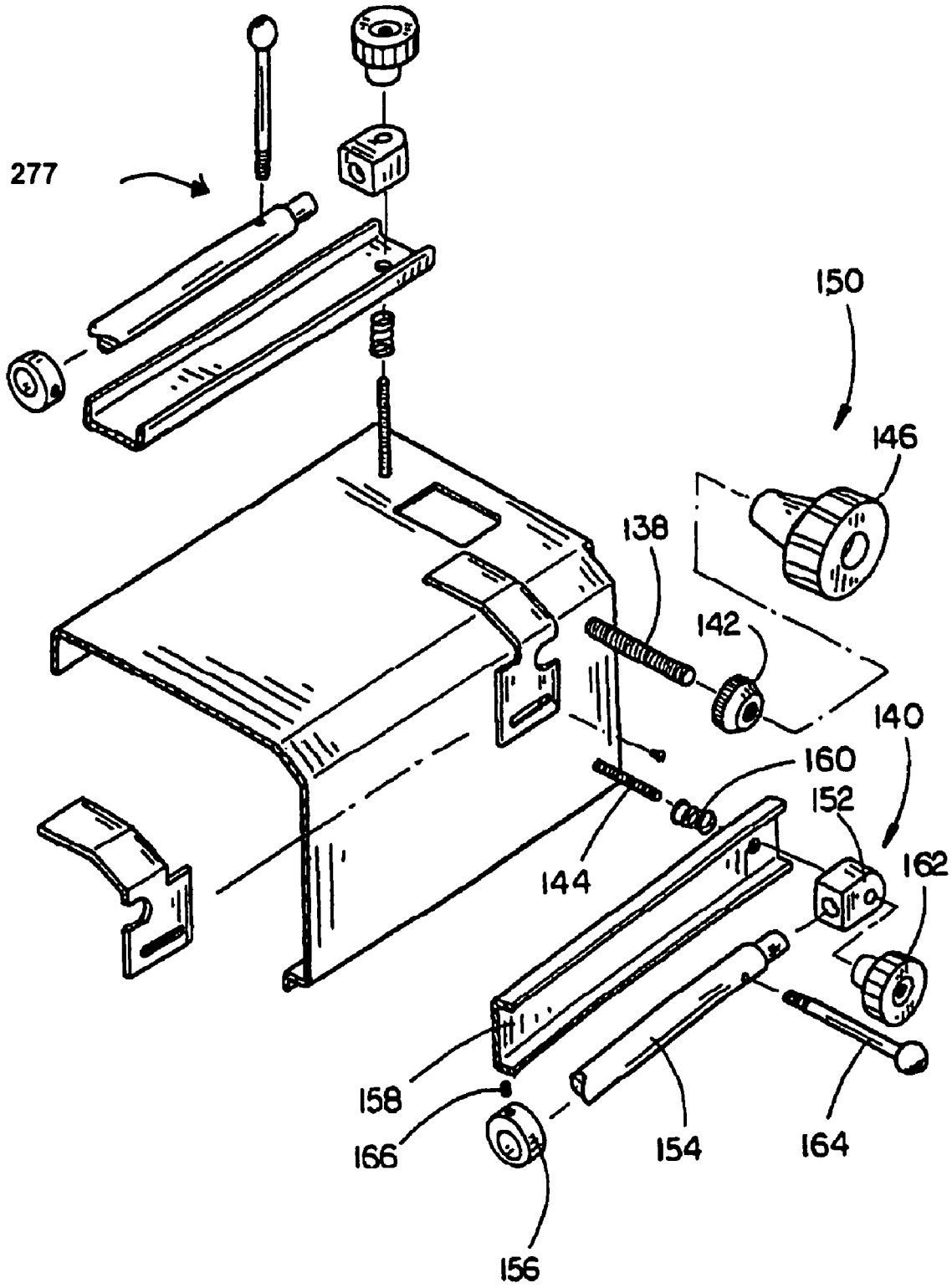
FIG. 11 is a partial exploded view of template mounting system and clamping mechanism in accordance with an aspect of the present invention.
Figure 12:
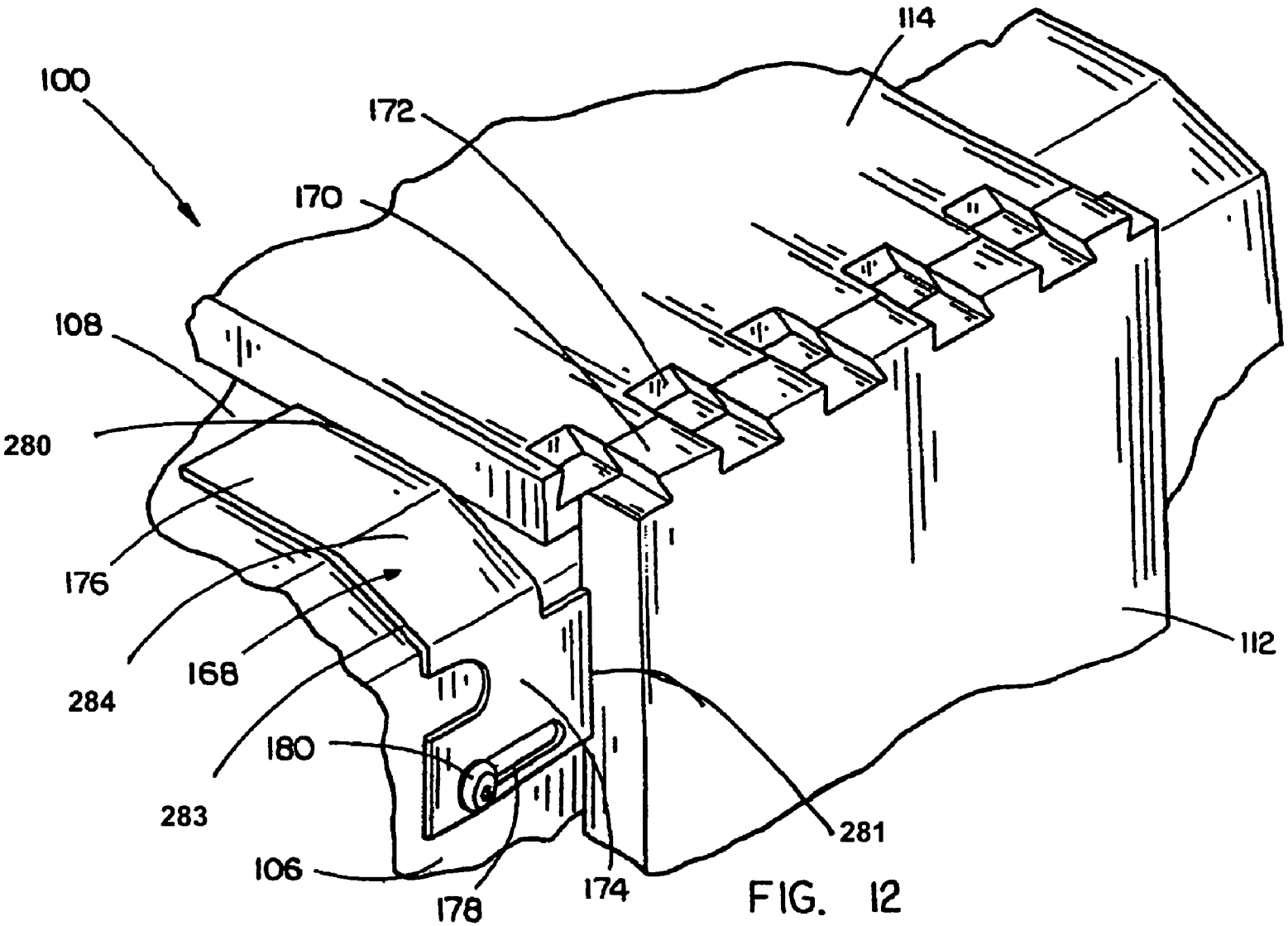
FIG. 12 is a partial view of a workpiece stop being generally implemented for single pass half-blind dovetail formation.

Referring to FIG. 11, the following discussion relates to a clamp assembly 140 disposed adjacent the front face 106 of the jig. However, one of ordinary skill in the art would appreciate the use of this or similar clamp assemblies adjacent the top face 108 or other portions of the jig. In the current embodiment, a threaded rod 144, such as a bolt, extends outwardly from the front face 106 of the base substantially adjacent a first edge of the face. The threaded rod 144 or bolt may be secured to the base via any appropriate method, such as a weld, an adhesive, a nut, or engagement with a threaded aperture in the base. A second threaded rod (not shown in FIG. 11) extends outwardly from the front face of the base at substantially adjacent a second edge of the face.

A mounting block 152 mounts on the threaded rod 144. The mounting block 152 includes a through aperture so that the mounting block may slide along the threaded rod 144. A lock bar 154 is pivotally coupled to the mounting block. For example, the lock bar 154 may have a terminal portion forming a trunnion, and the mounting block may have a corresponding aperture or recess.

An internally threaded knob 162 secures the mounting block 152 to the threaded rod 144. The knob can be rotated to coarsely adjust the clamp assembly spacing depending on the workpiece thickness. The knob may include a separate nut having a threaded aperture corresponding to the threaded rod 144, or the knob may have an integrally formed threaded aperture. The knob 162 may include protrusions and/or surface texturing for promoting ergonomic manipulation.

Figure 51:
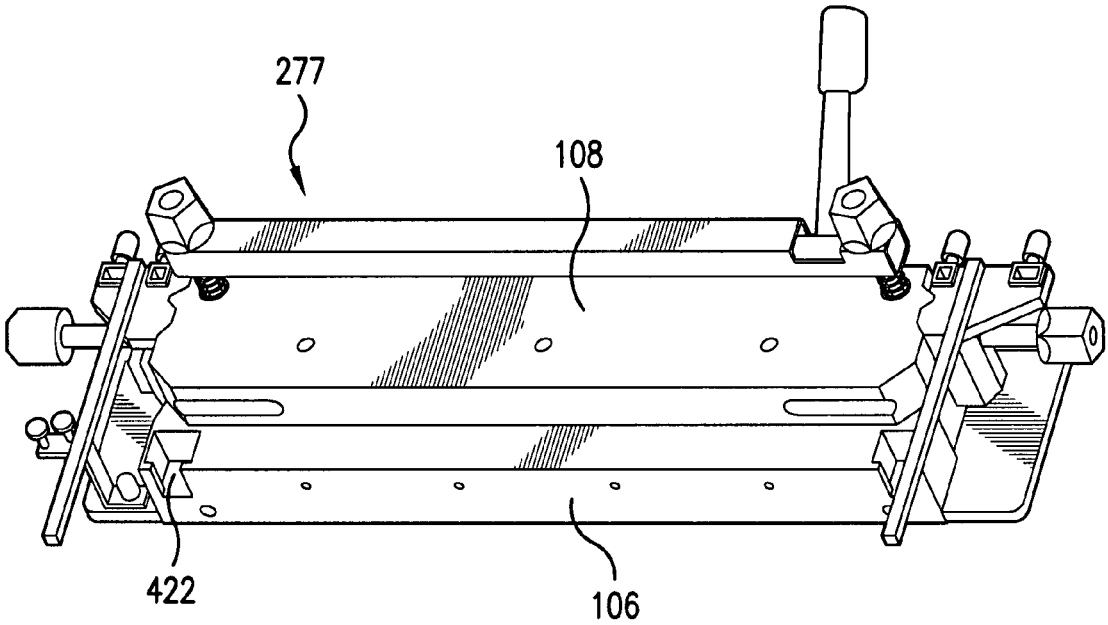
FIG. 51 is an isometric view of an embodiment of the jig apparatus having a removable clamp assembly, the figure showing the base with the clamp assembly removed.
Figure 52:
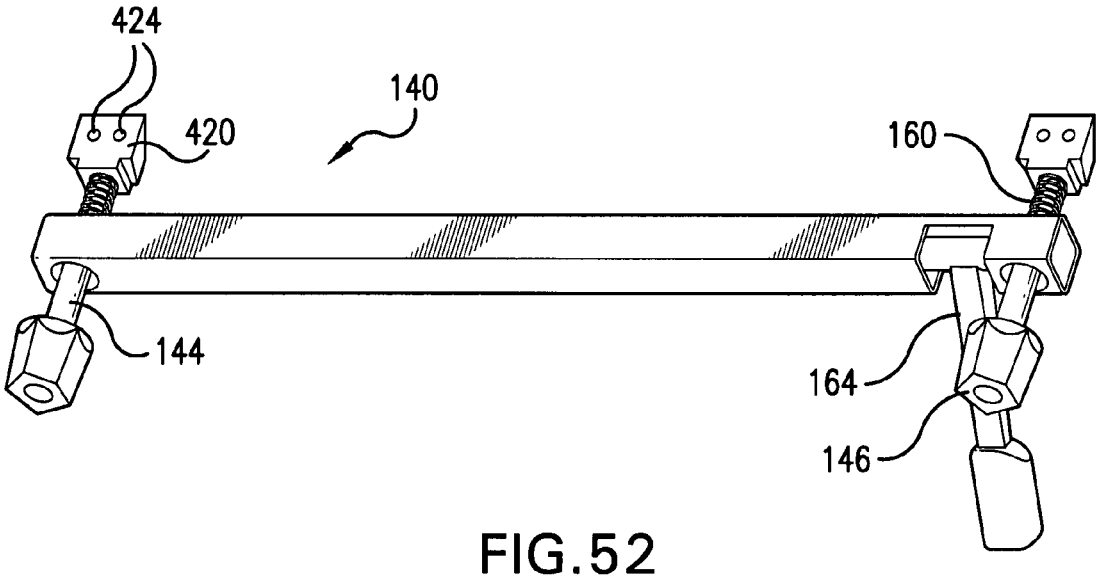
FIG. 52 is an isometric view of the removable clamp assembly of FIG. 51.
Figure 53:
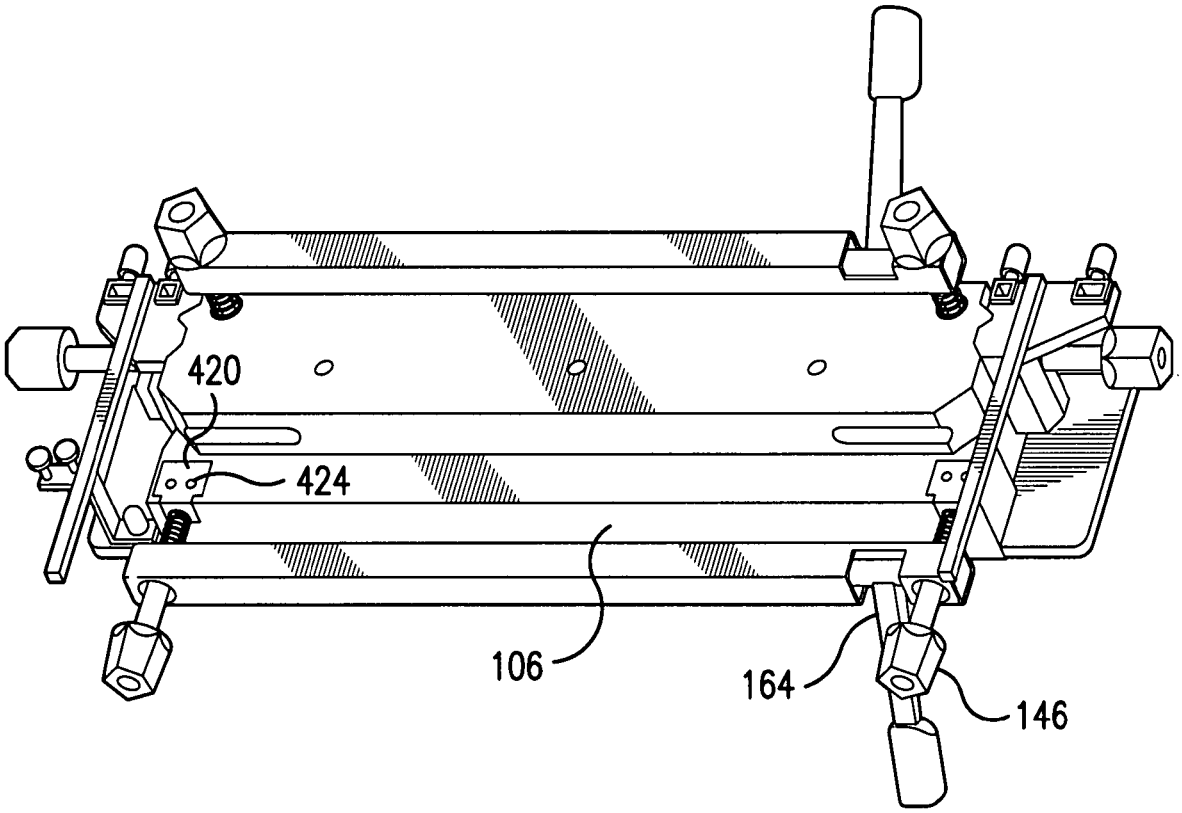
FIG. 53 is an isometric view of the embodiment of FIG. 51, showing the clamp assembly attached to the base.
Figure 54:
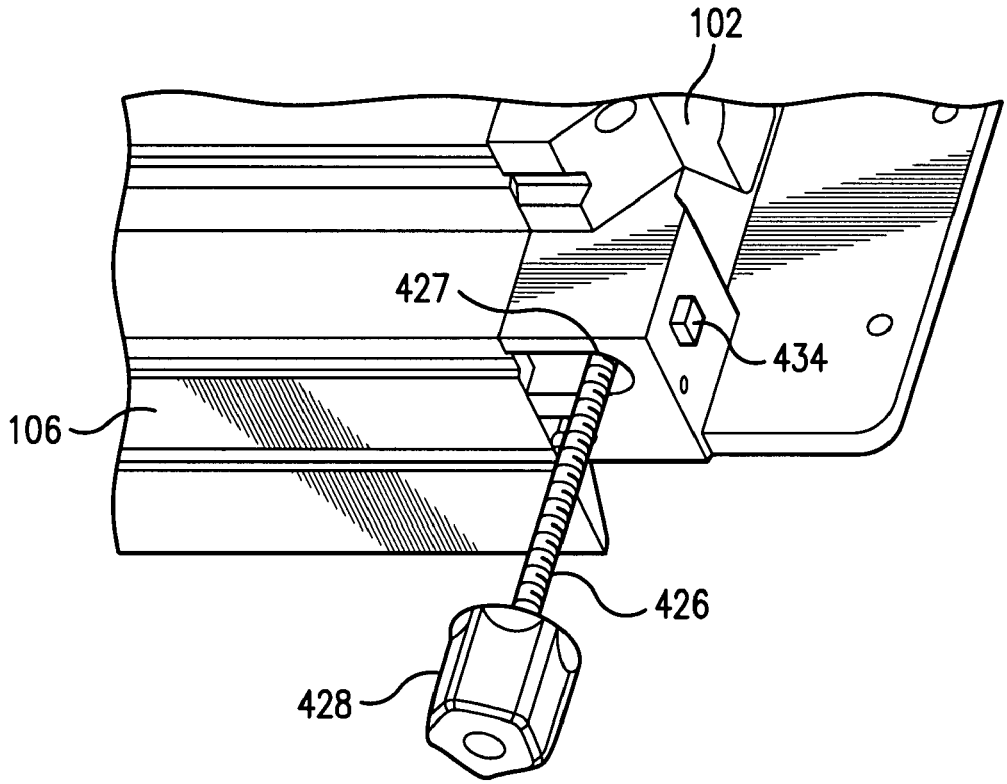
FIG. 54 is a partial isometric view of a removable threaded rod for use with a removable clamp assembly in accordance with embodiments of the invention.
Figure 55:
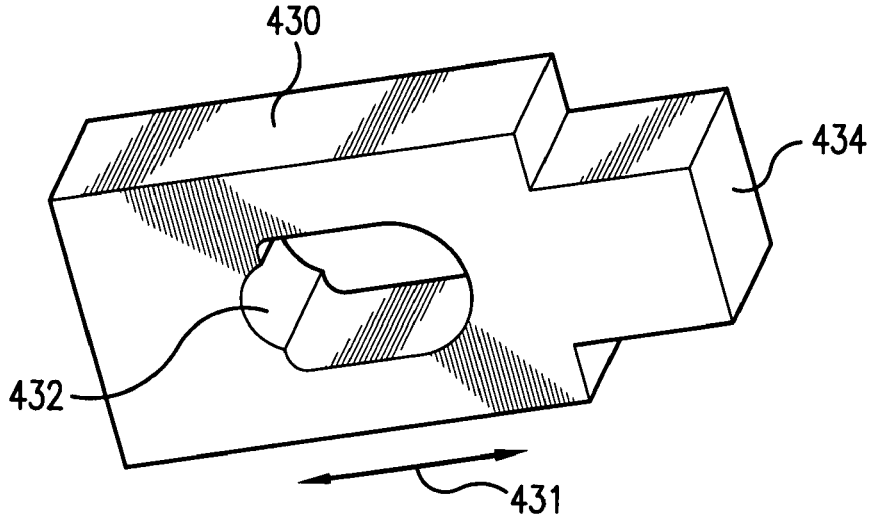
FIG. 55 is an isometric view of an engagement block for use with the removable threaded rod of FIG. 54.

In further embodiments, the clamp assembly 140 can be removed from the front face 106 of the base. As illustrated in FIGS. 51-53, embodiments of the threaded rod 144 include a protrusion 420. The protrusion 420 fits into a recess 422 formed in the base 102 such that the threaded rod 144 extents beyond the front face 106 of the base when the protrusion is placed in the recess. The protrusion may be secured to the base by interlocking with the recess and/or by the use of screws 424. The protrusion may also be secured by another means or combination of means as would be apparent to one of skill in the art Referring to FIG. 54-55, an alternative embodiment provides coarse adjustment utilizing a threaded rod 426 attached to or integrally formed with a knob 428. The threaded rod is inserted through the mounting block and into the front face 106 of the base. The base has an aperture 427 with a threaded nut or insert attached behind the aperture, or the aperture itself may be threaded. The clamp assembly may be removed by unscrewing the threaded rod 426 from the aperture 427.

A further alternative embodiment includes means for quickly releasing the threaded rod 426 from the base. The base includes an aperture 427. An engagement block 430 is also positioned behind the aperture and is movable relative to the aperture in a direction shown by arrow 431. The engagement block includes a portion of female threads 432 and an extension or button 434. A spring, or other appropriate means, biases the second engagement block against the threaded rod 426, engaging the threads of the rod with the portion of female threads formed in the engagement block 430, and securing the threaded rod to the base. When the user wishes to remove the clamp assembly from the front face of the jig, the user presses the button 434, overcoming the spring bias, and separating the engagement block 430 from the threaded rod 426. The threaded rod 426 is released from the female threads and can be pulled from the base without turning the rod through its entire length. To re-attach the clamp assembly, the user pushes the button 434, inserts the threaded rod 426 into the aperture 427, and releases the button. The spring bias presses the block 420 against the rod 426, engaging the corresponding male and female 432 threads.

After the mechanism is coarsely adjusted for the appropriate workpiece thickness, the user secures the workpiece using an eccentric cam mechanism. The lock bar 154 includes an eccentric portion 156, which is secured to the generally cylindrical lock bar 154. A handle 164 protrudes from the lock bar 154 such that movement of the handle causes the lock bar to rotate. As the user rotates the handle, the lock bar and eccentric cam 156 also rotate. The eccentric cam presses against the workpiece 112, securing the workpiece against the front face 106 of the base.

The lock bar may include a single cam portion or multiple cams. Preferably, the eccentric portions are spaced apart to ensure that a proper securing force is applied generally along the length of the lock bar. The eccentric cam may be integrally formed with the lock bar or may be secured to the lock bar via a set screw 166 or other appropriate means, such as a polygonal shape formed on the outside of the lock bar with a correspondingly shaped aperture formed in the cam. The eccentric portion 156 may be formed of a durable plastic or the like having sufficient rigidity to withstand workpiece clamping pressure.

Embodiments of the clamp assembly may include a workpiece engaging plate 158 for providing substantially even pressure across a workpiece/engaging zone. The plate 158 may prevent the eccentric portions 156 from marring or otherwise damaging the workpiece 112 by providing increased contact area. The engaging plate 158 may include surface texturing or a coating in the contact area for aiding workpiece engagement. In further embodiments, the engaging plate may include edges to form a trough or enclosure surrounding at least a portion of the lock bar 154. Additionally, the lock bar and or the mounting block 152 may be biased away from the base to permit efficient insertion of a workpiece between the base 102 and the securing mechanism. For example, a compression spring 160 may be disposed about the threaded rod 144 between the front face 106 and the engaging plate 158 in order to force the engaging plate and lock bar generally away from the base when the clamp assembly 140 is not in an engaged condition.

According to an embodiment of the invention, when using the jig, the user first positions the workpiece 112 between the engaging plate 158 and the front face 106. The user tightens the knobs 162 toward the base until the mounting block 152 and lock bar 154 are within range of the cams 156. The user then rotates handle 164, which rotates lock bar 154 and eccentric cam 156. The eccentric cam 156 presses against the locking plate 158, pressing the plate firmly against the workpiece and securing the workpiece against the base. In the foregoing manner, the clamping assembly functions to permit coarse adjustment via the threaded knob and fine adjustment through the clamping action of the cams and lock bar. Those of skill in the art will appreciate that the steps/order of the foregoing method are exemplary only and are not to be understood as limiting.

Figure 13:
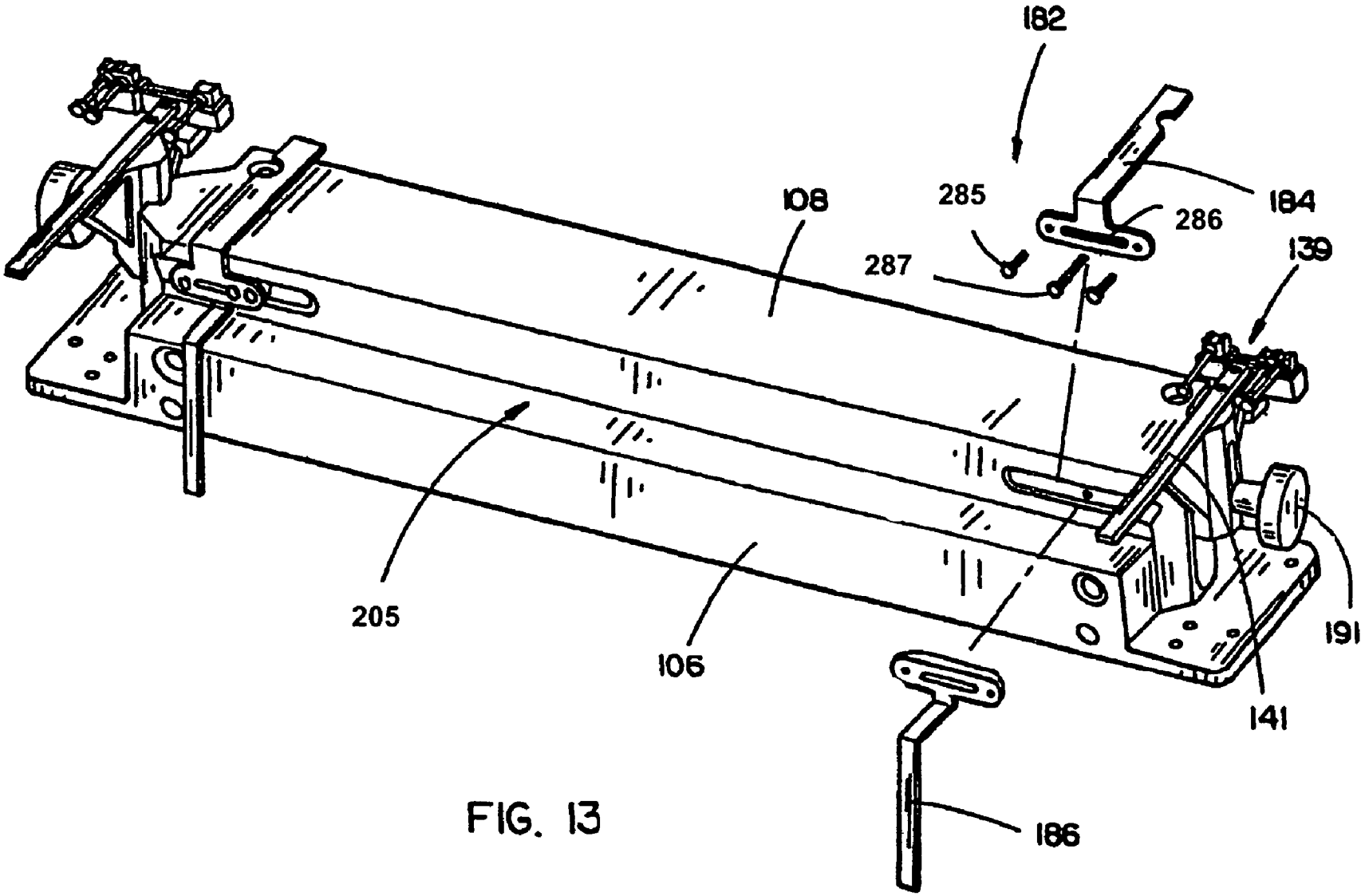
FIG. 13 is an isometric view of a jig apparatus illustrating an exemplary workpiece stop and a template mounting system in accordance with an additional aspect of the present invention.

In an embodiment of the invention, the front face 106 and top face 108 of the base 102 come together with at beveled edge 110. The beveled edge 110 allows a cutter (e.g., a router bit) to cut completely through a workpiece as it follows a guide or template without impacting a face of the jig. For example, as may be generally observed in FIGS. 7, 8A, and 8B, when cutting a half-blind dovetail in a single pass, or performing a unitary operation, two workpieces 112, 114 are aligned for shaping. The user aligns the first workpiece 112 vertically on the front face of side 106 and the second workpiece 114 horizontally on the top face of side 108. The respective ends of the workpieces 112, 114 are brought into abutment (as shown in FIG. 8B). Typically an end of the first board 112 extending flush with the top surface of the second board 114. The beveled edge 110 defines a void 124 at the interface of the workpieces adjacent the front and top faces of the base. In this fashion, as a router/router bit following a guide 116 is unlikely to inadvertently contact the base 102. Other configurations may be implemented as well, for example, a void or recess may be formed between the first and second side in order to provide a clearance space in the base adjacent an end of the workpiece. In an alternative embodiment, as illustrated in FIG. 13, the interface between the front face 106 and the top face 108 includes an intermediate stepped or recessed zone 205.

Figure 59:
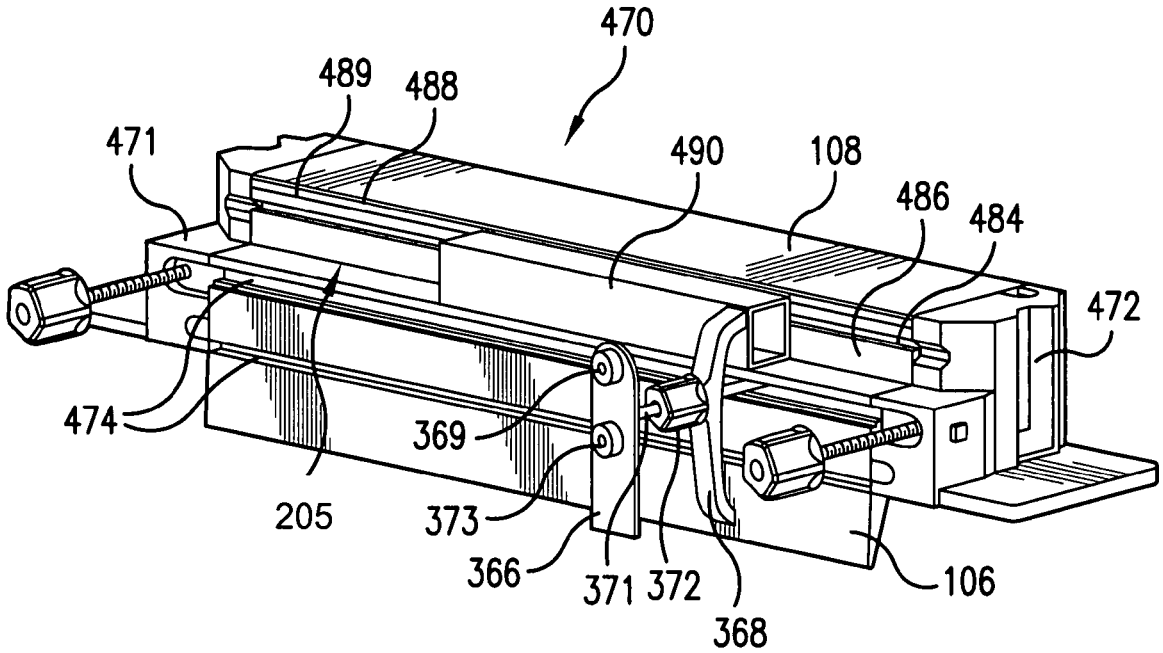
FIG. 59 is an isometric view of an embodiment of base having an extruded center section, end caps, and a support block.
Figure 60B:
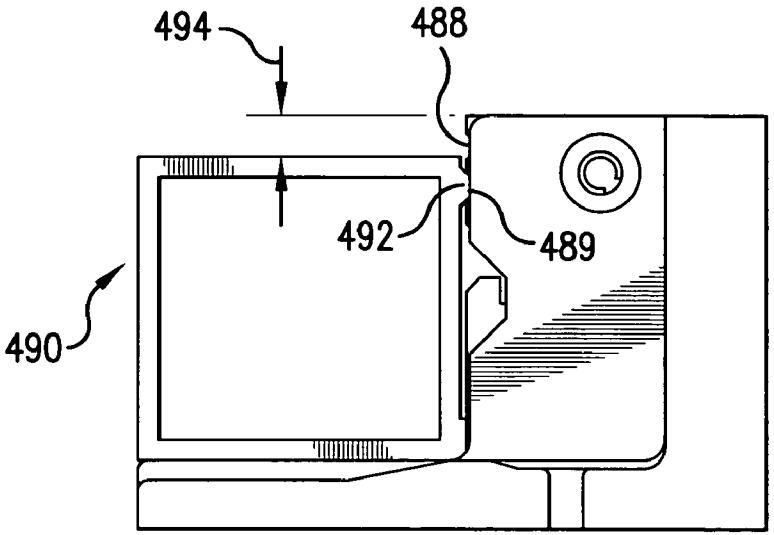
FIG. 60B is a plan view of the base and support block of FIG. 59 with the support block in a second position.
Figure 60A:
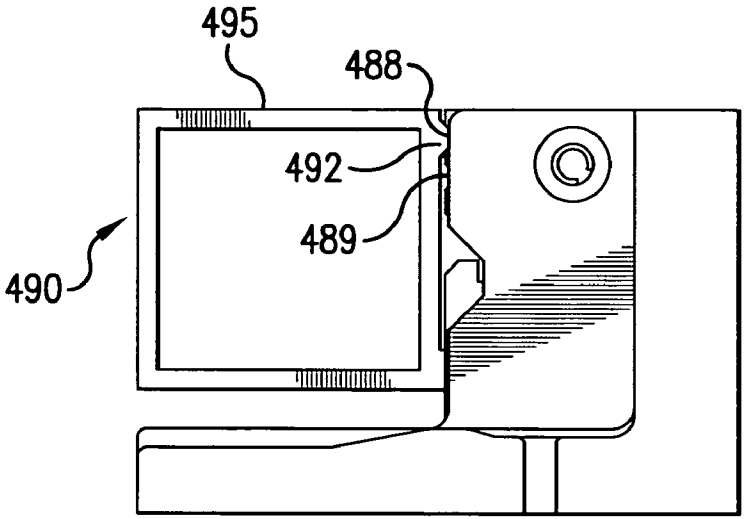
FIG. 60A is a plan view of the base and support block of FIG. 59 with the support block in a first position.
Figure 61:
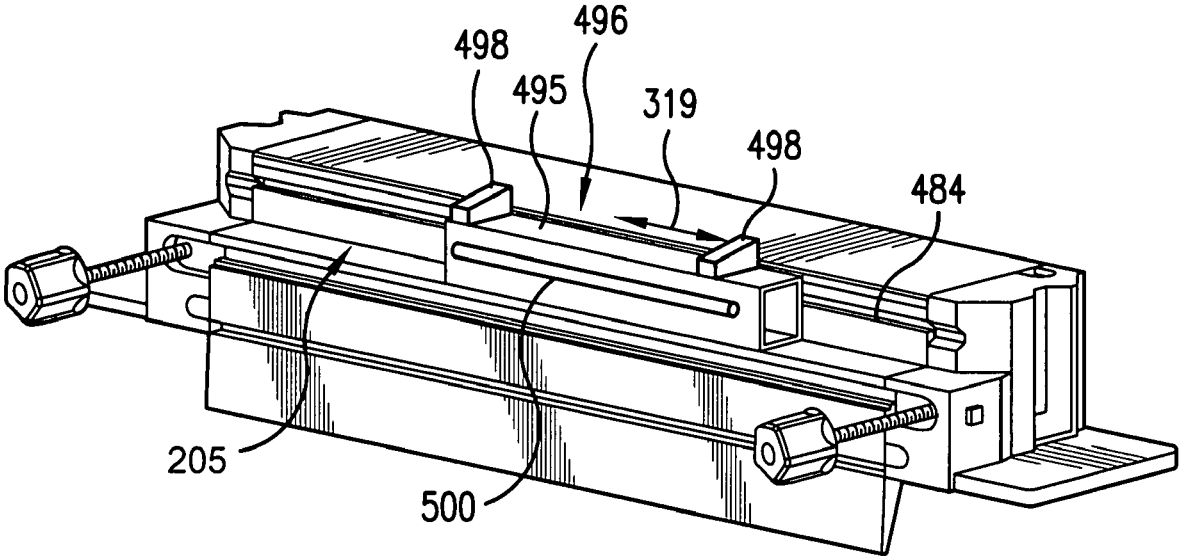
FIG. 61 is an isometric view of the base and support block of FIG. 59 further showing a clamp assembly integrated with the support block.

Referring to FIGS. 59-61, an embodiment of the base is formed by an extruded center section 470 connected with a left end cap 471 and a right end cap 472. The front face 106 and top face 108 come together with an intermediate step 205. Slots 474 are formed in the front face 106. The slots 474 may by T-slots that capture the head of threaded bolts 371. Positioning guides 366 or clamps 368 are placed over these bolts 371, 373 and secured with corresponding nuts 372, 369. The adjustable guides and clamps allow the craftsperson to secure boards in an up-and-down or left-to-right orientation. In addition, because the cam-lock assembly 140 is removable, workpieces that extend beyond the face 106 may be clamped. Slots may also be formed in the top surface 108.

In a further embodiment, a slot 484 is formed in a vertical surface 486 of the step 205. The vertical surface 486 also includes an upper positioning slot 488 and a lower positioning slot 489. A support block 490 may be placed in the step 205 and attached to the slot 484 by bolts (not shown). A tab 492 extends along a face of the support block. The tab alternatively engages either the upper positioning slot 488, shown in FIG. 60A, or the lower positioning slot 489, shown in FIG. 60B. When the tab 492 engages the upper slot 488, an upper surface 495 of the support block 490 will be flush with the upper surface 108 of the base 102. This may be useful for providing additional support for a workpiece, for example when making the pin board of a half-blind dovetail. When the tab 492 engages the lower positioning slot 489, there is a gap 494 between the upper surface of the base 108 and the upper surface of the support block 490. This gap 494 reduces the likelihood of a router bit contacting the support block 490. Embodiments of the support block may have a square cross-section as shown or may have any other appropriate cross section, such as a triangular cross-section, a C-section, an I-section, etc. The support block may be formed by extrusion, machining, casting, or another method as would be obvious to one of skill in the art.

As shown in FIG. 61, an embodiment of the support block 490 may include a clamp assembly 496. The clamp assembly comprises first and second jaws 498 extending from the top surface 495 of the support block 490. A clamping mechanism such as a threaded rod 500 tightens the jaws 498 left-to-right 319. The clamping mechanism is positioned below the upper surface 495 of the support block and may be positioned inside the support block The clamp 496 and support block 490 make possible clamping workpieces that are too short to be secured with other clamp assemblies 140, 277.

Figure 14:
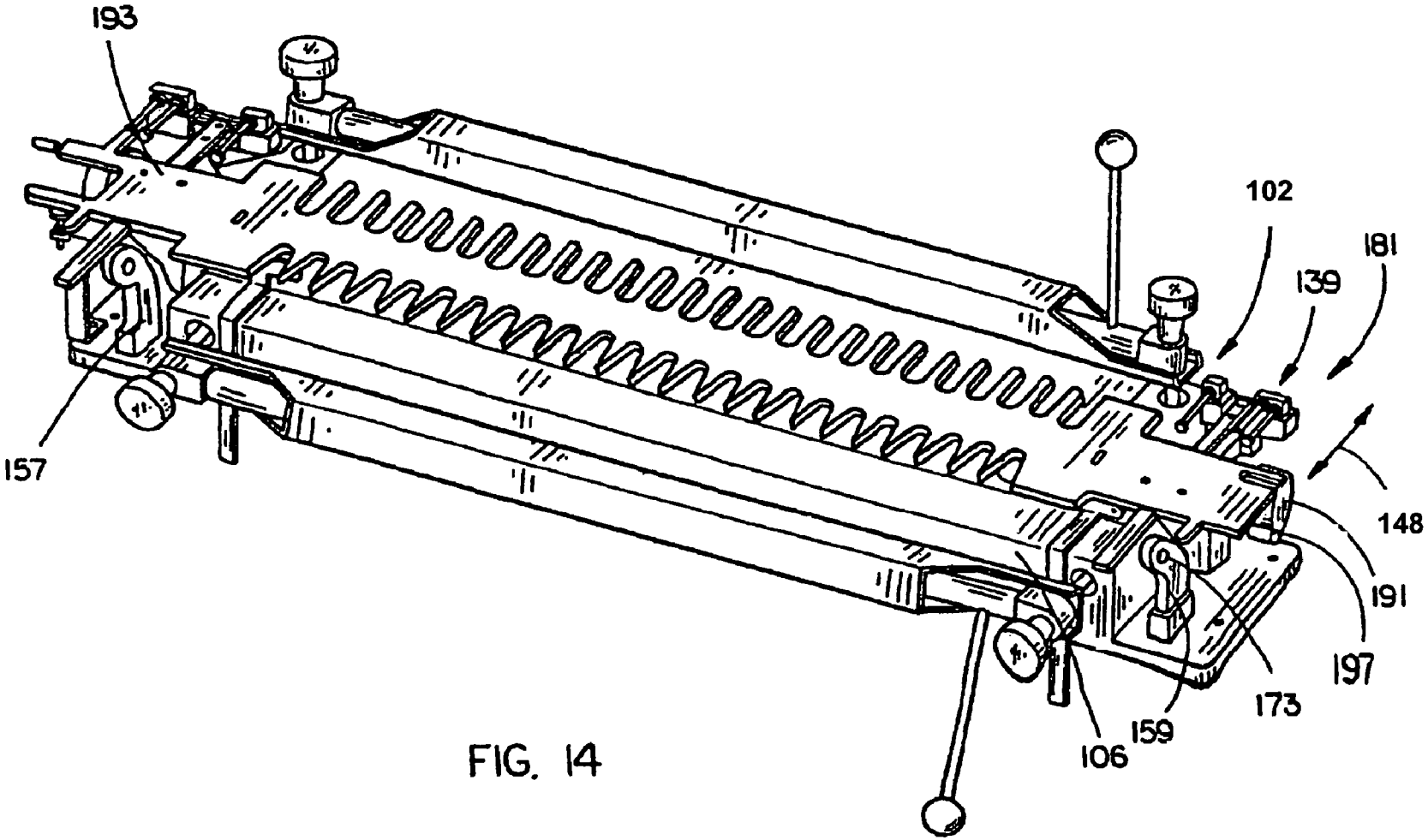
FIG. 14 is an isometric view of a jig apparatus including a removable template in accordance with an aspect of the invention.
Figure 15:
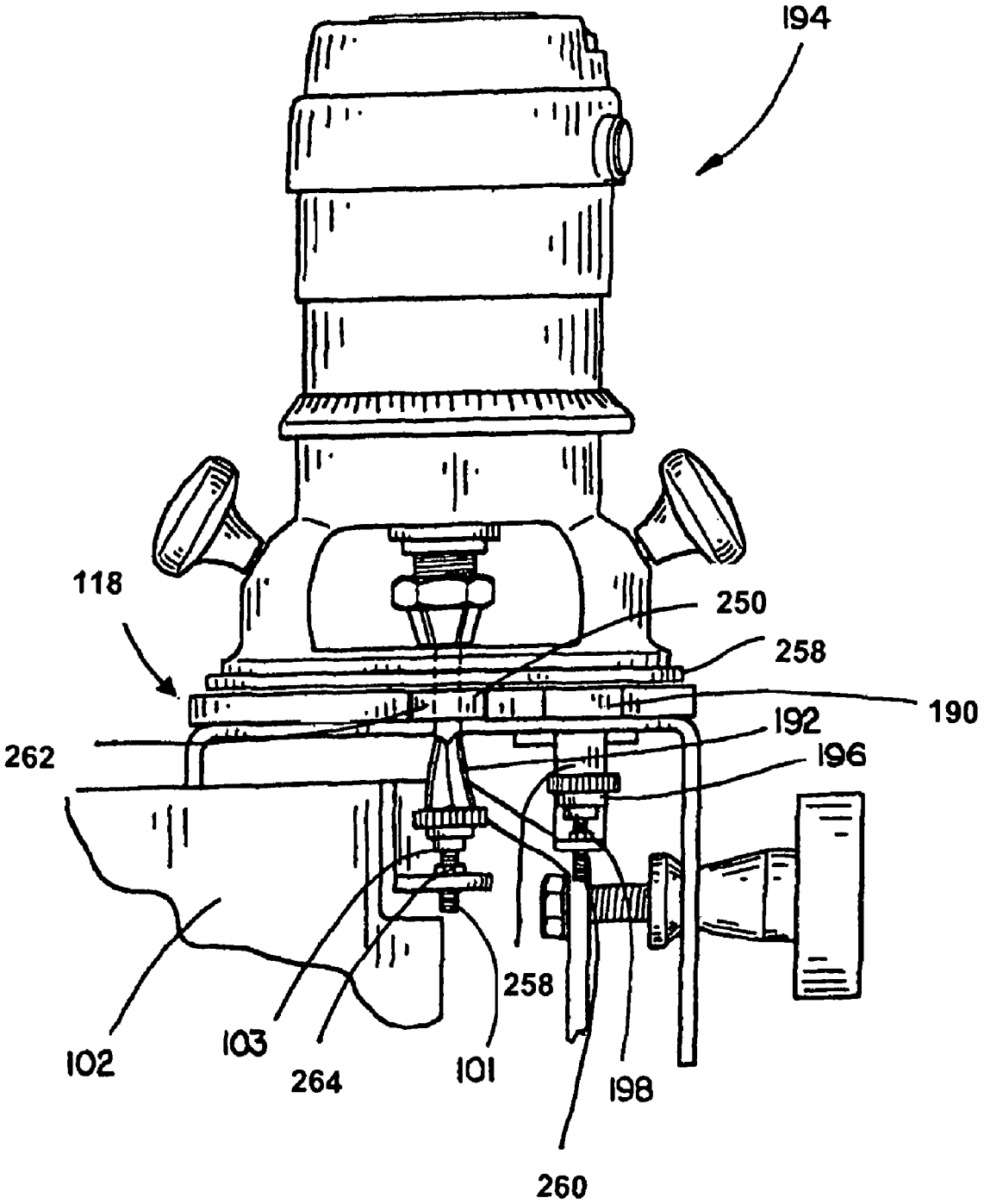
FIG. 15 is a partial cross-sectional view of a router being implemented with a router bit positioning system in accordance with an aspect of the present invention.
Figure 21:
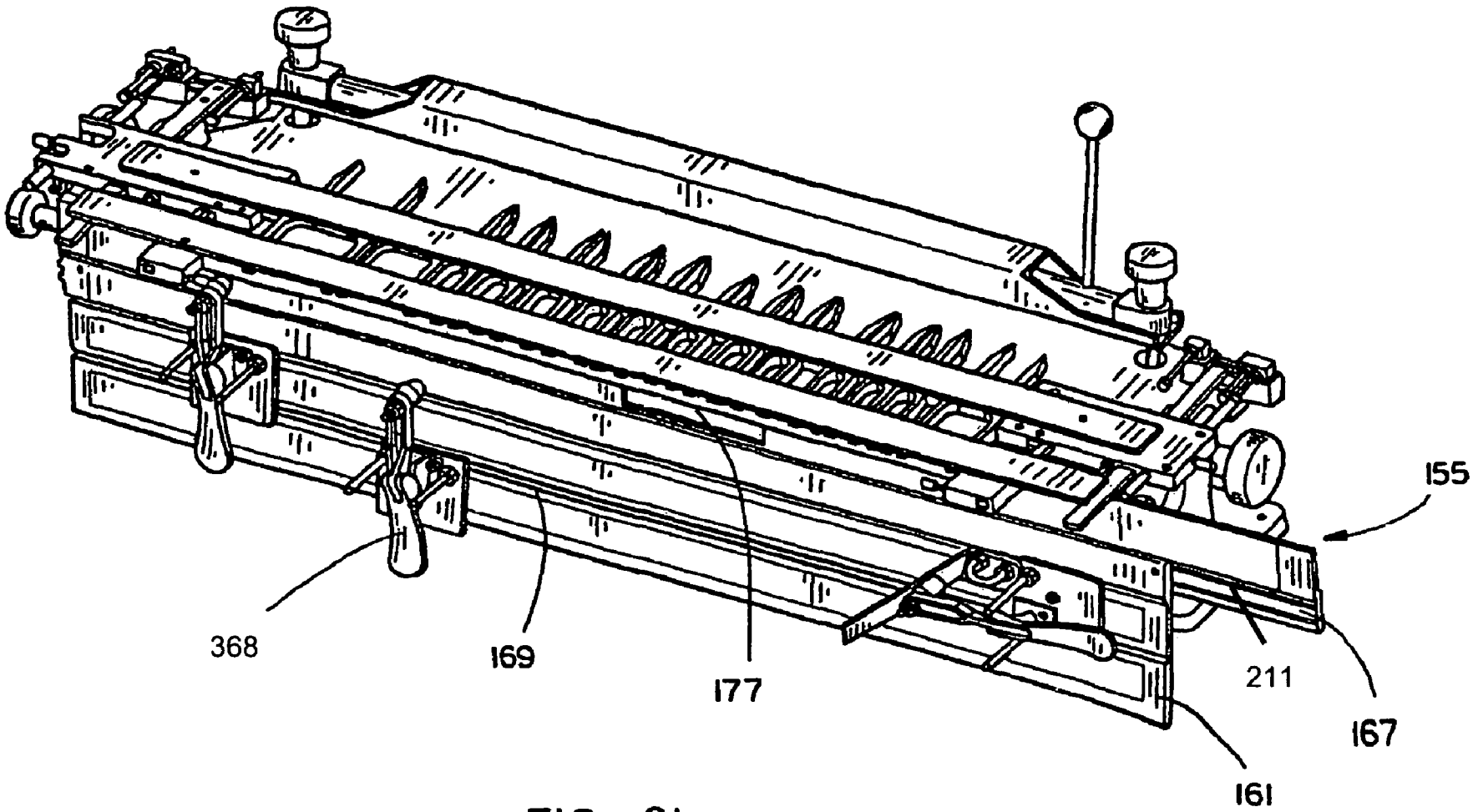
FIG. 21 is an isometric view of a jig apparatus including a variable angle workpiece mounting fence in accordance with an exemplary embodiment.
Figure 22:
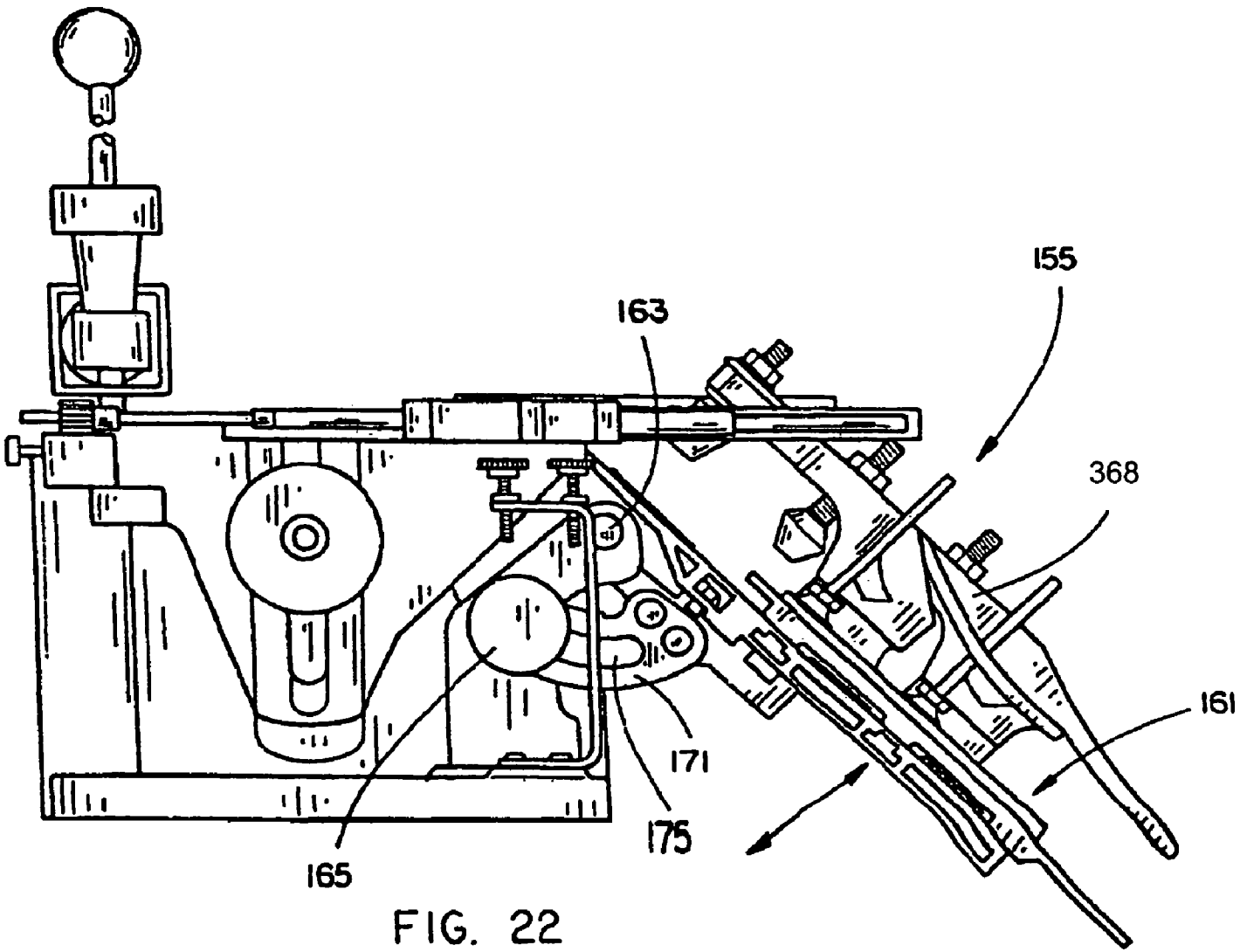
FIG. 22 is a cross sectional view of the jig apparatus of FIG. 21.

Alternatively, with reference to FIGS. 14, 21, and 22, an adjustable angle workpiece mounting fence system 155 in accordance with an aspect of the invention is disclosed. The fence system 155 may permit a user to vary the angular orientation of the workpieces forming the joint as desired. For example, a user may be capable of forming a dovetail joint for an angle other than 90° (ninety degrees) such as to form a decorative box or the like. While the angle mounting system of the present invention is implemented as a removable attachment, those of skill in the art will recognize the system 155 may be integrated into a jig apparatus 100 without sacrificing the advantages described herein.

As may be best observed in FIG. 14, a pair of spaced apart fence mounting brackets 157, 159, respectively, are secured to the base 102 via fasteners or the like. In an embodiment, the brackets 157, 159 are secured on either side of a base flange 104, adjacent the first side 106. Referring to FIGS. 21-22, the main fence portion 161 may be pivotally coupled to the mounting bracket via a trunnion 163 received in a recess or aperture 173 included in the fence mounting brackets. Angular positioning of the workpiece fence system 155 may be accomplished by including at least one of an extension 171 or a portion of the main fence 161 having an arced slot 175. The angular position of the main fence 161 may be secured via a locking system such as a threaded knob 165, a bolt, a wing nut, a screw, or the like for engaging the material defining the arced slot. Preferably, an adjustable or sliding fence portion 167 (FIG. 21) may be coupled to the main fence 161 via a mechanical interconnection such as a grove 211, rail or the like. Inclusion of a sliding fence portion 167 may permit removal of the sliding fence portion when support is unnecessary or when inclusion of the sliding fence portion would interfere with the operation to be performed. For example, a user may select to remove the sliding fence portion 167 when cutting a tenon to be included in a mortise and tenon joint in order to provide clearance about the area in which the router bit is to be manipulated. In further examples, a recess or aperture 177 may be included in the sliding fence portion such that a user may align the recess as necessary to permit proper bit clearance while supporting a workpiece along the fence system 155.

Additionally, a securing system such as a securing clamp 368 may be included in the mounting fence system 155. In the embodiment shown, a series of lockdown clamps are slide mounted to the main fence portion 161. In an example, a lockdown-TI clamp is removable from the main fence portion 161 to accommodate workpieces having dimensions approximately equal to the maximum sized workpiece which may be accepted. Adjustable securing may allow for efficient securing for workpieces having various dimensions without the need for a separate clamping device. For example, the clamps may be coupled via a tabbed extension, a rail portion, or the like for engaging with a lipped groove 169 to permit adjustment along the primary length of the main fence portion 161. Those of skill in the art will appreciate a wide variety of mechanical interconnections may be implemented to permit adjustable workpiece securing. Suitable securing systems may include spring biased clamps, threaded clamps, cam or eccentric clamping system, and the like for securing a workpiece during routing operation.

Figure 9:
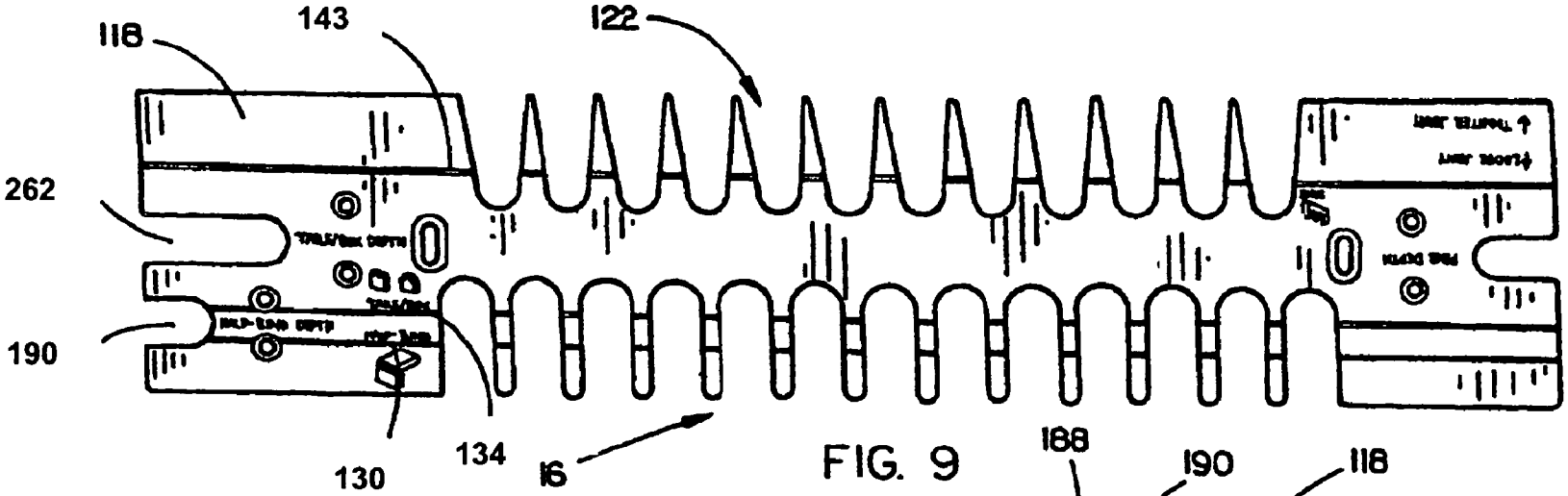
FIG. 9 is a top plan view of an exemplary template in accordance with an aspect of the present invention.
Figure 10:
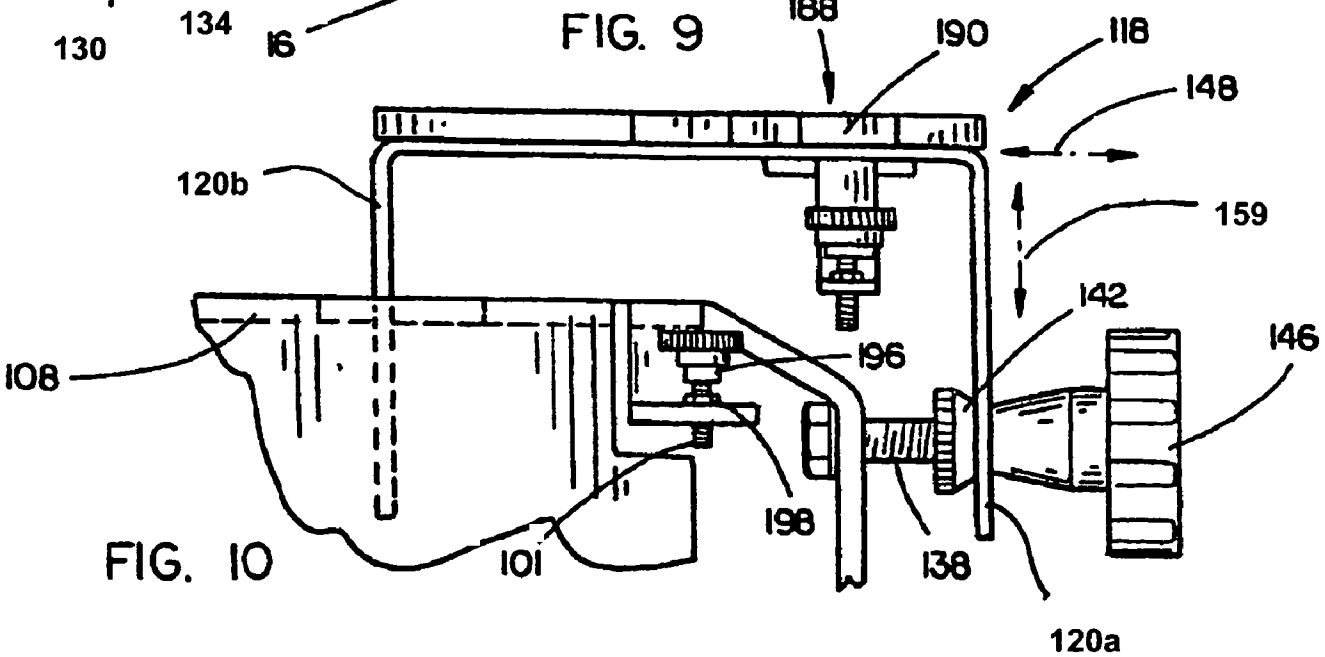
FIG. 10 is a partial cross-sectional view of jig apparatus in accordance with an aspect of the present invention.

FIGS. 9 and 10 illustrate a guide template 118 used in an embodiment of the claimed invention. Embodiments of the template may provide guides for more than one cut. For example, the template 118 may have a first side 116 for forming the tails of a through dovetail joint and a second side 122 for forming the dovetail pins. However, the two sides of the template need not form cooperating parts of the same joint. The two sides of the template may be used to form two or more cuts for different types of joints. For example, a template embodiment may have a half-blind template on one side and a dado template on the other, as shown in FIG. 17.

Referring to FIGS. 8A, 8B, 9 and 10, in embodiments of the guide template the template is secured to the base using one or more brackets 120. Pairs of brackets may be arranged proximate each end of the template. For each pair of brackets, one bracket 120*a* is positioned toward the first side 116 of the template and a second bracket 120*b* is positioned toward the second side 122 of the template. In the present embodiment, the two adjacent brackets are unitarily formed as a generally U-shape attachment fastened to the main body 128. However, one of skill in the art will appreciate that the brackets may be formed individually and separately connected, integrally formed with the main body 128, or formed in any other appropriate manner.

Each bracket 120 comprises a leg extending downwardly from the template 118, and each leg includes a slot 132. To make a first cut, the user positions the template with the appropriate side facing forward. The slot 132 of one bracket at each end of the template is placed over a threaded bolt 138. A pair of threaded knobs 142, 146 captures and secures the bracket. The user can adjust the template front-to-back 148 or up-and-down 159 to match the dimensions of the workpiece and the type of joint by adjusting the vertical position of the bolt 138 within the slot 132 and by adjusting the horizontal position of the coordinating knobs 142, 146. To make a second cut, the user rotates the template 180° and captures the second bracket of each pair over the threaded bolt 138 and between knobs 142, 146. The unused legs at the back of the template project downwardly through openings 136 in the top face 108 of the jig.

Figure 17:
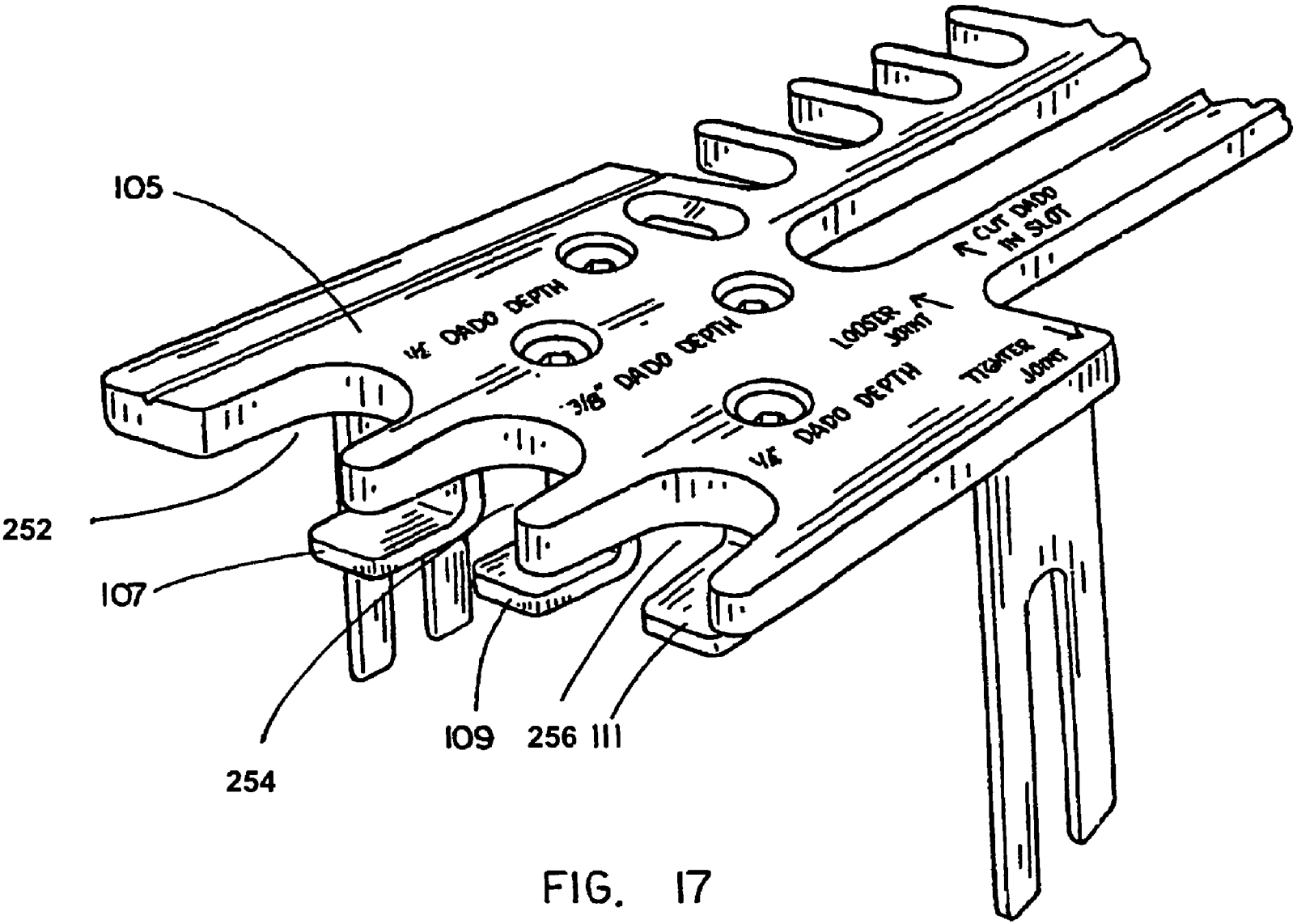
FIG. 17 is partial isometric view of a template including a fixed depth router bit positioning system.

With reference to FIGS. 8B, 9, and 17, in an embodiment of the present invention, a visual alignment system for inclusion in a jig apparatus is disclosed. If the template is skewed with respect to the workpiece(s), pins/tails of differing lengths may result. Users of prior jigs may have experienced difficulty in aligning the template in order to prevent the template from being skewed. An embodiment of the template includes an alignment marker or indicia for aiding in alignment of the template with the workpiece. Suitable alignment markers for aiding visual alignment may include printed, embossed or painted indicia, an etched or engraved marker, or the like. Alignment markers may include a line, an arrow, two-spaced apart lines, a cross-hair, alignment dots, dashed lines, or any other suitable marking. Other suitable systems include, apertures having alignment markers or visual indicators, or transparent windows having visual markers.

Figure 50:
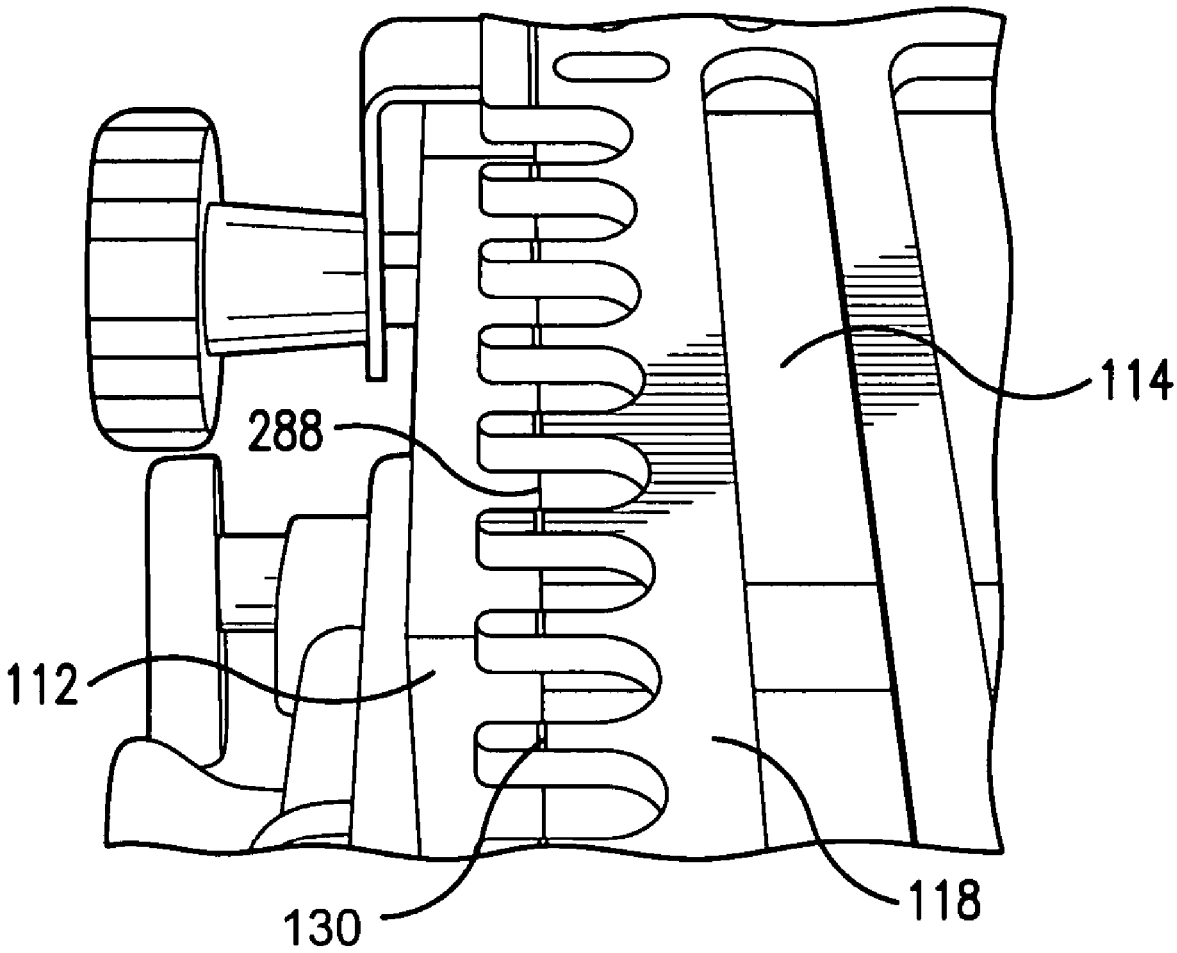
FIG. 50 is a partial isometric view of template alignment indicia in accordance with embodiments of the invention and as used to accurately align the template for cutting a single-pass half-blind dovetail joint.

For example, when aligning a template to a workpiece in prior jigs, a user had to estimate or measure the alignment of the template and workpiece to determine that the template was parallel with the end of the workpiece. The alignment system of the present embodiment allows the user to visually align the template and the workpiece using an appropriate marker or indicia without having to measure. For example, as shown in FIG. 50, when cutting or shaping a half-blind dovetail in a single pass, a user may align a scribed line 130, included on the main body of the template 118, with the interface 288 between a first workpiece 112 disposed against the front face 106 of the base (e.g., in a vertical orientation) and a second workpiece 114 disposed against the top face 108 of the base (e.g., in a horizontal orientation). As may be generally observed in FIG. 8B, should the template not be in alignment with the half-blinding dovetail alignment line 130, a user may manipulate the template front-to-back until the alignment line coincides with the interface of the first and second workpieces. Those of skill in the art will appreciate that a variety of indicia or markers may be included for aligning guides for this and other types of joints. As shown in FIG. 9, additional indicia may be included for different cuts and joints, such as an alignment marker 134 for the tails of a through dovetail guide and an alignment marker 143 for through dovetail pins. For example, when cutting the pins of a through dovetail, a user may align the edge of the workpiece in which the pins are to be formed with the alignment marker 143 included on the template guide for through dovetail pins 122.

Figure 23:
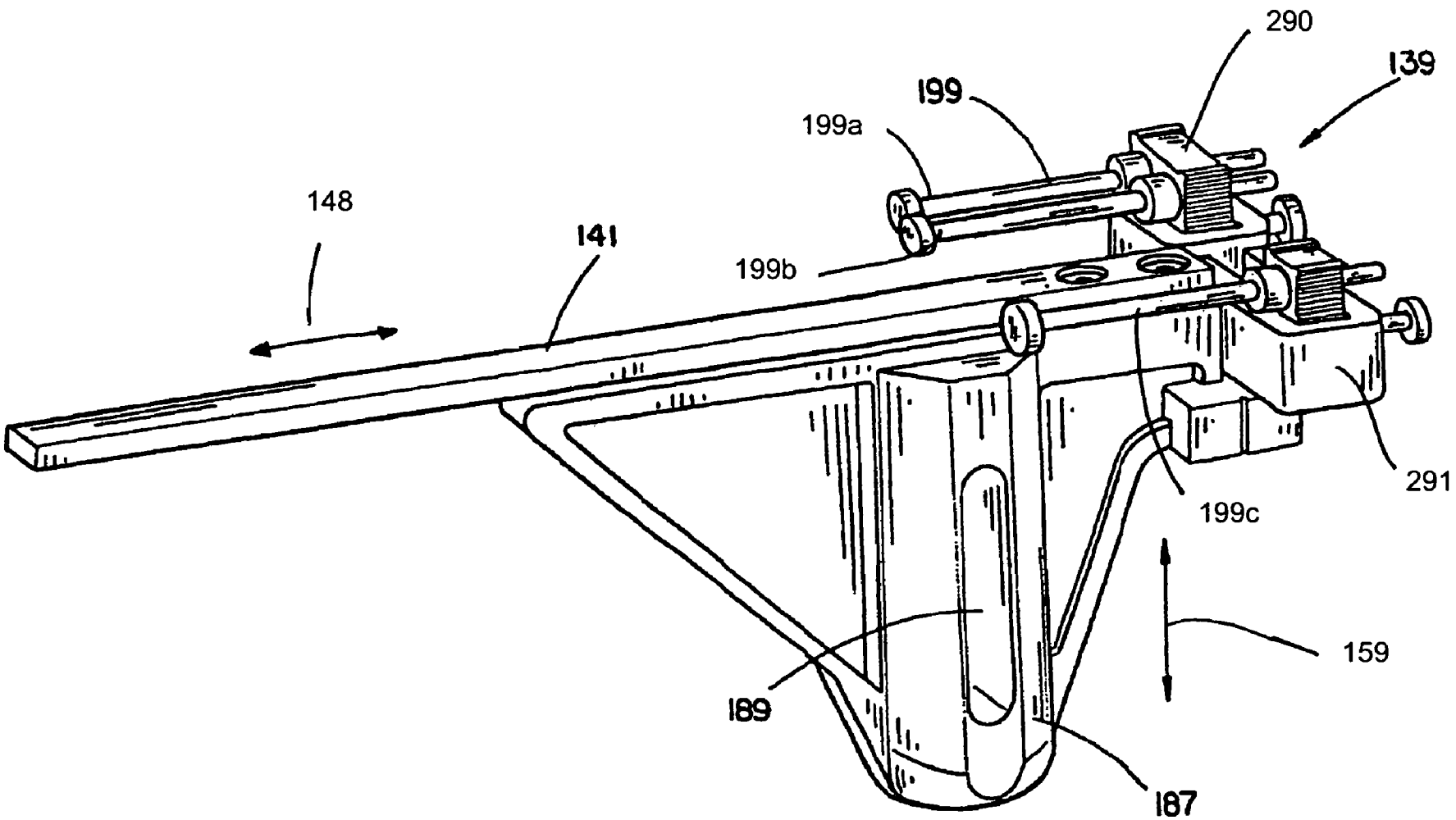
FIG. 23 is an isometric view of a template mounting bracket in accordance with an exemplary embodiment of the present invention.
Figure 24:
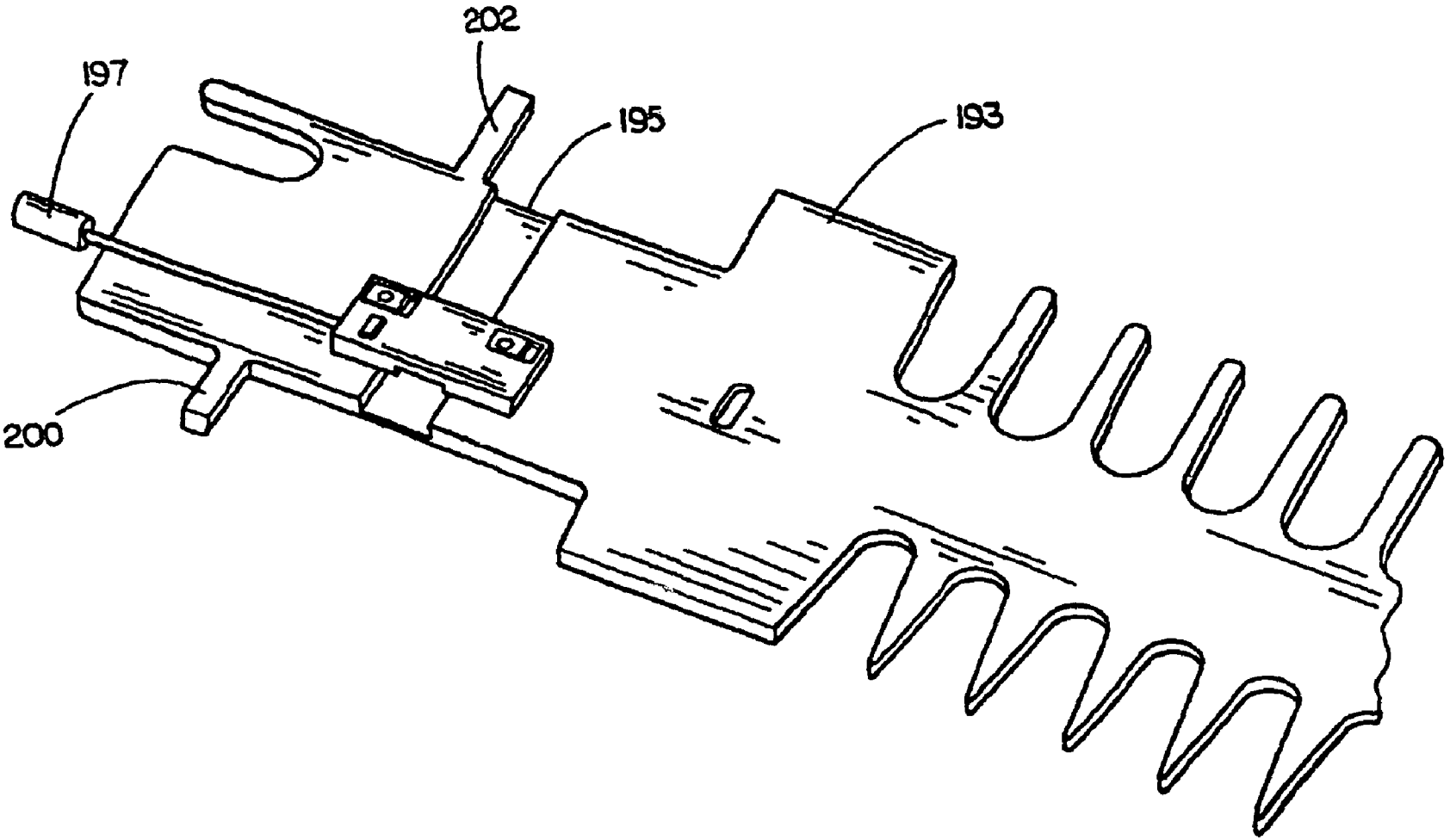
FIG. 24 is a partial view of a template suitable for engagement by a mounting rail included in a template mounting bracket in accordance with an exemplary embodiment.

Referring to FIGS. 13, 14, 23 and 24, an alternative embodiment of the present invention comprises a template 193 and a template mounting system 181. The template mounting system 181 accommodates up-and-down 159 and front-to-back 148 positioning of the template 193. The mounting system includes a support rail 141 onto which the template is mounted. A knob 191 has a threaded stud that passes through an elongated slot 189 formed in a positioning sleeve 187. The user can adjust the support rail up-and-down and secure the sleeve in position by tightening the knob. The sleeve 187 travels vertically on a post (not shown) attached to the base 102. The post and sleeve may have complementing polygonal shapes so that the mounting system can move vertically but still be secured against rotating around the axis of the post. The polygon shape of the post and sleeve also guarantees that the support rail will always be fixed in the same position front-to-back. This ensures the repeatability of the template alignment system 139, described below. For example, the post and sleeve may have a hexagonal cross-section, as illustrated in FIG. 23. Alternatively, the post and sleeve may have other complementing cross-sections such as square, semi-circular, or other appropriate shapes as would be apparent to one of skill in the art.

An embodiment of a template 193 for use with the template mounting system has slots 195 formed in the template that engage the support rail 141. The template may have multiple guides on a single template. For example, the template may be reversible having a first side for forming the tails of a through dovetail joint and a second side for forming the dovetail pins. However, the two sides of the template need not form cooperating parts of the same joint. The two sides of the template may be used to form two or more cuts for different types of joints. In order to access the guides on the template, the template may be rotated 180° so that the back of the template becomes the front, or alternatively, may be flipped over so that the bottom of the template becomes the top, allowing the user to orient the template in up to four different positions.

In a present embodiment, the template 193 mounts to the jig by engaging support rail 141 in a slot 195 formed on the template. This system allows the template to move front-to-back 148 with respect to a workpiece. Achieving the correct front-to-back adjustment by traditional means can be time consuming. An embodiment of the invention provides a repeatable alignment system 139 that allows the user to switch from a first template to a second or third template and back without having to realign the template. The alignment system 139 uses a series of adjustable fingers 199, which engage corresponding projections 200,202 on the template. One or more blocks 290 mount at each end of the jig. Each block supports one or more adjustable fingers 199. A bracket 291 extending from the template support rail 141 secures these blocks.

Figure 32:
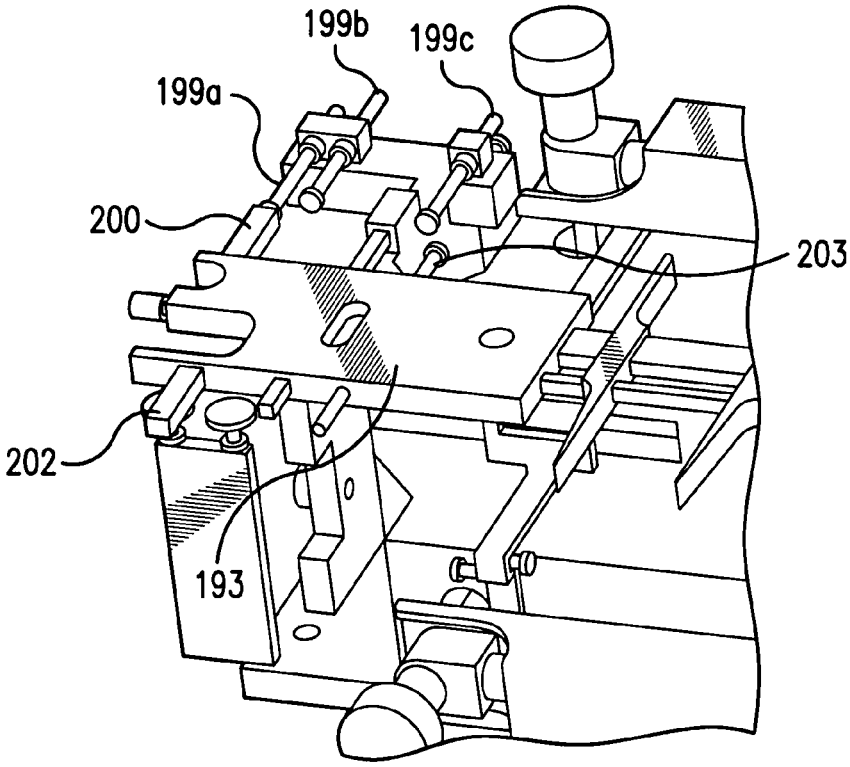
FIG. 32 is an isometric view of an embodiment of a repeatable template alignment system.
Figure 33:
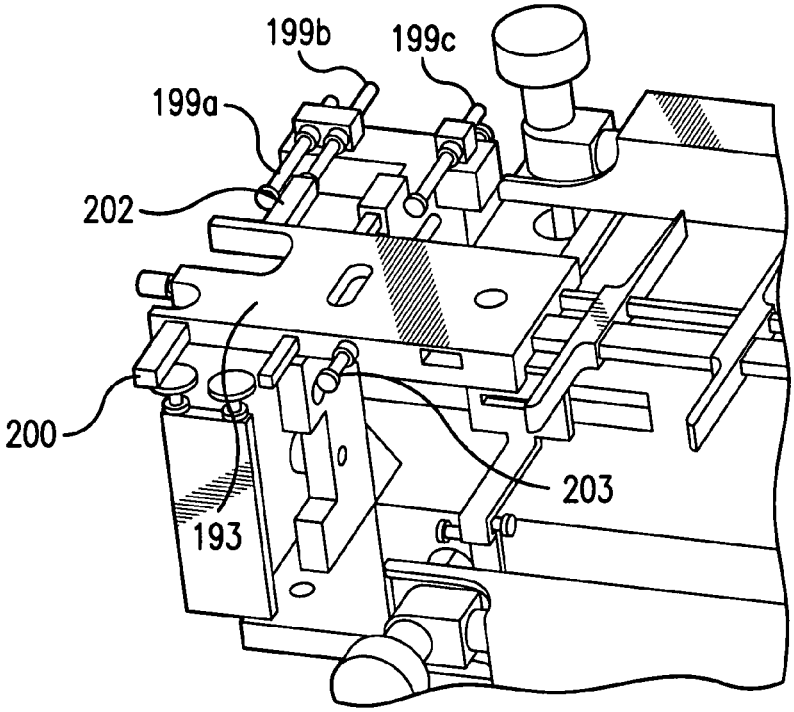
FIG. 33 is an isometric view of the repeatable template alignment system shown in FIG. 32.

As shown in FIGS. 32 and 33, when a template 193 is set in a first position (FIG. 32) a projection 200 on the template engages a first finger 199*a*. And, when the template is set in a second position (FIG. 33) a different projection 202 on the template engages a second finger 199*b*. The projections on the template and the fingers on the support assembly are positioned so that the correct stops will automatically engage with corresponding fingers when the template is correctly positioned on the support rail 141.

Additionally, a third finger 199*c* may engage a third projection 203. This third projection may be an adjustable threaded rod that passes through the template assembly. By having an adjustable finger in line with the adjustable threaded rod, the template can be flipped front-to-back while still maintaining the proper alignment. For example, when adjusting the fit of a variably spaced half-blind dovetail, the adjustable finger 199*c* controls the amount of overlap between the boards, and the threaded rod 203 adjusts for different thicknesses of the tailboard. In this way, the user can switch back and forth between multiple templates without having to realign the templates each time. The removable blocks 290 allow the user to remove the fingers 199 for one-time setups or to switch back and forth between multiple setups.

An adjustable finger 199 may be constructed as a threaded rod, a screw, a smooth shaft with a setscrew, a rack and pinion, or any other method of adjusting the finger as would be obvious to one of skill in the art. The projection 203 is described as a threaded rod; however, one of skill in the art would recognize that the projection might alternatively be any other adjustable stop, including a screw, a smooth shaft with a setscrew, or a rack and pinion.

The template mounting system 181 may be used to support various templates. For example, the jig may be provided with a box joint template. As shown in FIGS. 2 and 4, box joints differ from dovetail joint in that the dovetail is constructed of interlocking, angled pins and tails while the box joint comprises straight fingers and corresponding straight sockets.

Figure 34:
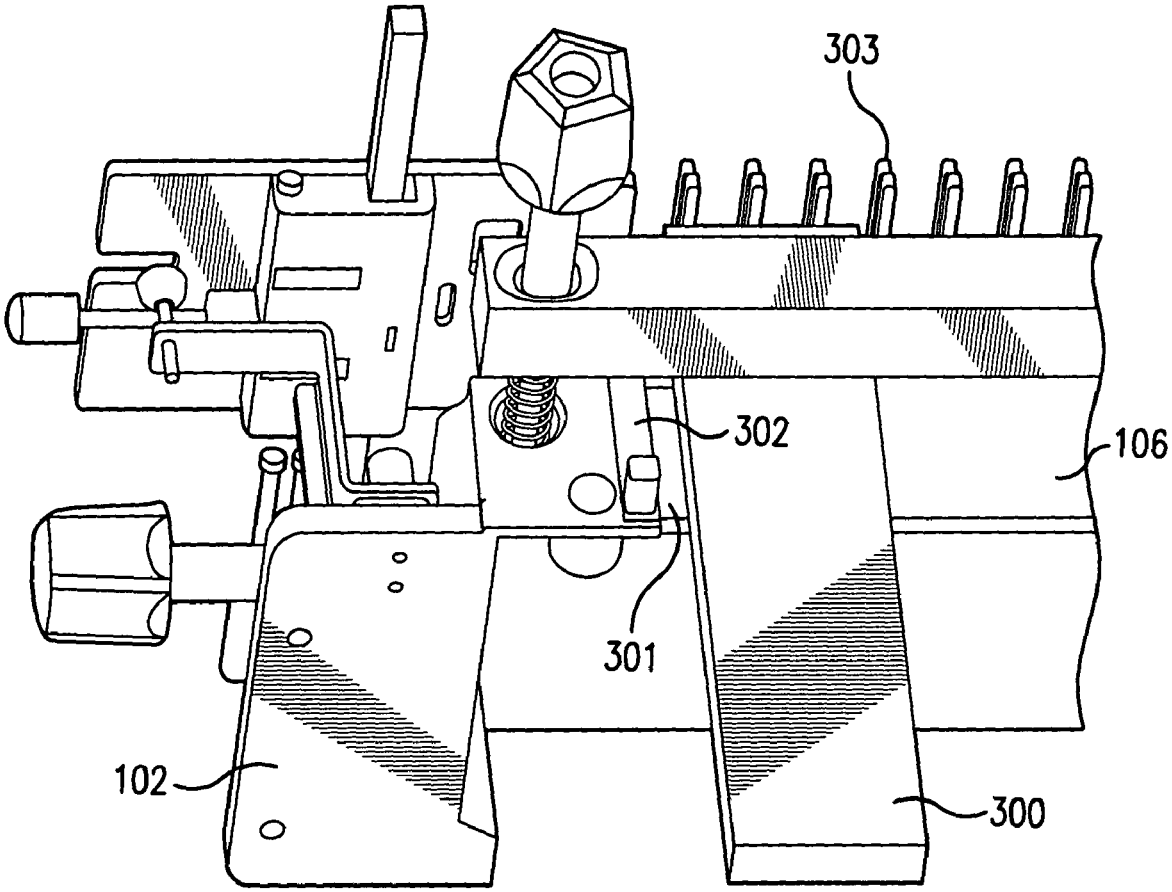
FIG. 34 is an isometric view of an embodiment of a workpiece offset alignment system as seen from below the jig apparatus.

FIG. 34 shows an embodiment of a box joint template 303 attached to the jig 100. When creating a box joint, the user positions a first board (not shown) vertically against the front face 106 of the jig and cuts fingers and sockets in the end of the board using a straight router bit following a box joint template. The user aligns the first board by placing it against a stop 302 mounted at the side of the front face 106. The user repeats the process with the second board 300. However, the second board must be offset an appropriate distance from the first board so that the alternating fingers and sockets will align correctly. An embodiment of the present invention ensures the correct offset by providing an offset guide 301. The offset guide mounts magnetically beside the stop 302 used by the first board, thereby providing a new stop that correctly offsets the second board. A variety of offset guides corresponding to various box joint finger widths may be provided. Alternating guides may also be provided for use on either the left or right sides of the jig.

Figure 35:
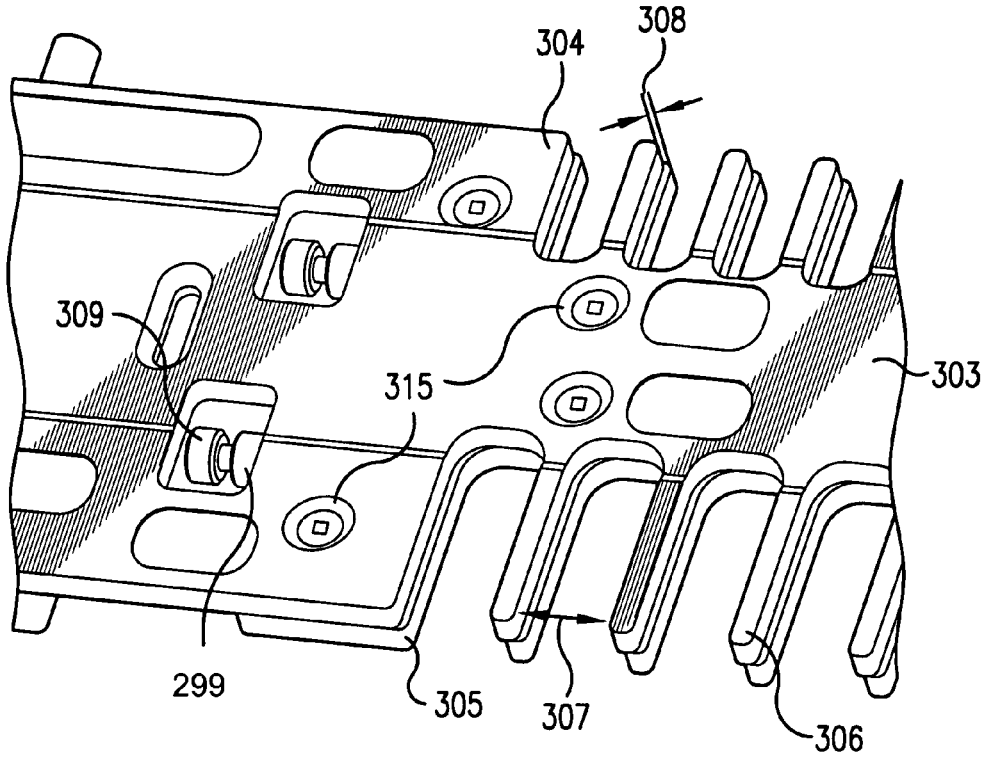
FIG. 35 is a partial isometric view of a box joint template in accordance with an embodiment of the invention.

Referring to FIG. 35, box joints are formed using a matched template 303, router bit and template guide. However, to insure a correctly fitting joint it may be necessary to make minor adjustments to the finger and socket widths, even when using a correctly matched template, bit and guide. An embodiment of a box joint template 303 allows for these minor adjustments to the finger and socket width by providing a template with an upper half 304 and a lower half 305. The upper half and the lower half each have the same finger shape 306. The halves are attached to each other, but the lower half 305 can slide left-to-right 307 with respect to the upper half 304 and can be locked at a slight offset 308 from the upper half. By changing the offset, the exact width of the alternating fingers and sockets can be controlled. A thumbscrew 309 incrementally adjusts the offset between the upper and lower halves, and a thumbnut 299 locks the thumbscrew in place. Alternatively, one or more screws 315 lock the upper half 304 relative to the lower half 305.

Figure 36:
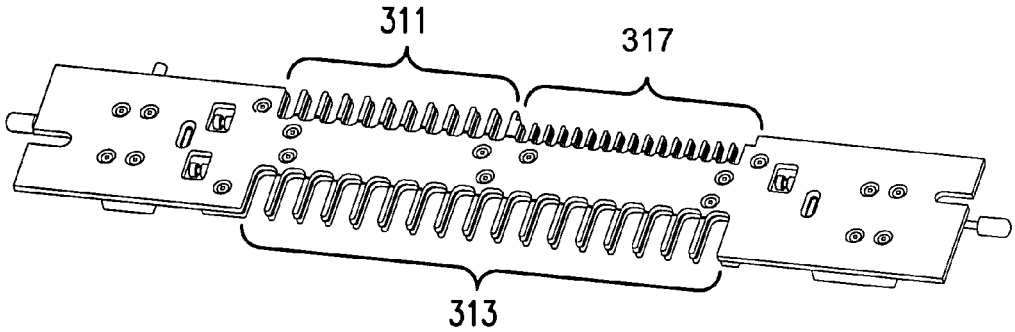
FIG. 36 is an isometric view of the box joint template of FIG. 35.

Referring to FIG. 36, an embodiment of the box joint template 303 has the ability to cut different sizes of box joints using different sections of the same template. For example the template 303 may include one or more sections such as a ⅜" (three-eighths inch) section 311, a ¼" (one-quarter inch) section 317, and a ½" (one-half inch) section 313. In order to take advantage of the template adjustment discussed above, the lower halves of the different sized sections operate independently of each other. This independent adjustment allows the craftsperson to alternate between the various sizes of box joints without resetting the template. An embodiment includes separate thumbscrews or other adjustment mechanisms for each section.

Figure 25:
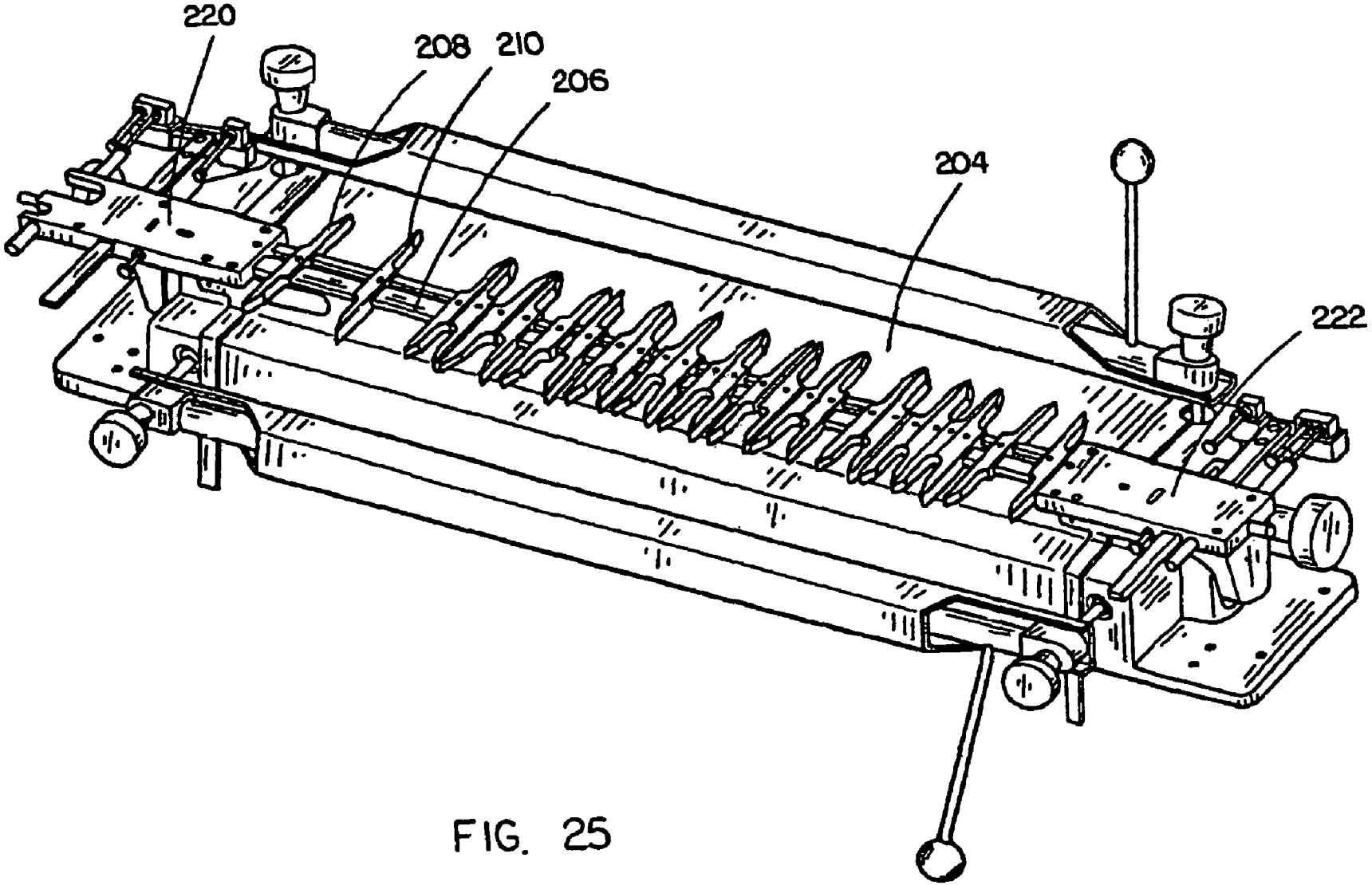
FIG. 25 is an isometric view of a jig apparatus including an adjustable finger template in accordance with an exemplary embodiment.
Figure 26:
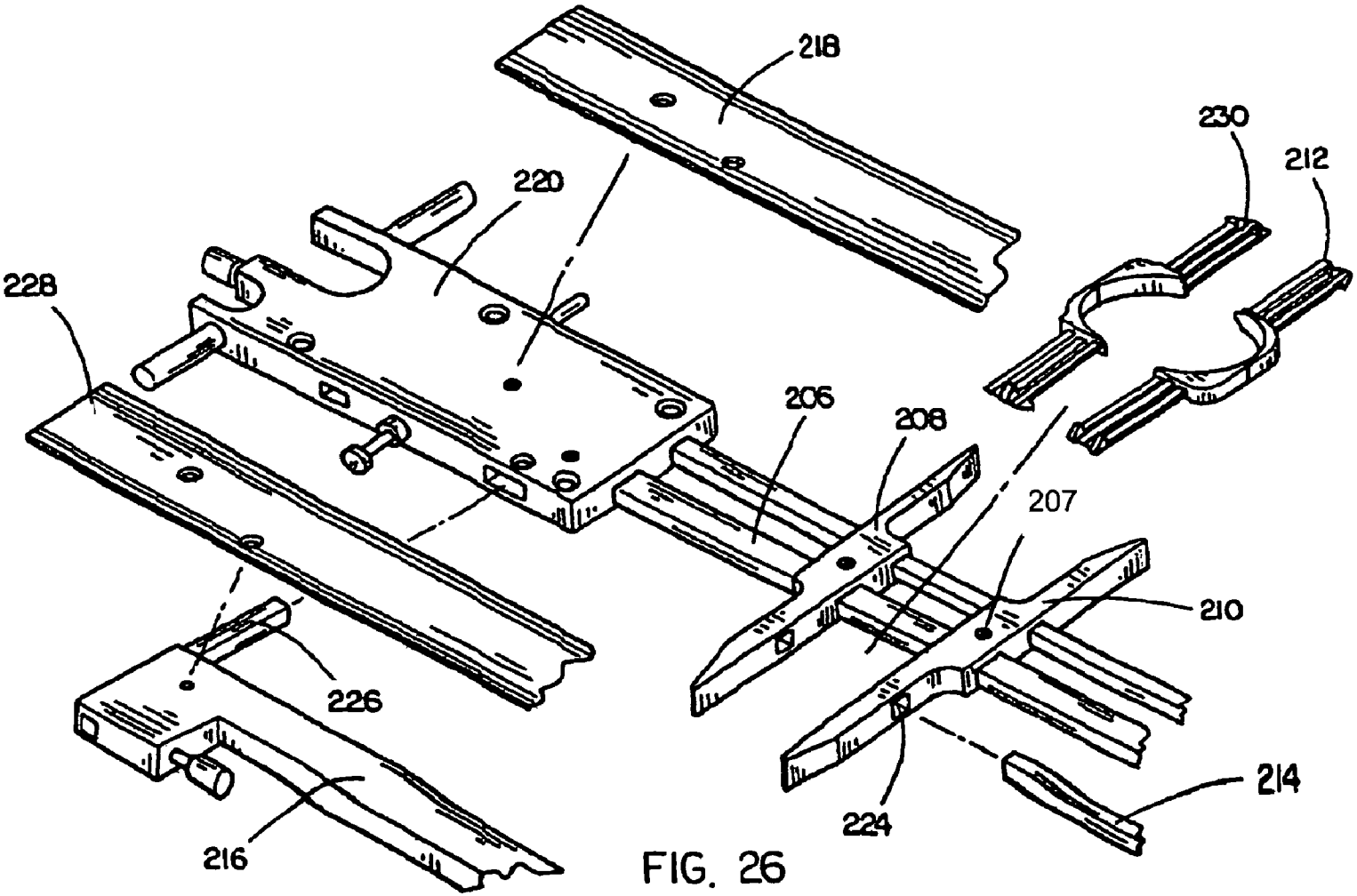
FIG. 26 is an exploded view of an adjustable finger template implemented for forming mortise and tenon joints in accordance with an exemplary embodiment.
Figure 27:
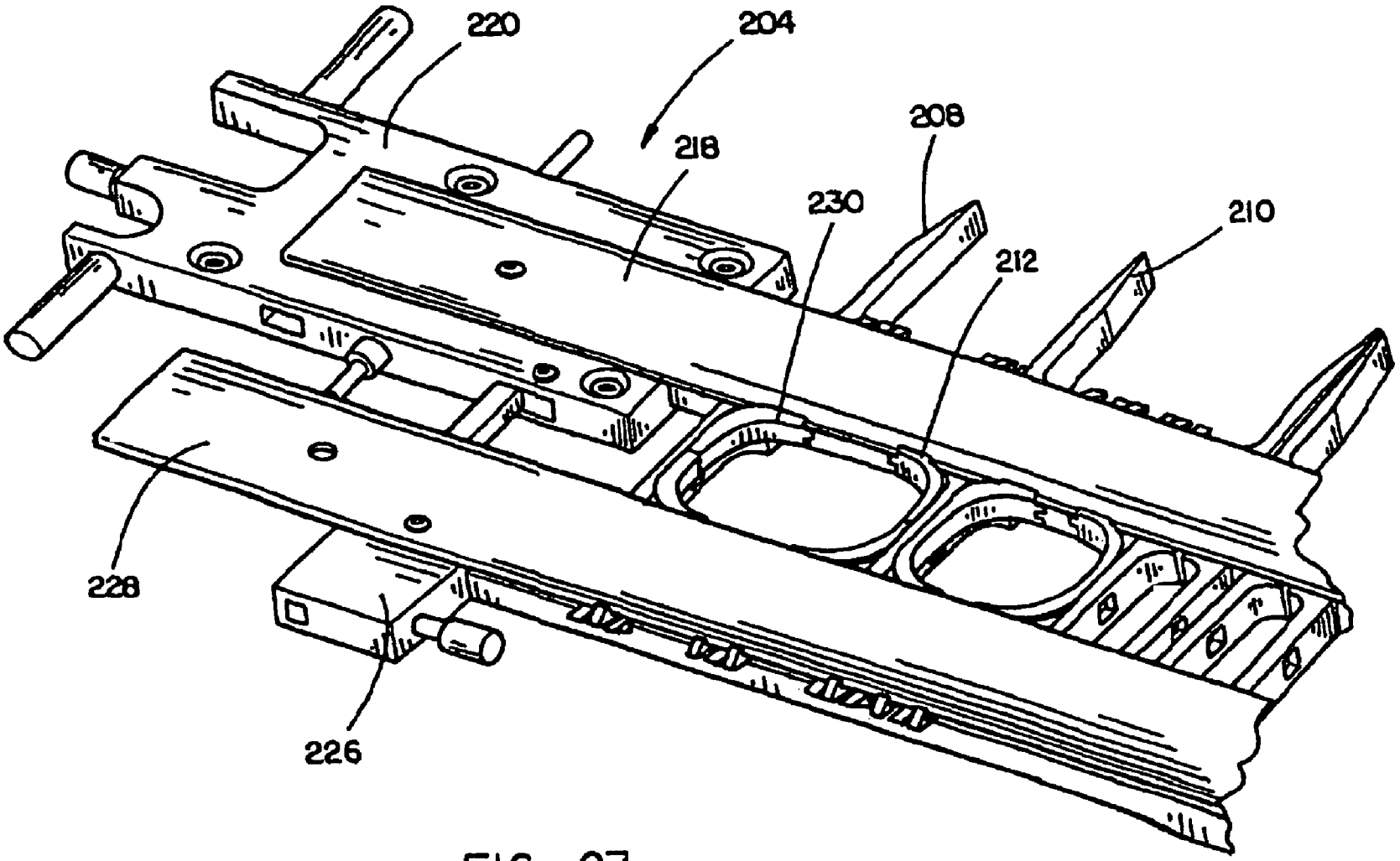
FIG. 27 is an enlarged view of an adjustable finger template implemented for forming mortise and tenon joints in accordance with an exemplary embodiment.

With reference to FIGS. 25 through 27, an adjustable finger template 204 for forming various joints such as through dovetails and half-blind dovetails is described. An embodiment of the template may provide a guide for forming joints of differing dimensions, such that the pins/tails forming the joints may be sized as desired. Those of skill in the art will appreciate the principles of the present embodiment may be implemented for templates for different joints, such as for a mortise and tenon joint and the like, without departing from the scope and spirit of the invention.

An adjustable finger template 204 in accordance with an embodiment of the invention includes a first end structure 220 having a slot for mounting on support rail 141. A second end structure 222 may be connected to the first end structure 220 via a template rail 206 extending between the end structures. Additional rails may be included, such as for preventing twisting of the template during utilization. A plurality of individual fingers may be slid on the template rail 206 to the desired position. The individual fingers 208, 210 (two are referenced) may be contoured in a variety of shapes based on the joint to be formed. Individual fingers may be secured via a setscrew 207 or the like to fix their respective positions along the template rail 206.

In an embodiment of the adjustable finger template, a through aperture 224 is included in the individual fingers for permitting passage of a depth stop rod or bar 214 through the fingers. For instance, the depth stop bar 214 may act as a stop for a router guide collar when forming a joint, so the router is prevented from extending inwardly between two adjacent fingers. In the foregoing manner, a user may be prevented from inadvertently removing excess material from the workpieces when forming half-blind dovetails. The depth stop bar 214 may be removed when cutting through dovetails, as the bit is allowed to pass entirely through the workpiece.

The depth stop bar may be useful in forming a single-pass half-blind dovetail joint. Typically, the adjustable finger template would require cutting the pins and tails in separate cuts. However, the depth stop bar 214 also provides the capability to use the adjustable finger template to cut half-blind pins and tails in a single pass (the dovetails will have uniform rather than variable spacing). In order to make a one-pass half-blind dovetail cut using the adjustable fingers, the fingers are pushed together, and a depth stop bar is inserted through holes in the fingers.

Figure 37:
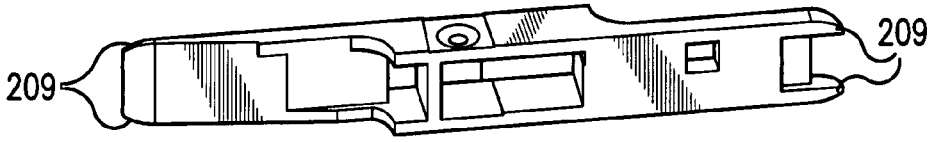
FIG. 37 is an isometric view of an adjustable finger for use with embodiments of the invention.

As illustrated in FIG. 37, embodiments of the adjustable fingers 208, 210 may be provided with ramped edges 209. When setting-up the template, the user positions the workpiece 112 in the clamp 140 and slides the template 204 onto the support rail 141, sliding the template fingers 208, 210 over an edge of the workpiece. The fingers have a tendency to catch on the edge of the workpiece. In order to eliminate this catching, the edges of the template fingers may be radiused, chamfered or otherwise ramped.

Referring to FIGS. 1, 7, 9, 10, and 15, an embodiment of the invention comprises a router bit depth adjustment system or depth guide. When forming joints in accordance with embodiments of the invention as described herein, the user must properly set the height of the router bit 192 with respect to the router base 248. This may become a time consuming task as a user fine-tunes the depth of the router bit. A router bit depth adjustment system may reduce the adjustment time required by eliminating the need to perform test cuts or the need to measure the depth of the router bit. Embodiments of the bit depth adjustment system provide a stop that the user can utilize to repeatably set the router bit depth. To use the depth adjustment system, the user places the router 194 on the top surface of the template. The user then lowers the router bit 192 until it contacts the bit stop 103 and locks the router bit in place relative to the base 248 of the router.

In an embodiment of the invention, a slot 190 or recess is formed an edge of the template 118. Preferably, the slot is wide enough to accept a template guide 250 disposed about the shank of the bit (see, e.g., FIG. 28B) while accurately positioning the bit 192 above the stop 103. Alternatively, a through aperture may be utilized instead of a slot.

In a first embodiment of the bit stop (FIG. 17) one or more fixed position bit stops 107, 109, 111 may be attached to or integrally formed with an end of a template 118. For example, a series of fixed bit stops corresponding to a ½" (one-half inch) depth 107, a ⅜" (three-eighths inch) depth 109, and a ¼" (one-quarter inch) depth 111 may be included with a single template 105. Such fixed bit stops allow a user to quickly set the router bit depth to a commonly utilized, preselected depth. For example, when cutting a sliding tapered dovetail joint most woodworkers select either a ½" (one-half inch) joint, a ⅜" (three-eighths inch) joint, or a ¼" (one-quarter inch) joint to connect the workpieces. The bit stops allow the user to quickly reference these router bit depths. In the present embodiment, the fixed stop is formed as a bracket coupled to the main body of the template via a fastener, disposed generally in-line with one or more slots 252, 254, 256 formed in the template 105.

In further embodiments, an adjustable bit stop 103, 196 may be used. Such a stop allows a user to adjust the preselected depth as desired. For example, some woodworkers elect to cut slightly longer tails so the user can sand the tails to match the joint. Without the repeatable bit stop, tedious measurement and adjustment would be necessary to repeatably achieve the correct depth setting.

In a first embodiment of an adjustable bit stop, the depth guide comprises a slot 190 in the template and a bit stop 196 mounted to a tab 258 extending from the underside of the template. The bit stop 196 includes a threaded portion 260 such as a threaded rod or bolt for threaded engagement with a threaded aperture in the tab 258. A nut 198 may be included for securing the bit stop 196 against movement relative to the tab 258 and template 118 during use. This embodiment may be useful in setting bit depth for a half-blind dovetail joint, where the depth of cut is the same regardless of the thickness of the workpiece. Attaching the depth guide directly to the template allows the craftsperson to consistently set a uniform cut depth.

In a further embodiment of an adjustable bit stop, the depth guide comprises a slot 262 in the template 118 and a bit stop 103 mounted to or integrally formed with the base 102. The bit stop 103 includes a threaded portion 101 such as a threaded rod or bolt for threaded engagement with a threaded aperture in the base 102. A nut 264 may be included for securing the bit stop 103 against movement relative to the base 102 during use. This embodiment may be useful in setting bit depth for a through dovetail, where thicker workpieces require a deeper cut while thinner workpieces require a shallower cut (the depth of cut matches the workpiece thickness). By inserting a scrap of wood that is the same thickness as the workpiece, the craftsperson can accurately and automatically set the depth of the cut. The distance between the template 118 and the through bit depth stop 103 is linearly related to the thickness of the workpiece. Additionally, the bit stop may be positioned such that when the template is in a first position, the bit stop aligns with a first slot in the template; and when the user reverses the template, the bit stop aligns with a second slot, allowing a single bit stop to serve for multiple cuts.

Those of skill in the art will appreciate that multiple router bit stops may be included. For example, a first template may include a depth guide for the pins of a through dovetail, a depth guide for the tails of a through dovetail, and a depth guide for a half blind dovetail. A second template may include depth guides for other joints such as a tapered sliding dovetail or a sliding dovetail dado. Any number and configuration of depth guides may be included with a template as desired. Also, those of skill in the art will appreciate that a depth guide may be mounted to or formed with any appropriate portion of the jig 100. For example, a depth guide may mount to the base 102, a tab extending from the template 258 or some other portion of the jig depending on the type of joint to be formed.

Figure 16:
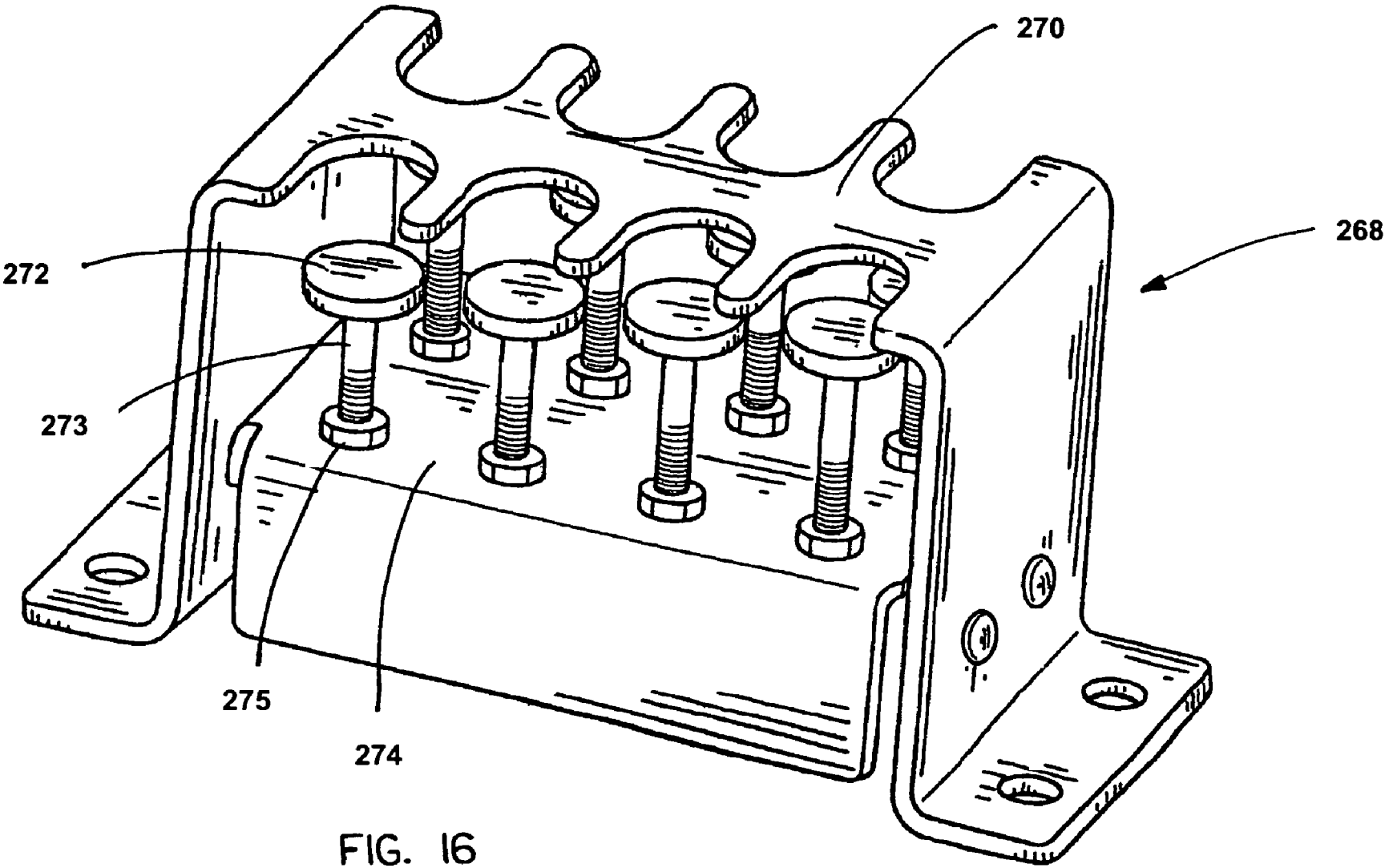
FIG. 16 is a general illustration of a router bit positioning system integrated in a separate housing.

In further embodiments, see FIG. 16, a separate housing 268 may be used for mounting one or more depth guides. The user places the router on a top surface 270 of the housing and adjusts the router bit depth as described above. A bit stop 272 has a threaded rod 273 or bolt that threads into an aperture formed in a mounting surface 274 positioned below the top surface 270 of the housing. A lock nut 275 secures the bit stop against movement relative to the top surface 270. Additionally, see FIG. 30, a depth guide housing 276 may be mounted to the top clamp assembly 277 of the jig. When mounted in this way, the depth guide housing is readily accessible to the user, yet still allows a workpiece to be positioned on the upper face 108 of the jig. The depth guide housing can also be mounted on the top clamp assembly together with a storage device 278, or the depth guide housing 276 and storage device 278 may be integrally formed as a single unit.

Referring to FIGS. 1, 7, 8A, and 12, in a further aspect of the invention, a workpiece stop 168 is disclosed. In the present embodiment, the workpiece stop is formed as a unitary piece. In further embodiments, the workpiece stop may be formed from two or more components connected together. The workpiece stop of the present embodiment permits efficient workpiece positioning for various types of joints. The workpiece stop allows for common adjustment for workpieces disposed on either the front face 106 or the top face 108.

In particular, when cutting half-blind dovetails in a single pass, or operation, the two workpieces forming the joint are required to be offset from each other. For example, as may be best observed in FIG. 12, the pin board 114 must be positioned horizontally on the top face 108 of the jig, and the tailboard 112 must be positioned vertically on the front face. In order for the pins 172 and tails 170 to correctly align in the finished joint, the two boards must be laterally offset by the correct distance. Typically, it is desirable for a half pin to be formed on either side of one of the workpieces so the joint appears uniform.

The workpiece stop may be configured to accommodate the spacing of common half-blind dovetail joints. For example, the workpiece stop may have a first edge 281 of a first portion 174 positioned against the front face 106 of the jig and a second edge 280 of a second portion 176 positioned against the top face 108. An intermediate area 284 is shaped to conform to the interface between the top face and front face of the jig. The first and second edges may be offset by ½" (one-half inch) to accommodate spacing of a common ½" (one-half inch) fixed half-blind dovetail joint. Workpiece stops with other offsets may be provided, and multiple workpieces with different offsets may be provided with the jig 100. In an alternative embodiment, the workpiece stop may be formed of a first portion with a first edge movable relative to a second portion with a second edge, so that the user can adjust the offset between the first edge and the second edge.

In a preferred embodiment, at least two workpiece stops are included in the jig apparatus 100. A first workpiece stop 168 is positioned proximate the left side of the base 102, and a mirror-image workpiece stop 282 is positioned proximate the right side of the base. Additionally, each workpiece stop may have a straight edge 283 opposite the first 281 and second 282 offset edges. For example, one side of the stop 281, 282 provides the offset for cutting one-pass half-blind dovetails, while the other side of the stop 283 is flush for cutting variable-spaced half-blind dovetails. The stop assemblies at either end of the jig are mirror images of each other. When the left stop assembly is swapped for the right stop assembly, the interior edges of the stop assemblies will switch from flush to offset and vise versa.

In the current embodiment, a workpiece stop includes a slot 178 extending generally from the aligned side to the offset side of the stop such that the right/left positioning of the workpiece may be finely adjusted, thereby permitting adjustable and repeatable workpiece positioning along the length of the template. A fastener such as a screw 180, in threaded engagement with the base, or other releasable securing device may be utilized for securing the workpiece stop 168. For example, a user may wish to vary the position of the workpiece along the template. In this fashion, a user may select where the edge of the workpiece is located with respect to an extension or finger included on the template. In additional embodiments, portions of the workpiece stop 168 may include a contoured edge such as a half-circle recess to accommodate a threaded rod, such as may be included in a template securing system, a clamping assembly, or the like.

Referring to FIG. 13, in an alternate embodiment, a multi-component workpiece stop 182 is included in a jig apparatus 100. In this embodiment, the workpiece stop 182 includes a first workpiece stop portion 186 for alignment generally on a front face 106 and a second workpiece stop portion 184 for alignment on the top face 108. A fastener 285 may secure the first and second portions while a slot 286 formed in at least one of the portions may permit sliding adjustment with respect to the base. A fastener 287 extending through the slot engages with a threaded aperture in the base 102. In further embodiments, the workpiece stop 182 may be configured such that one portion is fixed while the other portion is slidably adjustable, or both portions may be adjustable relative to each other and to the base. Additionally, the two portions may adjustment relative to one another independent of lateral adjustment of the entire workpiece stop. For example, a user may vary the offset without repositioning the entire workpiece stop, or the user may reposition the entire workpiece stop without adjusting the offset.

Figure 38:
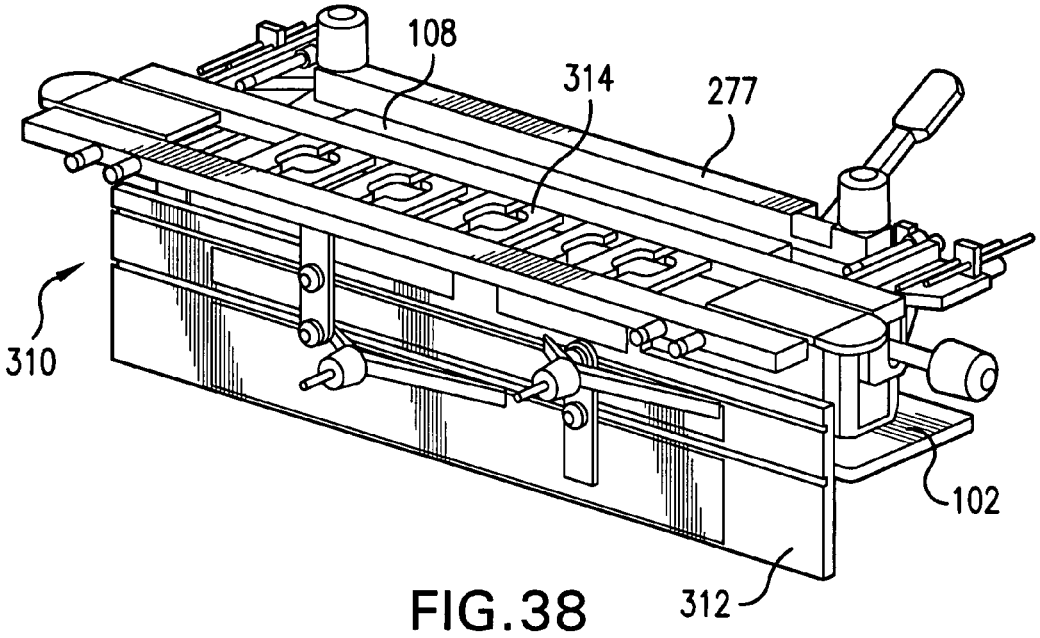
FIG. 38 is an isometric view of a mortise and tenon assembly in accordance with embodiments of the present invention.

Referring to FIG. 38, an embodiment of the present invention includes a removable assembly 310 for forming mortise and tenon joints. The mortise and tenon assembly attaches to the base 102 and has two parts: a base assembly 312 and a finger assembly 314. The finger assembly 314 can be used together with the mortise and tenon base 312 or can be mounted to the jig base 102 independently of the mortise and tenon base. When the mortise and tenon base is mounted to the jig base, the front clamp assembly 140 must be removed. Accordingly, when using the mortise and tenon finger assembly, the user can mount a workpiece in three different positions: (1a) up-and-down using the mortise and tenon base 312 with the cam-lock 140 removed (shown in FIG. 38); (1b) up-and-down using the cam-lock 140 on the front face 106 with the mortise and tenon base 312 removed; (2) left-to-right using the mortise and tenon base 312 (potentially extending beyond the edges of the front face 106); or (3) front-to-back using the cam-lock 277 on the top face 108. (The mortise and tenon base 312 must be removed to secure a workpiece on the top face 108.) Additionally, the finger assembly 314 may be mounted directly to the mortise and tenon base 312, allowing the entire mortise and tenon assembly 310 to be used as a portable, stand-alone mortise and tenon jig. This allows the craftsperson to carry the jig to larger workpieces rather than having to bring larger workpieces to a fixed jig.

Figure 39:
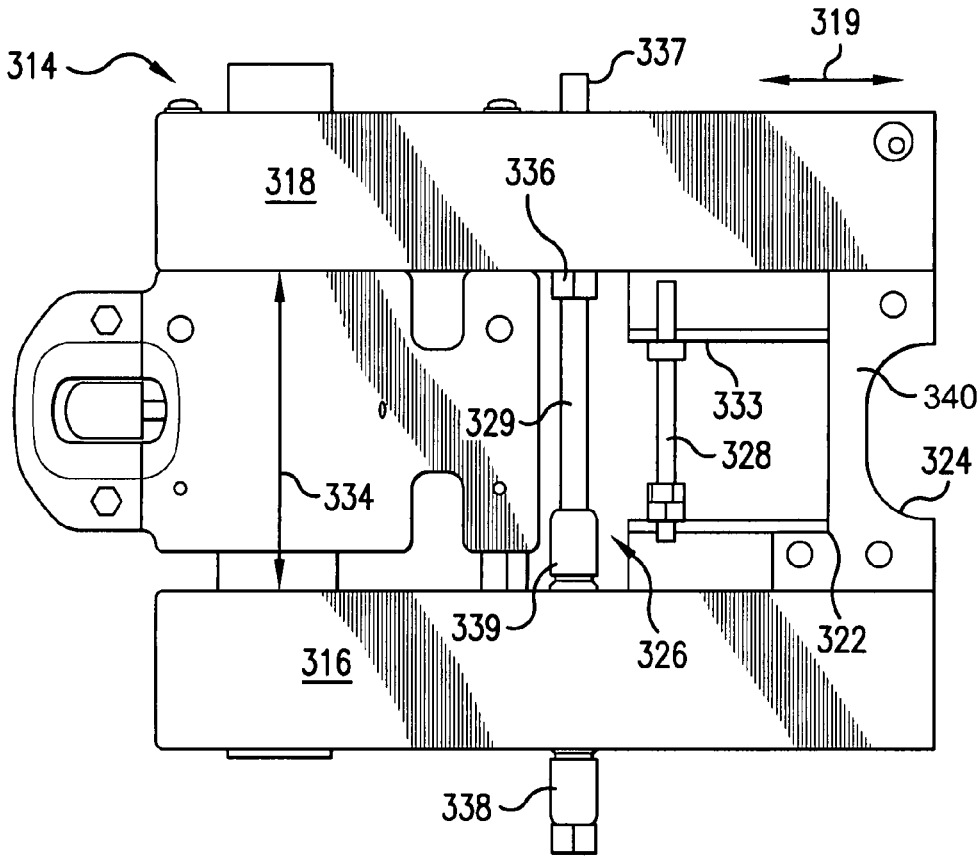
FIG. 39 is a partial plan view of a finger assembly of the mortise and tenon assembly shown in FIG. 38.
Figure 39A:
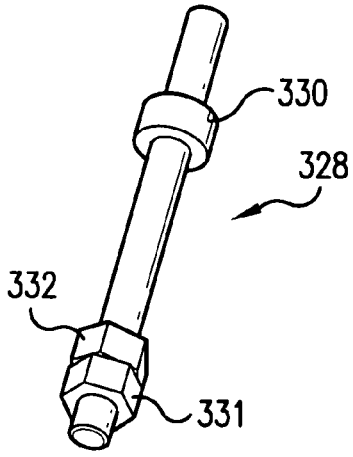
FIG. 39A is an isometric view of a positioning rod for use with the finger assembly of FIG. 39.

Referring to FIG. 39, an embodiment of the finger assembly 314 has a front rail 316, a rear rail 318, and a number of fingers 340 extending between the two rails. The mortise and tenon fingers 340 are adjustable to various positions left-to-right 319 in order to form mortises and tenons of variable length. The fingers are also variously configured with square corners 322 or rounded corners 324. The rounded corners form round edged tenons and mortises while the square corners form square edged tenons. Mortises formed with the square corners will be slightly rounded, which the craftsperson will square the tenon using a chisel mortiser (not shown).

In an embodiment of the mortise and tenon finger assembly 314, the user can adjust the distance between the front 316 and back 318 rails using an adjustment assembly 326. The adjustment assembly comprises a first positioning rod 328 and a second positioning rod 329. The first positioning rod 328 has a fixed collar 330 at a first end and a threaded collar or nut 331 at a second end. The rod may also have a second threaded collar or nut 332 that serves to lock the first nut 331 against rotation. The first and second ends of the rod are adapted to removably attach to the back rail 318 and the front rail 316, such as by sitting in a cradle 333 or other fixture connected with the rail. The collar 330 and the threaded nut 331 abut the front and back rails, thereby positioning the front rail 316 relative to the back rail 318. In this way, the user can adjust the distance 334 between the front and back rails and fix the distance using the rod 328. The user can then remove the rod and adjust the mortise and tenon finger assembly to different widths for different cuts. When the user wishes to return to the originally set distance 334, the user can place the rod 328 in the appropriate fixture 333 and immediately return the distance 334 to its original setting.

The second positioning rod 329 may have a fixed collar 336 proximate a first end or may be directly attached to the back rail 318. The second rod includes an exterior thumbnut 338 positioned proximate the exterior side of the front rail 316 and an interior thumbnut 339 positioned proximate the interior side of the front rail. The interior thumbnut maybe adjusted relative to the collar 336 to vary the distance 334 between the two rails. The exterior thumbnut 338 may be tightened against the exterior surface of the front rail to hold the rail tightly against the interior thumbnut, securing the rail against movement while the finger assembly is in use. One of skill in the art will understand that the first 328 and second 329 rods may be used together or independently and that the exterior thumbnut 338 may be used to hold the rail against either the interior thumb nut 339 or the nut 331, or both.

Figure 40:
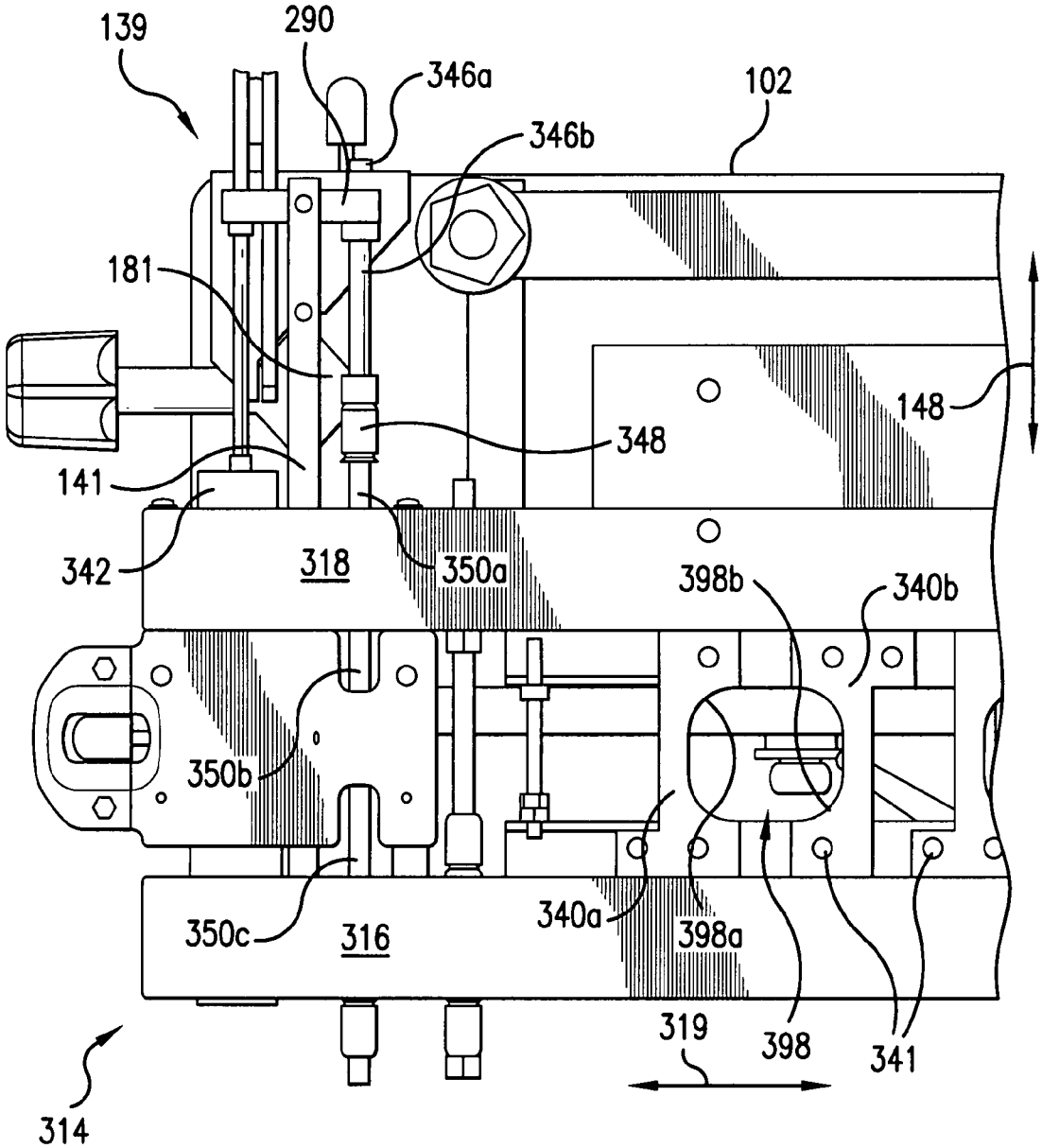
FIG. 40 is a partial plan view, as seen from above, of a finger assembly and a repeatable alignment system in accordance with the mortise and tenon assembly shown in FIG. 38.

An embodiment of the invention is shown in FIG. 40. In order to vary the length of the mortise or tenon, the user moves the fingers 340 left-to-right 319 along the front and back rails. Once a finger is correctly positioned, the craftsperson secures the finger against further movement by tightening a screw 341 on the top face of the finger. The screw connects to a securing system (not shown) in which the screw 341 passes through the finger 340 and threads into a first wedge; as the screw tightens, the first wedge engages a second wedge, forcing the second wedge to move laterally and press against the front or back rail. The engagement surface of the rail is smooth, and friction between the rail and the second wedge keep the finger from moving left-to-right 319.

Referring again to FIG. 40, embodiments of the jig provides a means for positioning the finger assembly 314 front-to-back 148 with respect to the jig base 102. In embodiments of the invention, the finger assembly 314 mounts to the support rails 141 of the template mounting system 181 for front-to-back adjustment. In a first embodiment, a stop 342 in attached to or integrally formed with the rear rail 318. The user positions the back rail 318 by abutting the stop 342 with an adjustable finger 199 of the repeatable alignment system 139. In a further embodiment, an adjustable rod 344 mounts to a block 290 of the alignment system 139. The rod may be threaded and use one or more nuts 346*a, b* to adjust the front-to-back position of the rod. Embodiments of the rod have a scale 347 marked or otherwise inscribed on the rod to aid correct alignment of the rod on one side of the assembly with a corresponding rod on the other side of the assembly. A first thumb nut 348 controls the front-to-back position of the rear rail 318. A second thumbnut 349 locks the finger assembly 314 against movement relative to the alignment system 139 and mounting system 181. Portions 350*a, b, c* of the finger assembly may be marked with a scale to visually ensure that the front rail 316 is parallel to the back rail 318.

Figure 64:
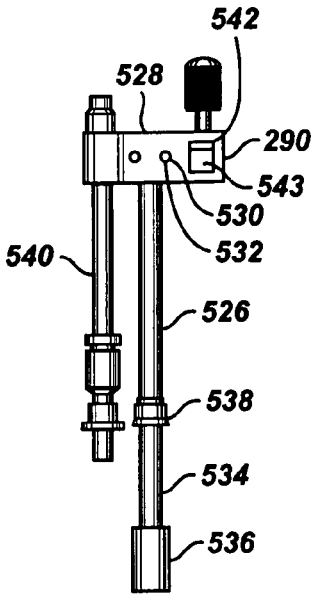
FIG. 64 is a plan view of the positioning assembly for the mortise and tenon finger assembly.
Figure 65:
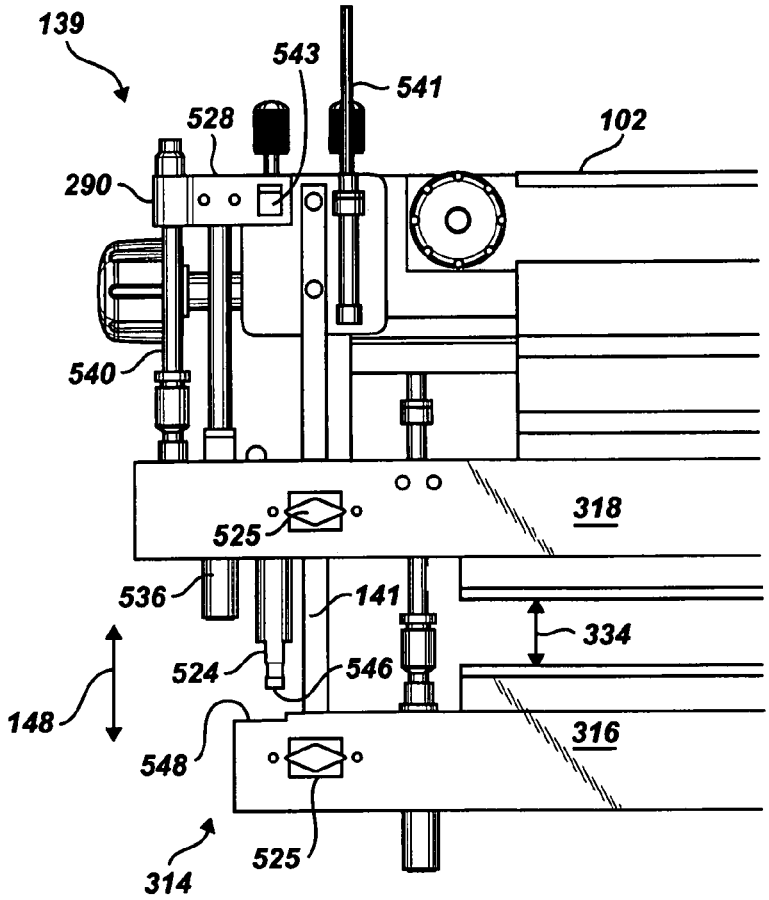
FIG. 65 is a partial plan view of the positioning assembly of FIG. 64 with the mortise and tenon finger assembly mounted on the jig base.
Figure 66:
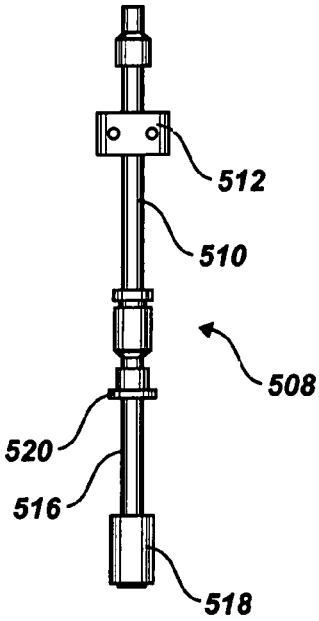
FIG. 66 is a plan view of the adjustment rod of the mortise and tenon finger assembly.
Figure 67:
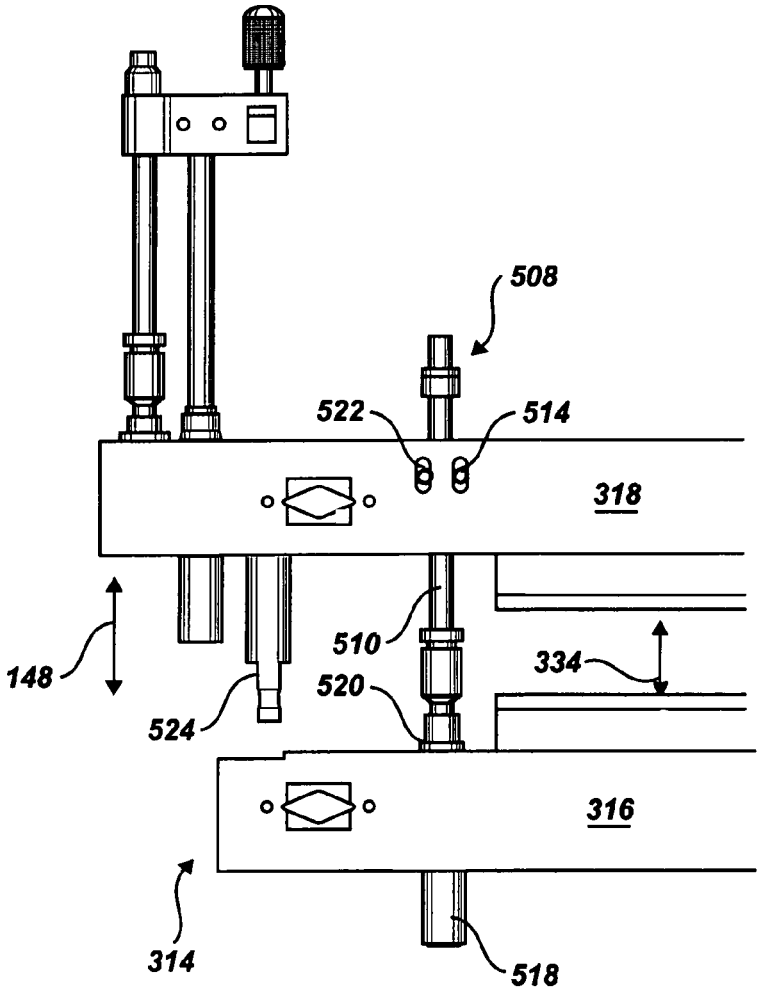
FIG. 67 is a partial plan view of the adjustment rod of FIG. 66 together with the mortise and tenon finger assembly.
Figure 68:
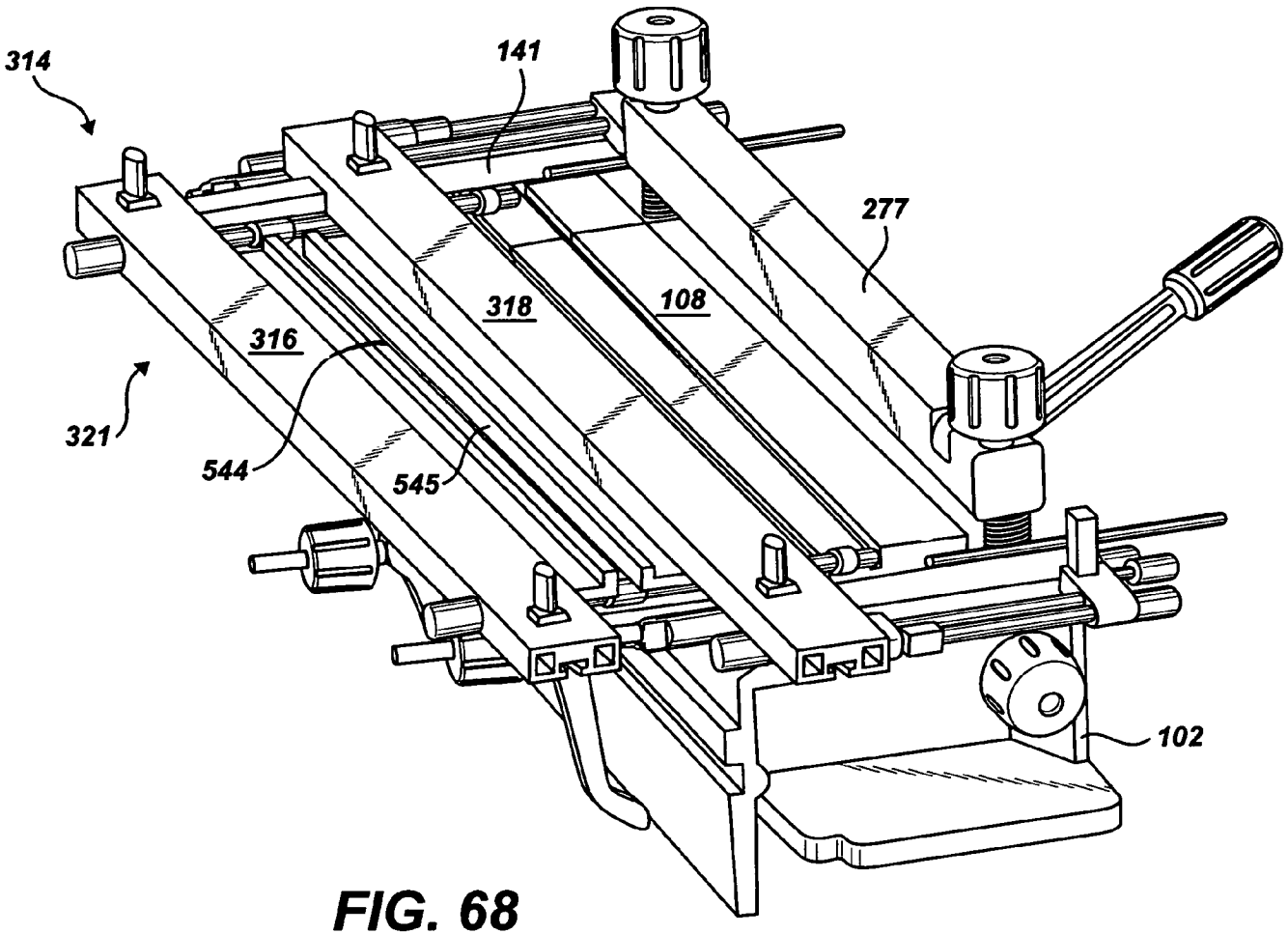
FIG. 68 is an isometric view of the embodiment of FIG. 62 with the mortise and tenon finger assembly configured for use as a dado guide assembly.
Figure 69:
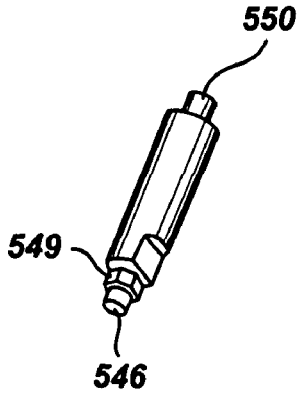
FIG. 69 is an isometric view of the adjustable stop for use with the dado guide assembly.

Alternatively, a positioning system 139 as shown in FIGS. 64-67 may be used to position the front rail 316 and back rail 318 of the finger assembly 314 with respect to each other and with respect to the base 102. Referring to FIGS. 66-67, the user can adjust the distance 334 between the front rail 316 and back rail 318 by using an adjustment assembly 508. The adjusting assembly 508 comprises a rod 510. A threaded portion of the rod 510 passes through a block 512, and screws 514 attach the block 512 to the back rail 318. As the rod 510 rotates relative to the back rail 318, the rod 510 also moves front-to-back 148 relative to the back rail 318 because the rod 510 is threaded through the block 512, and the block is fixedly attached to the back rail 318.

A front portion 516 of the rod 510 passes through a hole or slot in the front rail 316, capturing the front rail 316 between a knob 518 and a nut or other collar 520. The rod 510 can rotate relative to the front rail 316, but the front rail 316 must move together with the rod 510 in a front-to-back 148 direction. Therefore, rotating the knob 518 also rotates the rod 510, and as the rod rotates, the rod moves front-to-back 148 within the threaded block 512, forcing the front rail 316 to move relative to the back rail 318. The rod 510 may also include indexing marks that make it more convenient for the user to repeatably position the front rail 316. Slots 522 formed in the back rail 318 where the screws 514 connect the threaded block 512 to the rail allow for minor adjustment to correctly match the index marks of positioning assemblies on the right and left sides of the jig. An adjustable stop 524 can be used to easily and repeatably position the front rail 316 with respect to the back rail 318.

Referring to FIGS. 64-65, embodiments of the positioning system 139 also allow the user to position the front 316 and back 318 rails relative to the jig base 102. A rod 526 threads into a threaded block 528. The threaded block 528 slidably mounts into the rear mounting block 290, which mounting block 290 is fixedly mounted to the base 102. Screws 530 pass through holes 532 to secure the threaded block 528 to mounting block 290 while allowing minor front-to-back 148 adjustment of the threaded block 528. A forward portion 534 of the rod passes through the back rail 318, engaging the rail between a knob 536 and a rear nut or collar 538. In this manner, turning knob 536 adjust the front-to-back 148 position of the back rail 318, and correspondingly the front rail 316, relative to the base 102. The rod 526 may include index marks that allow the user to more accurately adjust the position of the back rail 318. The positioning system 139 may also include various adjustable stop 540, 541 for easier repeatable settings. Once the rails 316, 318 are correctly positioned, knobs 525 turn to tighten the front 316 and back 318 mortise and tenon rails against mounting rail 141, locking the mortise and tenon rails 316, 318 in place.

Embodiments of the positioning system 139 also include a release mechanism 542 having a stop 543 movable between an up position and a down position. In the down position, the stop 543 engages the base 102, fixing the rear bracket 290 to the base 102 and allowing the positioning system 139 to function. In the up position, the stop 543 disengages from the base 102 allowing the mortise and tenon finger assembly 314, including the positioning system 139, to be removed from the base.

Referring to FIGS. 65 and 68-76, in a further embodiment of the jig apparatus 100, portions of the mortise and tenon finger assembly 314 can also be used as a dado guide assembly 321. As when using the finger assembly 314 to form mortises, the front rail 316 and the back rail 318 support the router, while the inside surface, 544, 545 of each rail 316, 318 guides the router bit. A router guide system such as shown in FIGS. 28-29 or 56-58 can be used in conjunction with the router to properly position the router bit between the guide rails 316, 318.

The proper distance between the two rails 316, 318 is set using stop 524 shown in FIG. 65. In order to correctly adjust the spacing 334, a sample workpiece is placed between an end 546 of the stop 524 and a contact surface 548 formed on the rear edge of front rail 316. The front rail 316 is then moved toward the back rail 318 until the stop 546 and contact surface 548 each touch an opposite side of the workpiece. The rails are then secured in position and the workpiece is removed. The process is repeated on each side, left and right, of the guide assembly 321 to insure that the dado guide is correctly spaced along its entire length.

Stops 524 may be fixed length or adjustable. A nut 549, may allow the end 546 of the stop to be adjusted and locked into place. Additionally, the stops 546 may be removed and interchanged for other stops. The rear of the stop has a post 550 extending from the base of the stop. The post is inserted into a corresponding hole formed in the rear rail 318 allowing the stop to be removed and replaced. A series of stops may be provided corresponding to the desired dado size in proportion to workpiece width.

Figure 71:
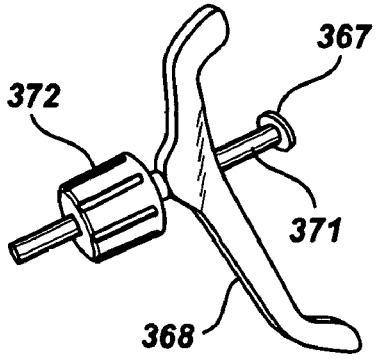
FIG. 71 is an isometric view of a clamp for use with the dado guide assembly.
Figure 70:
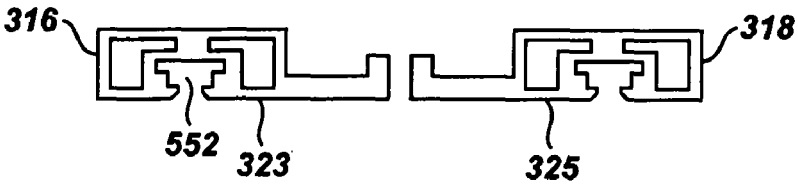
FIG. 70 is an a cut-away plan view of the dado guide assembly rails.
Figure 72:
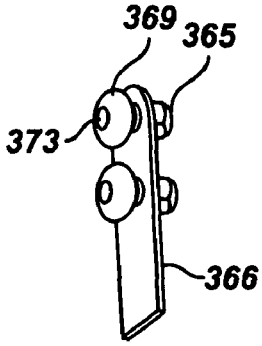
FIG. 72 is an isometric view of a positioning guide for use with the dado guide assembly.
Figure 73A:
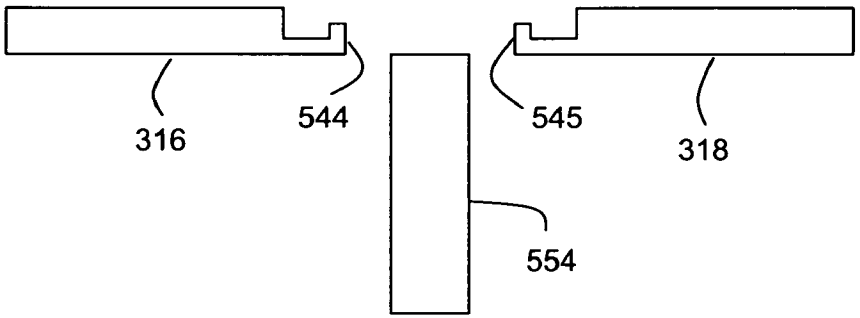
FIGS. 73A-D are schematic illustrations of the steps for forming a sliding dovetail tenon board.
Figure 73B:
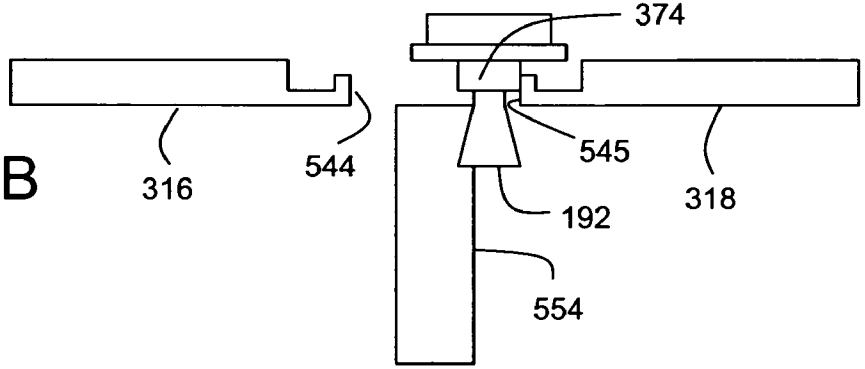
Figure 73C:
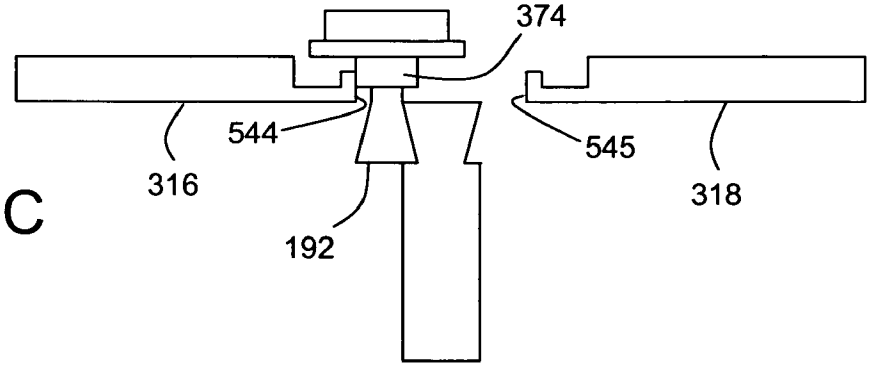
Figure 73D:
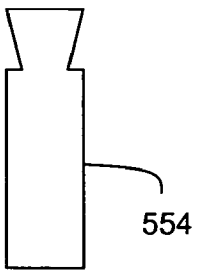

Embodiments of the dado guide assembly 321 may be used by positioning the workpiece across the top surface 108 of the jig base 102 and securing the workpiece using the top clamp 277. Alternatively, embodiments of the guide assembly can be used independently of the jig base 102. Referring to FIGS. 70-72, slots 552 formed in the undersides 323, 325 of rails 316, 318 cooperate with clamps 368 to secure a workpiece to the dado assembly 321. A head 367 is formed at the end of the threaded rod 371. This head 367 is inserted into T-slot 552. The nut 372 can then tighten the clamp 368 against an undersurface of the workpiece, thereby holding the workpiece against the dado guide assembly 321. A positioning guide 366 may also be used in order to correctly position the workpiece. A head 365 is formed on an end of threaded rod 373 and inserted into slot 552. A nut 369 tightens the guide 366 against the underside 323, 325 of the rail 316, 318, securing the guide 366 to the rail and providing a positive stop for positioning the workpiece.

Figure 46A:
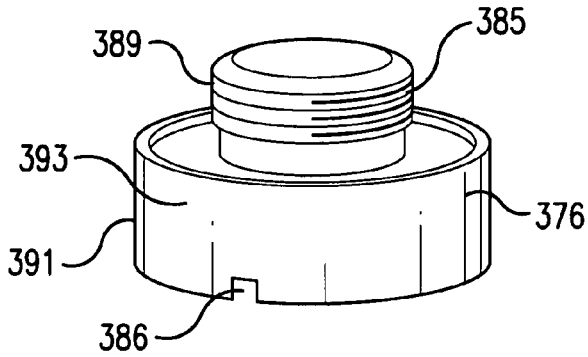
FIGS. 46A and B are isometric views of various template guides for use with the system of FIG. 44.
Figure 46B:
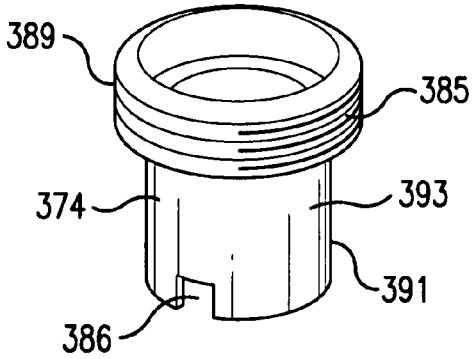
Figure 47:
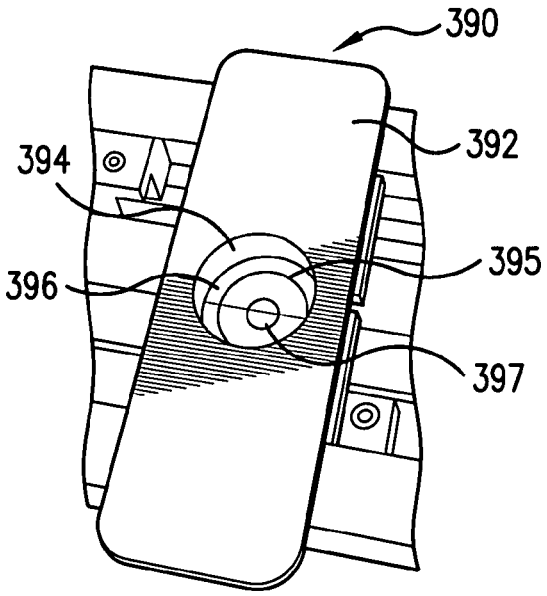
FIG. 47 is top plan view of a mortise and tenon set-up guide in accordance with embodiments of the invention.

The dado guide assembly may also be used to create sliding dovetails. FIGS. 73A-D schematically illustrate the process of forming the tenon board for a sliding dovetail, and FIGS. 74A-D illustrate the process of forming the corresponding dovetail dado board. Beginning with FIG. 73A, the user sets the distance between the rails 316, 318 as described above. Next, the user mounts the tenon board 554 vertically to the front surface of the jig base. A template guide, e.g. 374 (FIG. 46B), runs along the edge 545 of one rail 318, guiding the router bit 192 along one edge of the tenon board 554. On the reverse pass, the template guide 374 passes along the edge 544 of the other rail 316, guiding the router bit 192 along the other edge of the tenon board and leaving a completed tenon board 554, FIG. 73D.

Figure 74A:
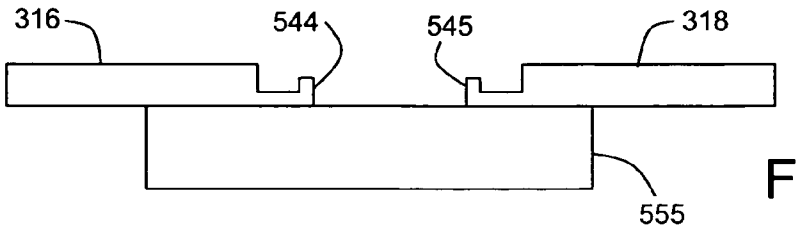
FIGS. 74A-D are schematic illustrations of the steps for forming a sliding dovetail dado board.
Figure 74B:
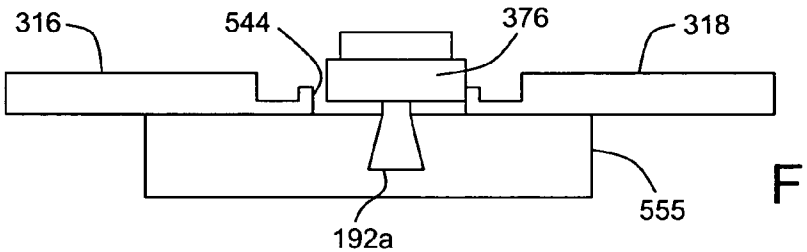
Figure 74C:
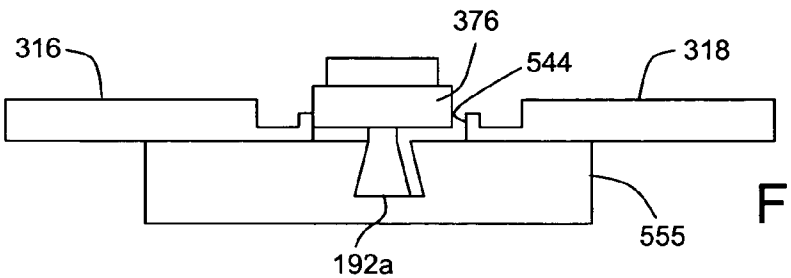
Figure 74D:
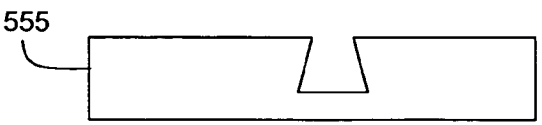
Figure 76C:
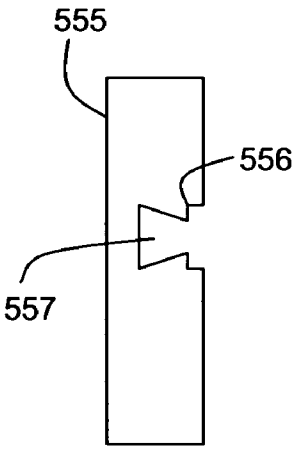
FIG. 76C is an end view of the dado board of a housed sliding dovetail joint.
Figure 76B:
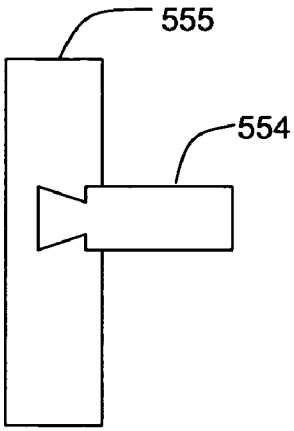
FIG. 76B is an end view of a housed sliding dovetail joint.
Figure 76A:
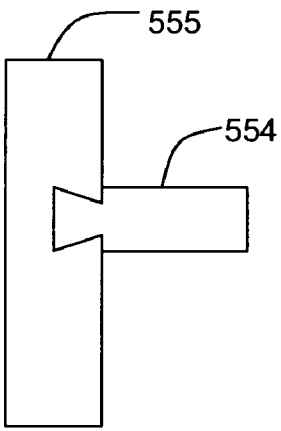
FIG. 76A is an end view of a sliding dovetail joint.

Turning to FIG. 74A, the user mounts the dovetail dado board 555 horizontally to the top surface of the jig base. Using a different template guide, e.g. 376 (FIG. 46A), and possibly a different router bit 192*a*, the user guides the router bit along the edge 545 of one rail 318 and back along the edge 544 of the other rail 316. A complete dovetail dado board 555 corresponding to the tenon board 554 results, FIG. 74D. The boards can then be fitted together as shown in FIG. 76A. Additionally, by cutting a straight dado 556 overlaid with a dovetail dado 557 in the dado board 555, see FIG. 76C, a housed sliding dovetail can easily be formed as shown in FIG. 76B.

Figure 75B:
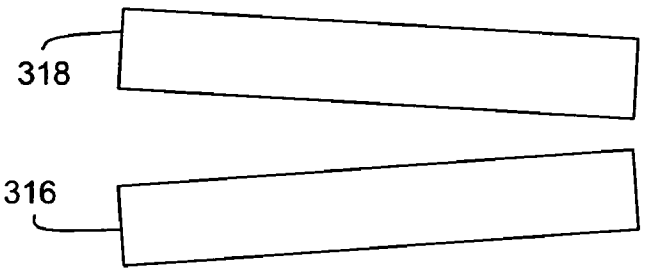
FIG. 75B is a schematic view of the guide rail positions for forming tapered dados.
Figure 75A:
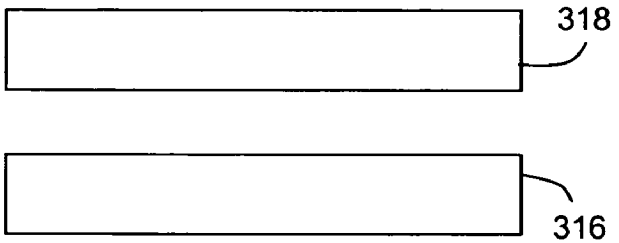
FIG. 75A is a schematic view of the guide rail positions for forming non-tapered dados.

Typically, the right and left stop will be of equal length resulting in parallel front 316 and back 318 rails as illustrated in FIG. 75A. Such a parallel set-up will result in a non-tapered sliding dovetail. However, the user may wish to form a tapered sliding dovetail. In order to do so, asymmetrical left and right stops may be provided such that the spacing between the rail 316, 318 is not constant, as illustrated in FIG. 75B. Alternatively, the user could set adjustable stops 524 to different lengths in order to create and adjust the taper of a sliding dovetail. Additionally, a user may wish to form a stopped dado. In this case, a finger 340 from the mortise and tenon finger assembly 314 can be positioned between the front 316 and back 318 rails at an appropriate position for the desired end of the dado.

Figure 41:
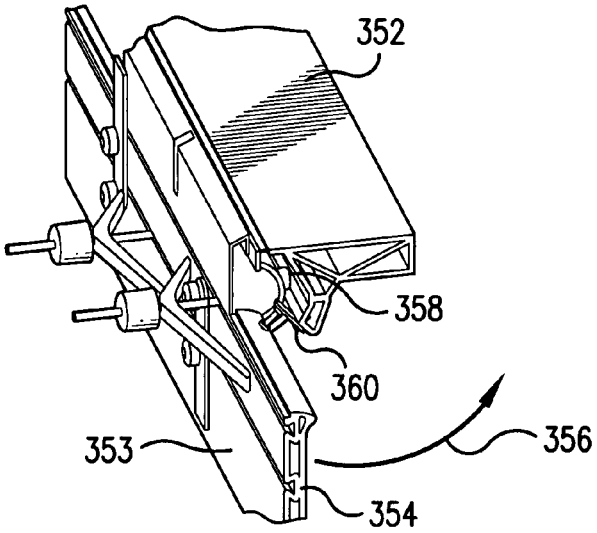
FIG. 41 is an isometric view of an embodiment of the base assembly for use with a mortise and tenon assembly.
Figure 42:
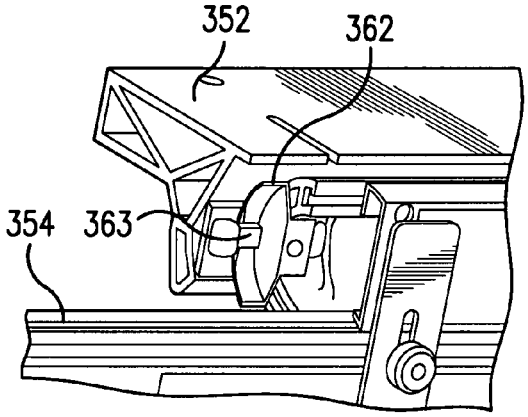
FIG. 42 is a partial isometric view of the base assembly of FIG. 41.

Referring to FIGS. 38 and 41, embodiments of the mortise and tenon base assembly 312 have two parts. A first, top portion 352 attaches to the top face 108 of the jig base 102 using three screws. A second, front portion 354 is pivotally attached to the top portion as shown by arrow 356. The front portion forms a front face 353 to which workpieces are attached in either an up-and-down or a left-to-right orientation. The pivotal attachment of the top portion 352 to the front portion 354 allows the user to form joints at other than perpendicular angles, including mortise and tenon joints as well as dovetail joints, box joints, etc. Embodiments of the pivot mechanism 358 include an adjustable stop 360 allowing the craftsperson to quickly place the front assembly in a perpendicular position when needed. Additionally, as shown in FIG. 42, embodiments of the pivot mechanism 358 include an angle scale 362 and indicator 363 showing the angle of the front portion 354 relative to the top portion 352. The angle of the front portion may be fixed by one or more screws 364 threaded to the top portion that, when tightened, press against plastic pieces (not shown) in the front portion and hold the two portions in position relative to one another (FIG. 43).

Figure 43:
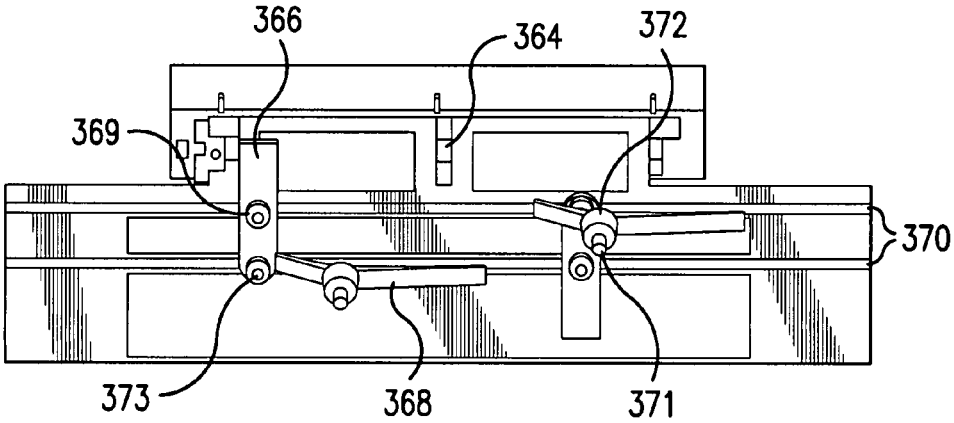
FIG. 43 is a plan view, as seen from the front, of the base assembly of FIG. 41.

Referring to FIG. 43, embodiments of the mortise and tenon base assembly 312 include positioning guides 366 for aligning workpieces and clamp assemblies 368 for clamping workpieces against the face 353 of the front portion 354. Embodiments of the front face 353 have slots 370 that capture the heads of threaded bolts 371, 373. Positioning guides 366 or clamps 368 are placed over these bolts 371, 373 and secured with corresponding nuts 369, 372. The adjustable guides and clamps allow the craftsperson to secure boards in an up-and-down or left-to-right orientation. In addition, because the cam-lock assembly 140 is removable, workpieces that extend beyond the face 353 may be clamped, and the user can form mortise and tenon joints on larger projects.

Figure 62:
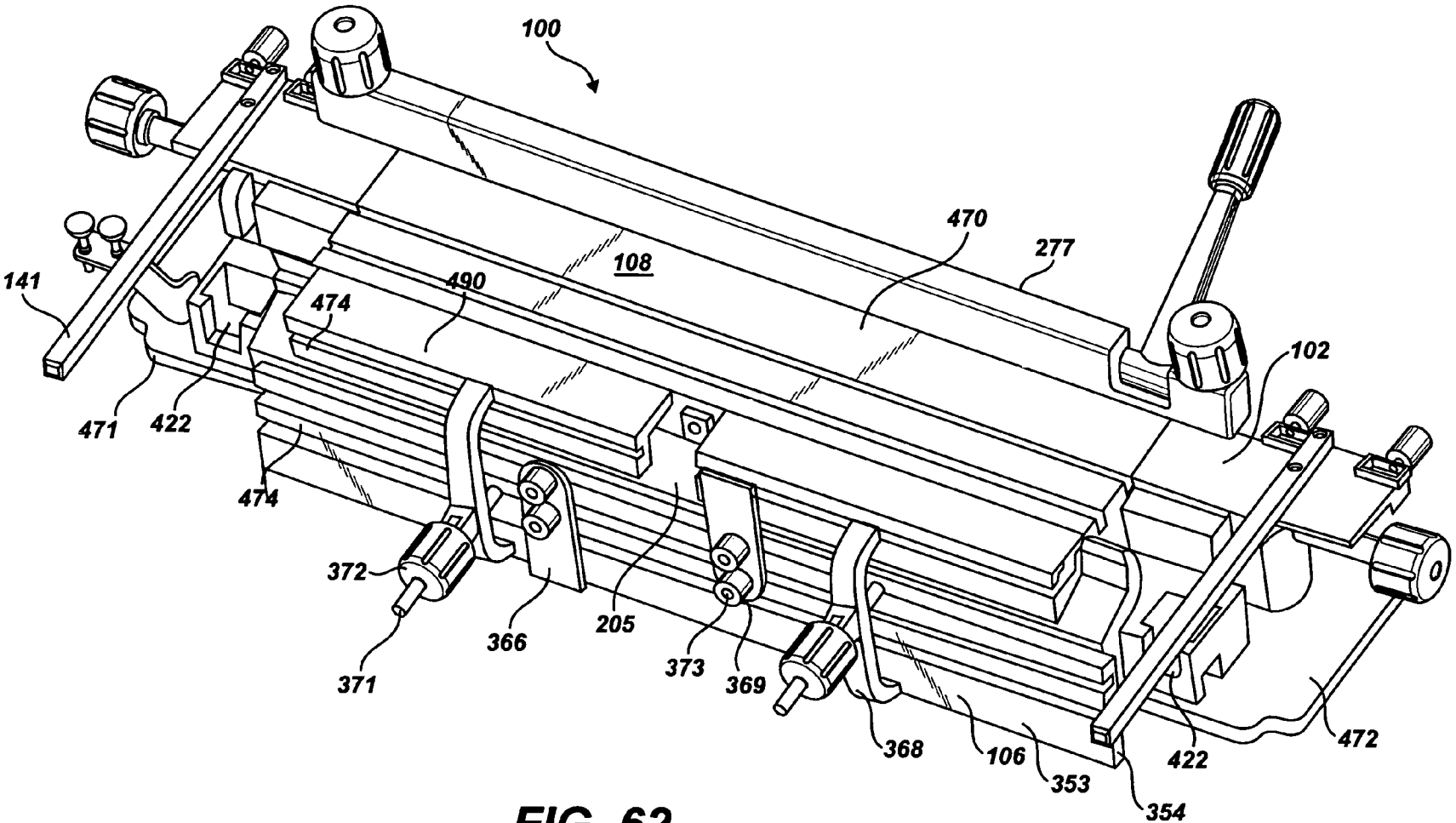
FIG. 62 is an isometric view of the jig apparatus base including a pivotally attached front portion.
Figure 63:
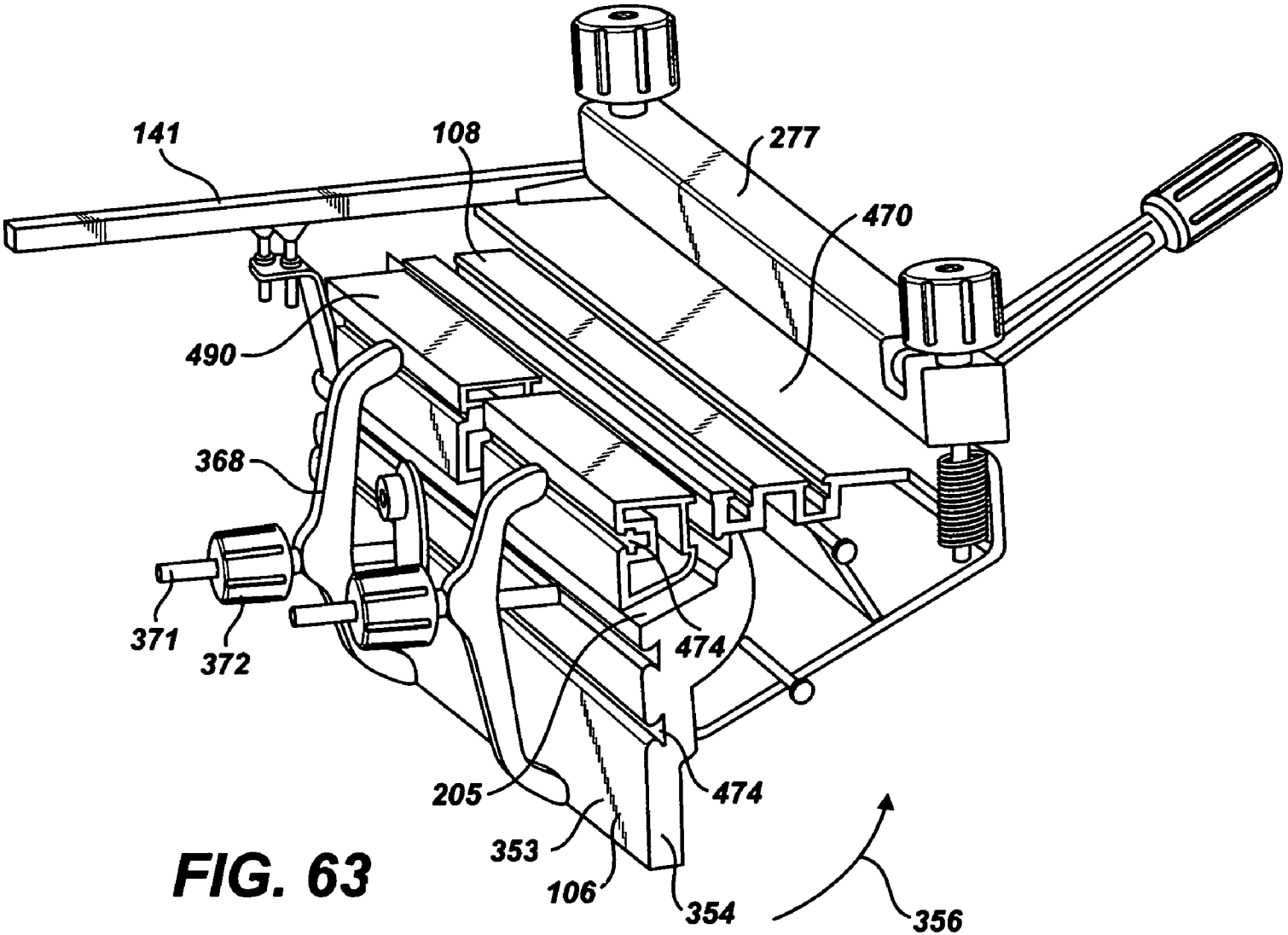
FIG. 63 is a partially cut-away isometric view of the embodiment of FIG. 62.

Alternatively, the mortise and tenon base 312 may be integrated with the main jig base 102 as illustrated in FIGS. 62 and 63. In this embodiment, the jig base 102 is formed from multiple sections, including an extruded center section 470 connected with a left end cap 471 and a right end cap 472 as also described above with respect to FIG. 59. The mortise and tenon front portion 354 pivotally connects directly with the center section 470. The front face 353 of the mortise and tenon front portion 354 acts as the front face 106 of the base 102. The front portion 354 integrates with the center section 470 of the base 102 such that the front surface 106, 353 and the top surface 108 come together with an intermediate step 205. Slots 474, positioning guides 366, and clamps 368 function to secure a workpiece to the front surface 106, 353 of the jig 100. Support blocks 490 may also be positioned in the intermediate step 205, see also FIGS. 59-61.

Additionally, the front clamp assembly 140 may be used in conjunction with the pivoting base portion 354. The front clamp can be easily attached or removed by fitting protrusions 420 into recesses 422, see FIG. 52. Further, because this embodiment of the mortise and tenon base does not require a top portion 352 to be screwed into top surface 108, the adjustable angle front portion 354 may be used in conjunction with top clamp 277. In this manner, the jig may be used to form mortise and tenon joints as well as dovetail and other joints in which the two workpieces meet at an angle other than 90 degrees.

Figure 28A:
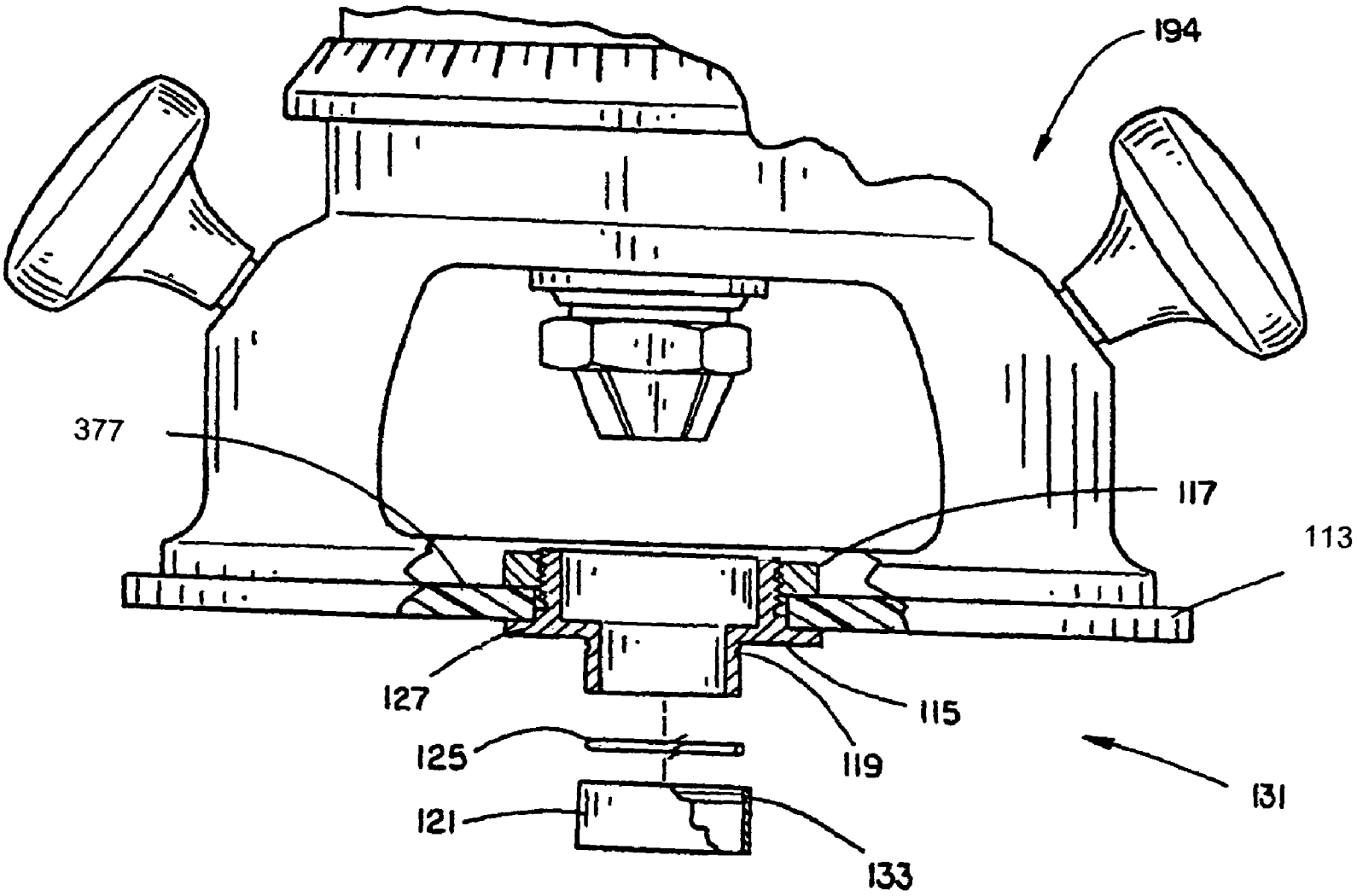
FIG. 28A is partial view of a router including an exemplary variable spacing collar system of the present invention.
Figure 28B:
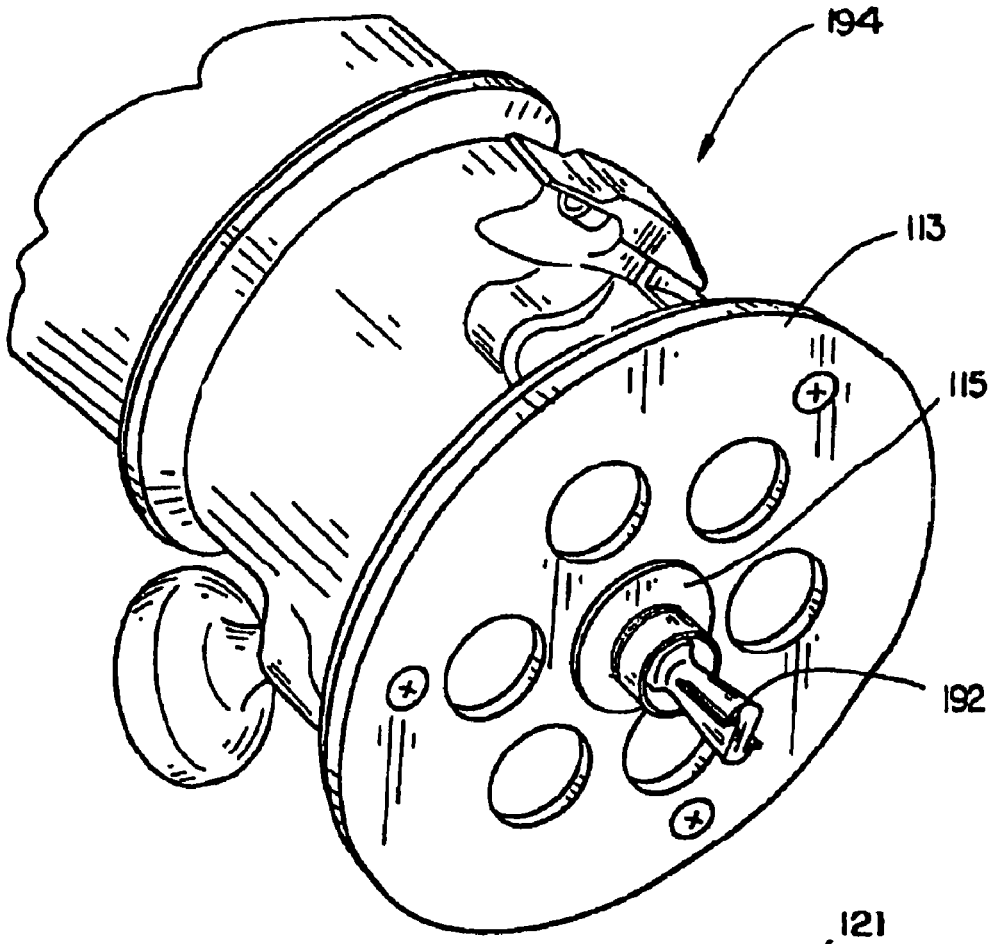
FIG. 28B is an exploded view of an exemplary variable spacing collar system.
Figure 29:
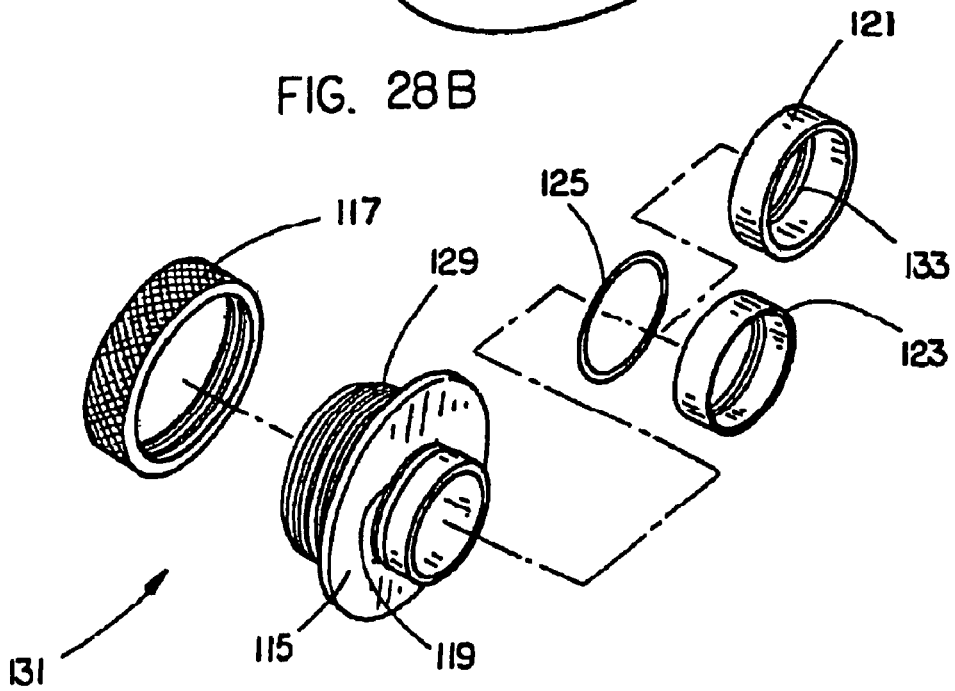
FIG. 29 is a cut-away view of a router including a variable spacing collar in accordance with an exemplary embodiment of the present invention.

Referring to FIGS. 28A, 28B and 29, in embodiments of the current invention, the user follows the contours of a template or other guide surface with a handheld router 194. A router bit 192 extending from the base of the router cuts the workpiece as the router follows the template. To aid the user in following the template, a template guide is attached to the base plate 113 of the router. Those of skill in the art will appreciate that while embodiments of collar system are described for use in forming a mortise and tenon joint, the principles of these embodiments may be suitable for forming inlays or for use with various joint guides, user constructed guides, lettering guides, and the like requiring variable spacing between a guide and a router bit.

When forming a mortise and tenon joint, the user first cuts the tenon, using a straight bit and a tenon template guide. The tenon guide follows around the inside of the space formed by the fingers 340 and rails 316, 318 (FIG. 40). The router bit removes material from the edges of the workpiece to cut the cheeks of the tenon. To cut the corresponding mortise, the same template is used with a larger diameter mortise template guide. If the following formula is used, then the mortise will exactly fit the tenon.

$$ODM=2\cdot DS+ODT$$

Where ODM is the outside diameter of the mortise guide; DS is the diameter of the straight bit; and ODT is the outside diameter of the template guide. Slightly varying the diameter of the mortise guide can make the joint tighter or looser. Embodiments of the invention include apparatus and methods for providing appropriately sized mortise guides and tenon guides.

Embodiments of the template guide include a variable spacing router collar system 131 having a collar body 115 configured for being received by a router base plate 113. For example, the collar body 115 is formed as a generally cylindrical sleeve having an outward extending flange 127 and a threaded end portion 129. The threaded end portion 129 may be engaged by a lock ring 117, having corresponding threading, for securing the collar system 131 to a router base plate. In a further embodiment, the router base plate 113 and the collar body 115 are configured so that the flange 127 is substantially flush with or slightly recessed in the base plate 113. A generally cylindrical outer sleeve 121 having a through aperture for being received about a portion of the collar body 115 may be secured to the collar body via a frictional engagement, a magnetic engagement, or the like. For example, an O-ring 125 may be disposed between the outer surface of the collar body and the outer sleeve. Preferably, the O-ring 125 is retained in a groove 133 formed in the interior aperture of the outer sleeve 121 such that when the outer sleeve is removed from the collar body, the O-ring remains with the outer sleeve. Retaining the O-ring in the outer sleeve 121 may prevent the O-ring from interfering with the proper function of the collar body when the outer sleeve is not used. Additionally, a collar body groove 119 may be included to assist in aligning the outer sleeve 121 to the collar body 115 and in retaining the outer sleeve on the collar body.

In an embodiment of the collar system, the collar body 115 may be used as a tenon guide, and the outer sleeve 121 may serve as a mortise guide. Those of skill in the art will appreciate, a kit of outer sleeves having different diameters and/or a kit of collar bodies having different diameters may be included for permitting variable spacing. For example, a first outer sleeve 121 having a first diameter may be included as part of a kit with a second sleeve 123 having a second outer diameter. In a further instance, a series of collar bodies having differing outer diameters may be implemented for a substantially similar purpose. In an advantageous embodiment, a variable spacing collar system includes a kit of collar bodies/outer sleeves corresponding to commonly formed mortise and tenon joints such as a ½" (one-half inch) joint, a ⅜" (three-eighths inch) joint, or a ¼" (one-quarter inch). Additional collar bodies/outer sleeves having slightly larger or smaller outer diameters may be included for permitting fine adjustment of joint or inlay fit.

Figure 44:
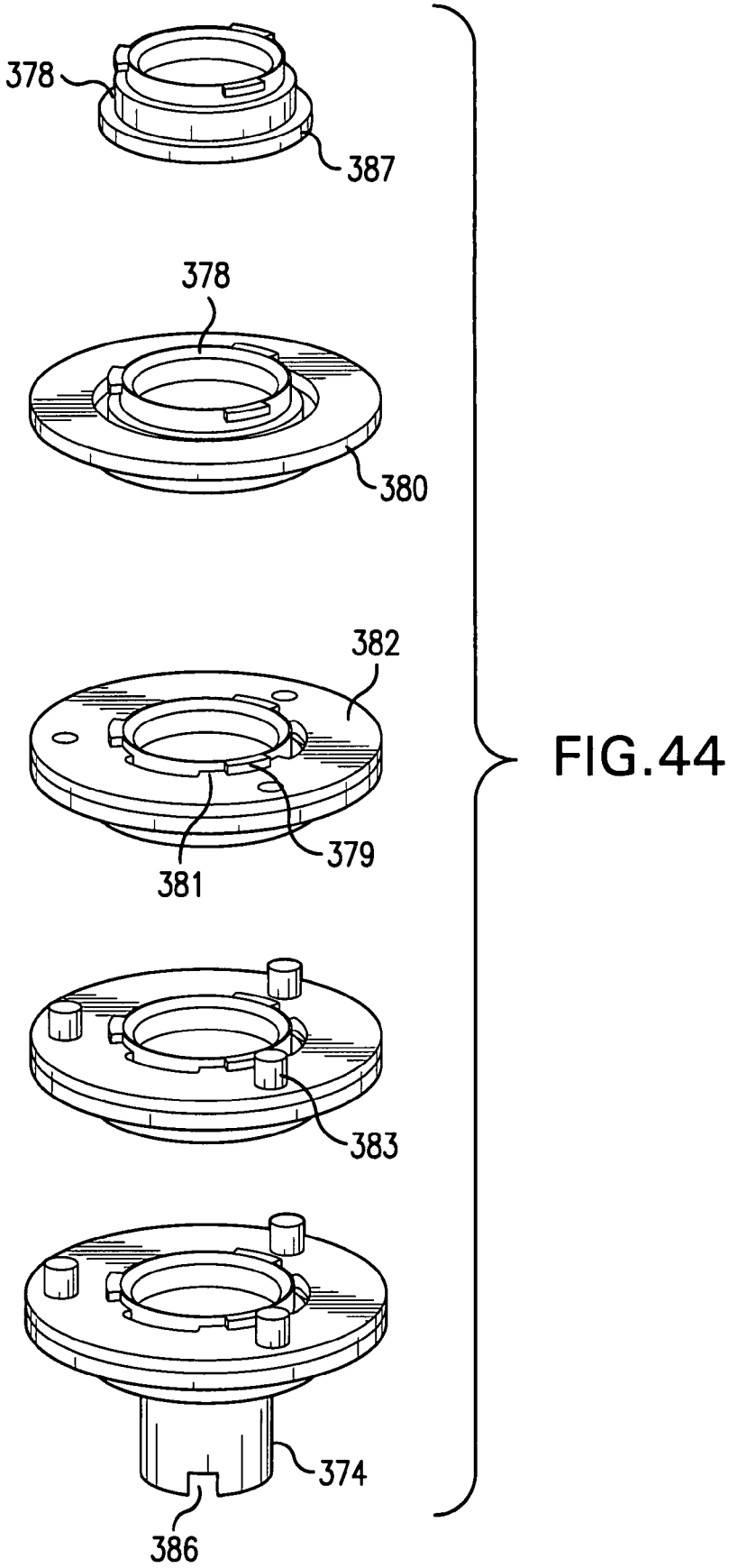
FIG. 44 is an isometric view of an embodiment of a quick-change template guide system at various stages of assembly.
Figure 45:
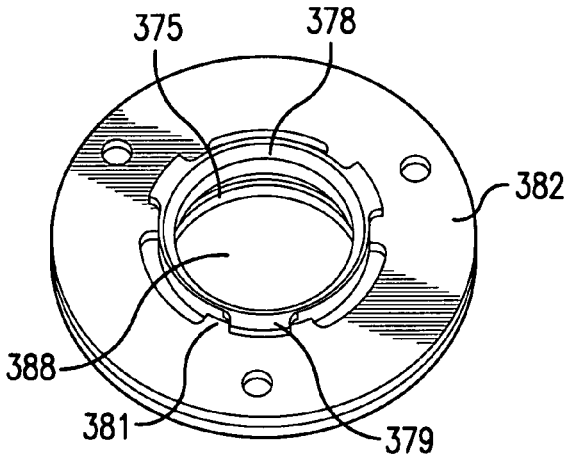
FIG. 45 is a top plan view of the template guide system shown in FIG. 44.

Referring to FIGS. 44-46, in further embodiments, separate template guides, such as a tenon guide 374 and a mortise guide 376, are alternatively attached to the router base using a quick-change system. A mounting ring 378, defining a bore 388 and having a radially extending flange 387, is inserted through the bottom of the router base plate. Female threads 375 are formed along at least a portion of the bore 388. A washer 380 is inserted on a top surface 377 (FIG. 28A) of the router base plate 113, and a lock ring 382 is inserted around the mounting ring 378, thereby capturing the router base between the flange 387 and the washer 380. Tabs 381 on the lock ring engage corresponding tabs 379 on the mounting ring. Setscrews 383 threaded through the lock ring 382 are tightened against washer 380 and base plate 113. As the setscrews are tightened, the setscrews force the lock ring away from the washer and router base plate, pressing the tabs 381 of the lock ring against the tabs 379 of the mounting ring and securing the entire fixture against movement. During normal use, the mounting ring 378, washer 380 and lock ring 382 remain attached to the router base plate 113. An embodiment of the mounting ring is flush with or recessed into the base plate and does not project below the lower plane of the router base. The template guides include an upper portion 389 having male threads 385 and a lower portion 391 with a guide surface 393 for engaging a template. The upper portion threads 385 match the female threads 375 of the mounting ring 378, and the template guide can be quickly and easily screwed into the mounting ring.

Figure 56:
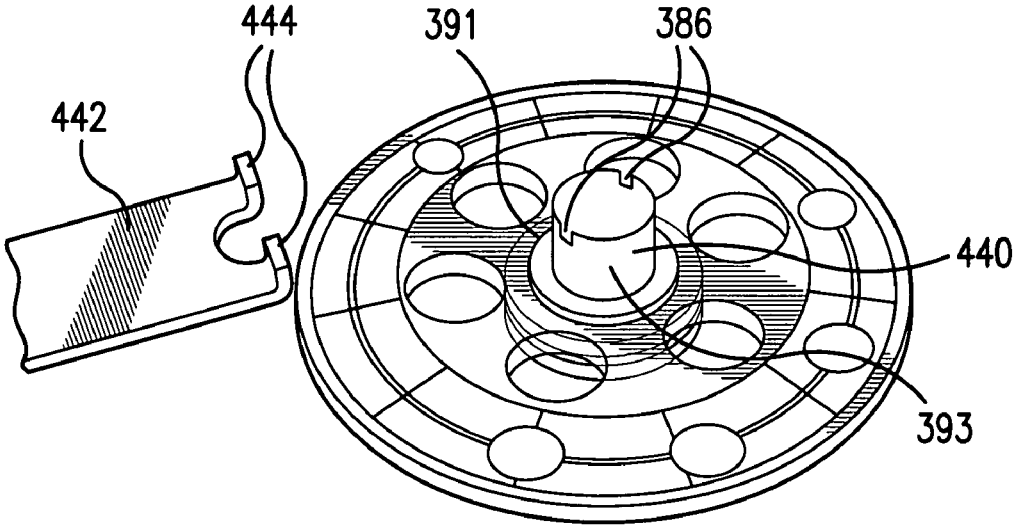
FIG. 56 is an isometric view of an embodiment of a quick-change template guide with slots formed in an end of a guide surface together with a corresponding wrench.
Figure 57:
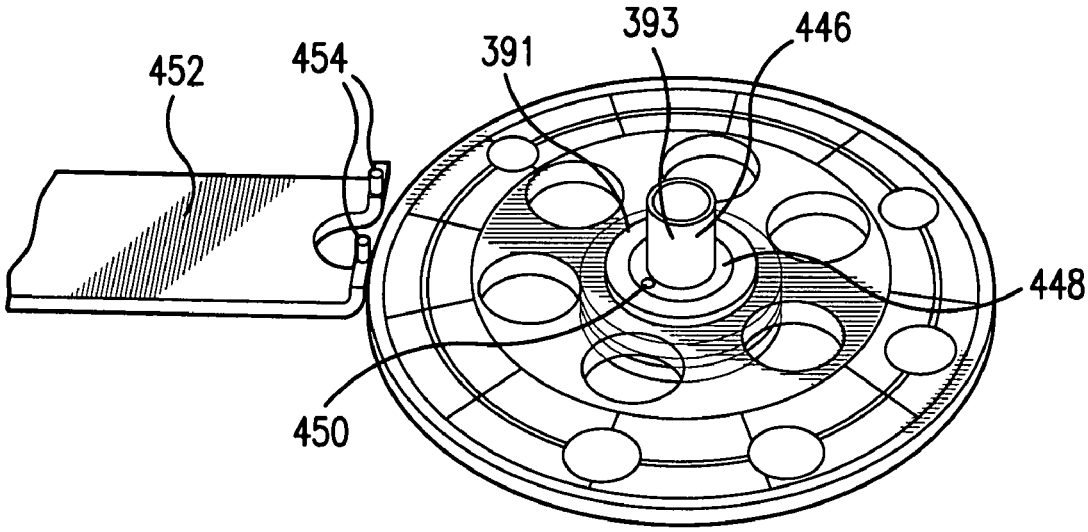
FIG. 57 is an isometric view of an embodiment of a quick-change template guide with recesses formed in a shoulder of the template guide together with a corresponding wrench.
Figure 58:
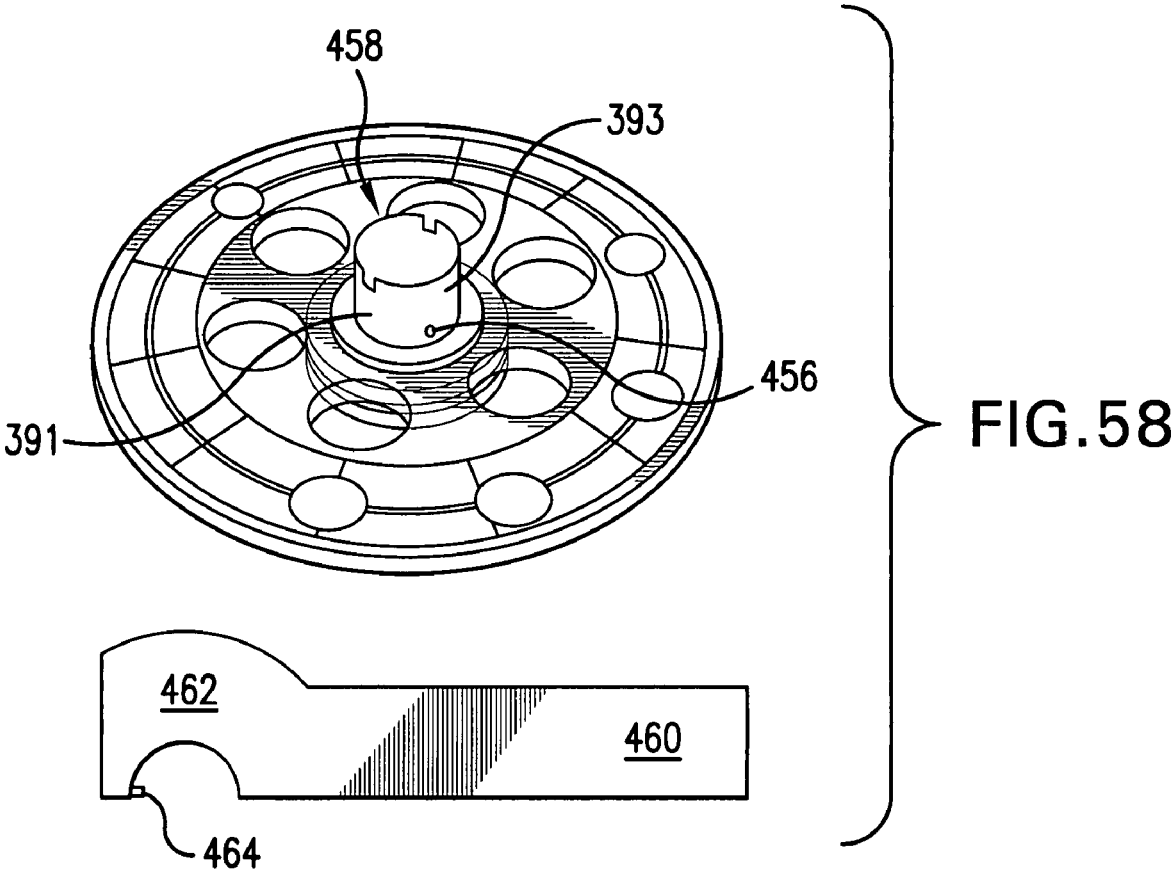
FIG. 58 is an isometric view of an embodiment of a quick-change template guide with recesses formed in a guide surface of the template guide together with a corresponding wrench.

As shown in FIGS. 56-58, embodiments of the template guide include means to tighten or loosen the guide. In a first embodiment, a template guide 440 has slots 386 formed at a lower end of the guide surface 393. A wrench 442 includes protrusions 444 engageable with the slots 386 to tighten or loosen the template guide 440.

In a second embodiment, the lower portion 391 of a template guide 446 has a shoulder 448 formed around an upper edge of the guide surface 393. Holes or recesses 450 are formed in the shoulder 448. A wrench 452 includes protrusions 454 corresponding to the recesses 450 and engageable with the recesses to tighten or loosen the template guide 446. A double-ended wrench may be provided having protrusions 444 corresponding to slots 386 at a first end and protrusions 454 corresponding to recesses 450 at a second end.

In a further embodiment, a hole or recess 456 is formed in the guide surface 393 of a template guide 458. A wrench 460 has an arcuate portion 462 corresponding to the circumference of the guide surface 393 and a protrusion 464 engageable with the recess 456 to tighten or loosen the template guide 458.

One of skill in the art will readily recognize that embodiments of the quick change system described could provide various sizes of template guide for use with other templates and in forming other types of joints in addition to use in forming mortise and tenon joints. One of skill in the art would also recognize that alternative means could be used to attach the mounting ring to the router base or that the mounting ring may be integrally formed with a router base. Additionally, one of skill in that art would recognize that alternative connecting means could be used between the mounting ring and the template guide, including a bayonet fitting, interlocking tabs, or other appropriate mechanisms.

Referring to FIGS. 40 and 47-49, embodiments of the present invention include a mortise and tenon set-up guide 390, which aids in setting the front-to-back position of the rails 316, 318 and the right-to-left position of the fingers 340. The set-up guide 390 has a relatively planer top portion 392 and a cylindrical protrusion 394 extending downwardly from the top portion. At least the bottom 396 of the cylindrical protrusion is transparent. A first ring 395 and a second ring 397 are marked on or integrally formed with the bottom of the cylindrical protrusion. The rings are concentrically spaced from the cylinder walls.

In a first embodiment, the set-up guide assists the user in achieving the correct vertical position of a tenon workpiece. The set-up guide is placed on the top surface of the mortise and tenon finger assembly 314 with the cylindrical protrusion 394 extending downwardly, the bottom of the protrusion corresponds with the correct height of the tenon workpiece. Therefore, to achieve the correct vertical position of the tenon workpiece, the user places the mortise and tenon finger assembly 314 on the jig, places the set-up guide 390 in the guide space 398 of the assembly, and attaches the tenon board to the front face of the base assembly so that the top end of the tenon board just contacts the bottom surface 396 of the set-up guide.

In a further embodiment, the set-up guide can be used to correctly align both mortise and tenon workpieces front-to-back 148 and left-to-right 319. To correctly align the workpieces, the user uses the rings in the bottom of the cylinder to visually align the workpiece. The concentric rings align with the position of cheek cuts made by a router bit. The set-up guide is first positioned in the upper left part 398*a* of a guide space formed in the mortise and tenon finger assembly. In this position, the set-up guide aids in aligning the rear rail 318 front-to-back and the left finger assembly 340*a* left-to-right. The guide is next positioned in the lower right part 398*b* of a guide space formed in the mortise and tenon finger assembly. In this position, the set-up guide aids in aligning the front rail 316 front-to-back and the right finger assembly 340*b* left-to-right.

Figure 48:
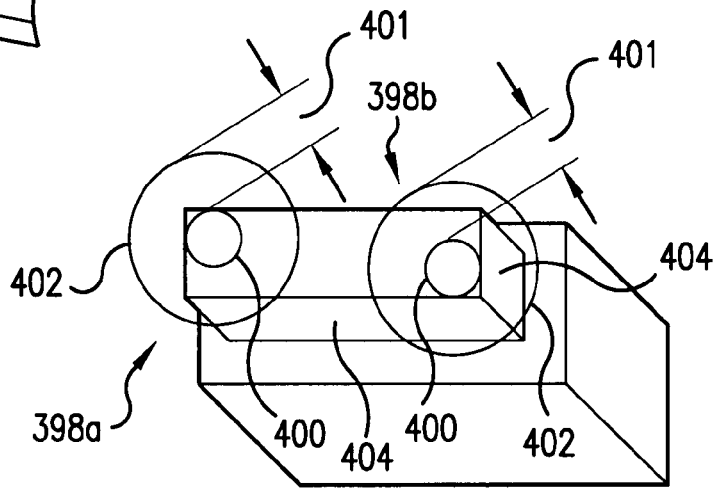
FIG. 48 is a diagram representing a tenon cut with relation to the set-up guide of FIG. 47.
Figure 49:
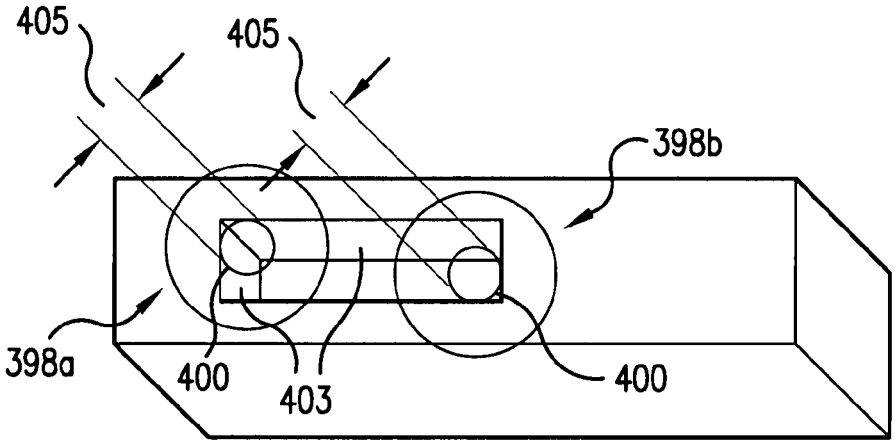
FIG. 49 is a diagram representing a mortise cut corresponding to the tenon cut diagram of FIG. 48.

FIG. 48 shows a diagram of a tenon cut as it aligns with the set-up guide. The figure shows the set-up guide in both the upper left part 398*a* of the guide space and the lower right part 398*b* of the guide space. In use, the guide would be positioned first in the upper left part and then in the lower right part. The inner ring 400 shows the position of the outside cheek cuts 404, while the space between the rings 401 shows the material that will be removed. The outer ring 402 shows the maximum amount of material that will be removed (material outside of the outer ring will not be removed). FIG. 49 shows a diagram of a mortise cut complementing to the tenon cut shown in FIG. 48. The inner ring 400 shows the position of the inside cheek cuts 403, while the material 405 inside of the inner ring will be removed, and any other material will not be affected. In further embodiments, a variety of different size guides are provided for forming different size mortise and tenon joints.

Figure 18:
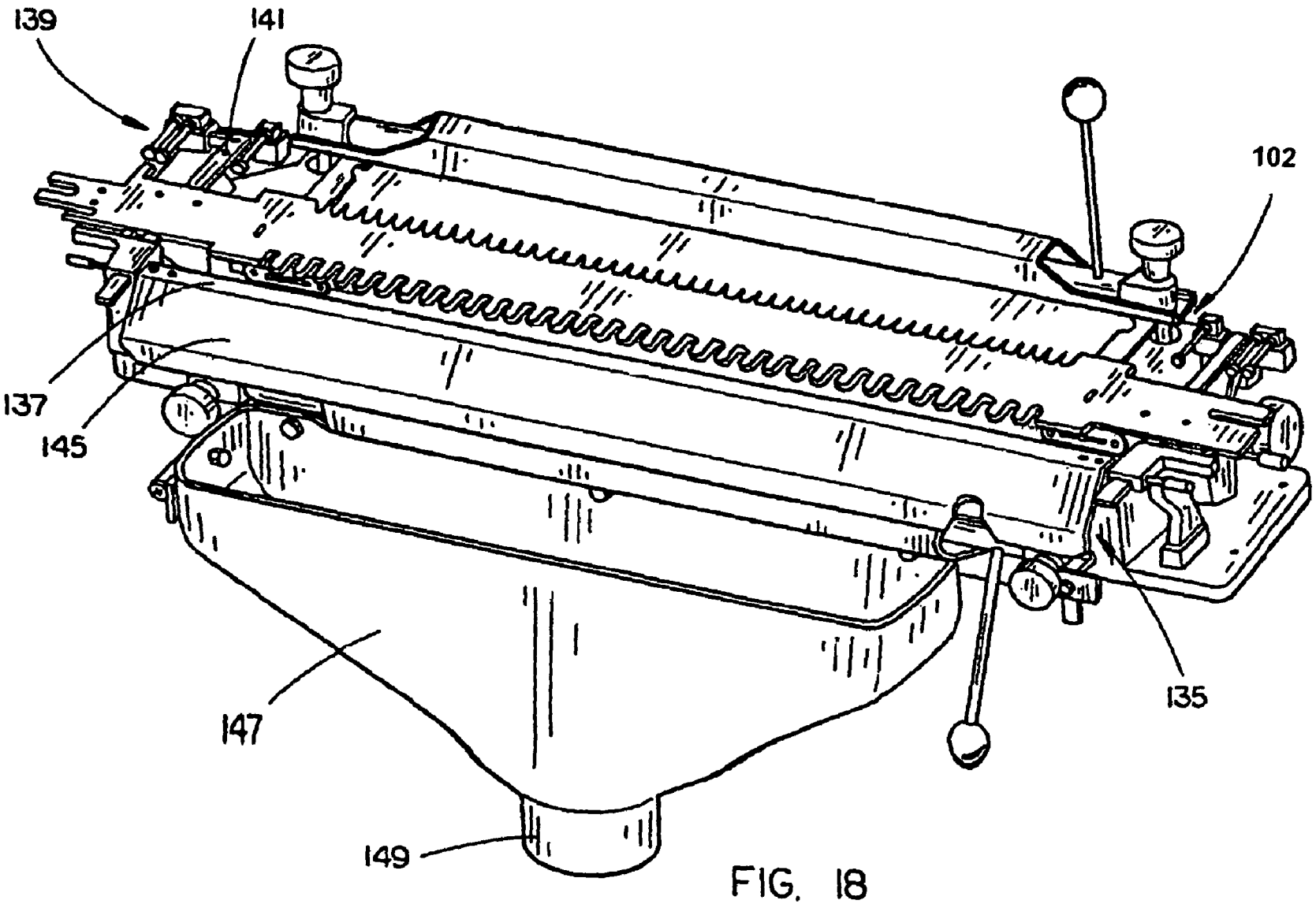
FIG. 18 is an isometric view of a jig apparatus including a router support and a dust collection chute in accordance with an embodiment.
Figure 30:
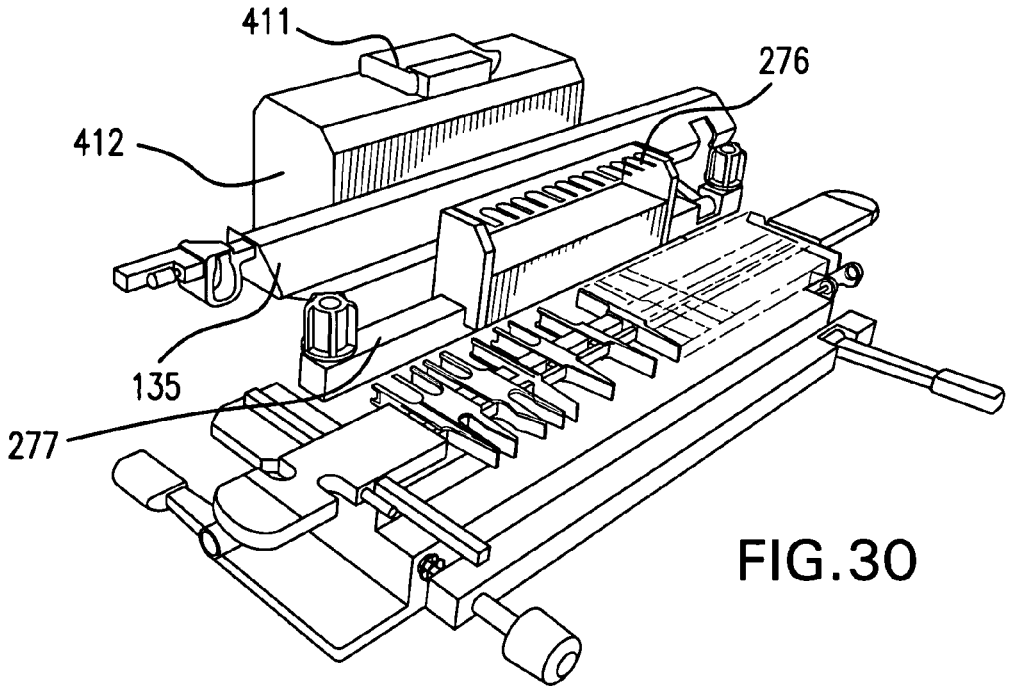
FIG. 30 is an isometric view of a jig apparatus, storage device, router support, and router bit depth adjustment system in accordance with an embodiment of the invention.

Referring to FIG. 18, a router support 135 for implementation with a jig apparatus is disclosed. In the current embodiment, the router support is formed with a flat or planar rail portion 137 disposed substantially flush or vertically aligned with the surface of the template. Aligning the router support 135 substantially flush with the template may prevent tipping or tilting of the router bit during operation while providing a support surface for resting the router on during shaping operations. Use of the router support may result in an improved joint because tilting of the router/router bit as the guide manipulates the router may result in an ill-fitting joint. The router support in the current embodiment is mounted to the mounting rail 141 included in the repeatable alignment system 139. In further embodiments, the router support may be mounted to the template, mounted to the base 102 of a jig apparatus, and the like. An embodiment may include a support brace extending the length of the router support 135 for reinforcing housing portion 145. The housing portion 145 is formed with a curved or multisided portion directed generally toward the base. In this configuration, the housing portion 145 may direct dust and debris generated during material removal away from the template and router. Additionally, the router support 135 may be utilized in conjunction with a dust collection chute 147 to collect dust and debris. Referring to FIG. 30, embodiments of the router support 135 and the bit depth guide housing 276 allow the router support to be stored in a slot formed on the rear of the depth guide housing when the router support is not in use.

Figure 19:
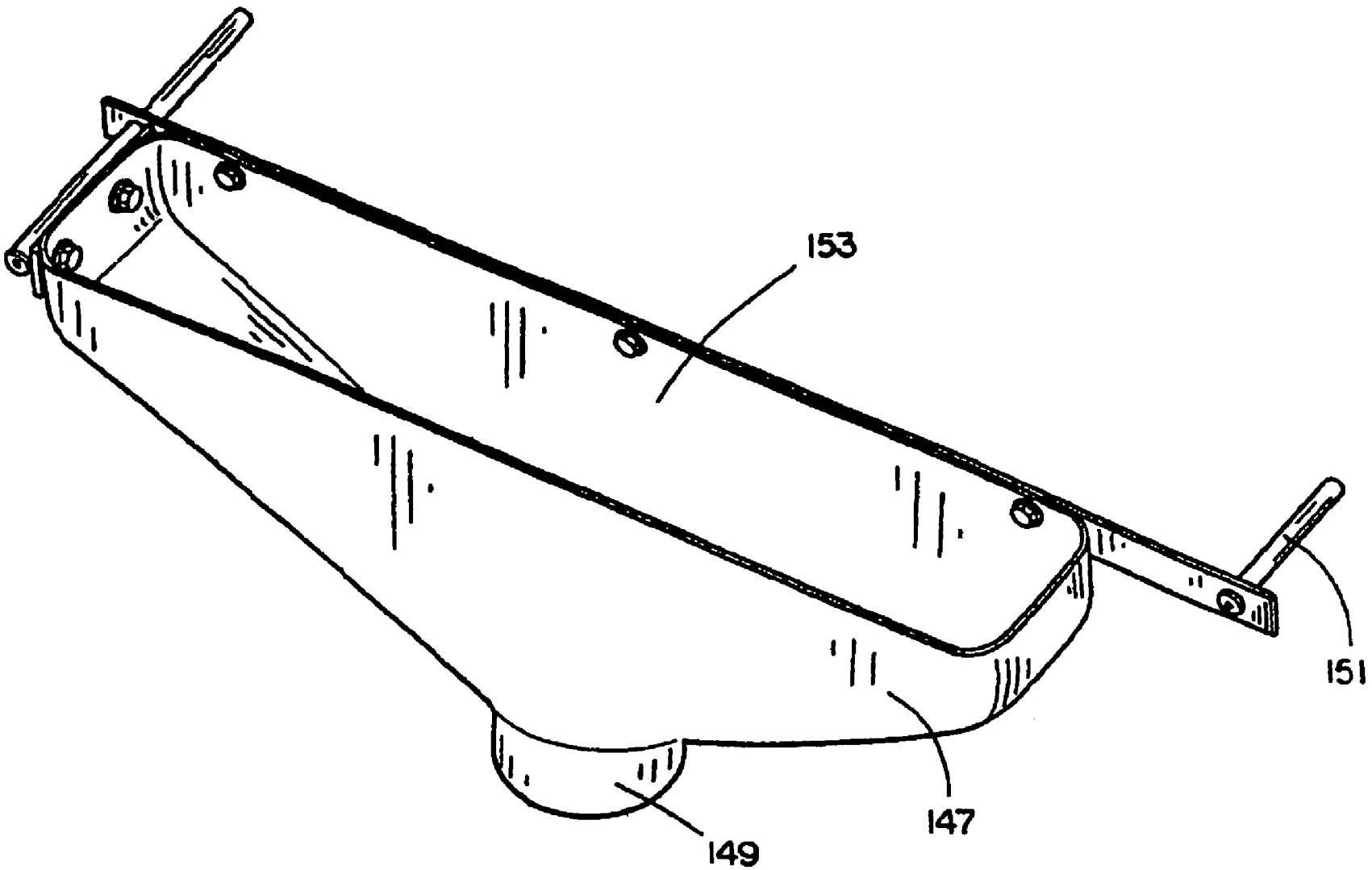
FIG. 19 is an isometric view of a dust collection chute in accordance with an exemplary embodiment of the present invention.
Figure 20:
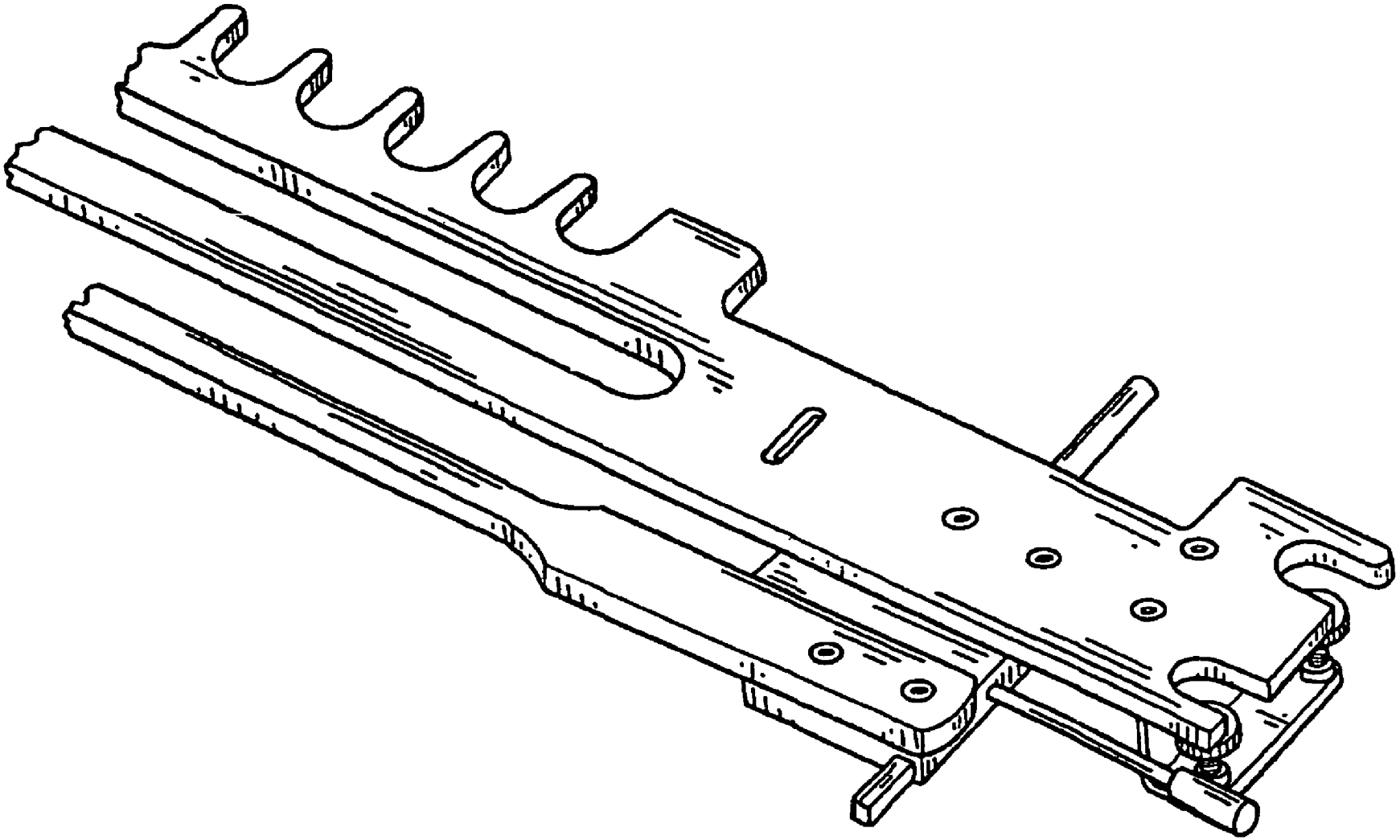
FIG. 20 is a partial isometric view of a template including variable position guide for forming a tapered sliding dovetail tenon.

Referring to FIGS. 18 and 19, embodiments of the invention may include a dust collection chute 147 as a removable accessory for the jig apparatus 100. Preferably, the chute opening 153 extends substantially along the front face 106 of the base 102 to direct dust and debris into a remote vacuum system coupled by a hose. The dust collection chute 147 includes a mounting mechanism for coupling the chute to the jig base 102. In the current embodiment, the dust collection chute includes a pair of spaced apart rods 151 (one is referenced), which are removably received in an aperture or recess, included in the base. The rods may include threading for being secured via a nut disposed on an opposing side of the base 102. In further embodiments, various mounting mechanisms may be implemented such as a received rail system, a fastener system (e.g., a screw or bolt received in a threaded aperture in the base), an interlocking lip and support (such that the chute may hang from a support for efficient removal), and the like. An outlet flange 149 may be included for attaching a suitable connection hose or duct for transferring the dust/debris to a central vacuum system or a dedicated vacuum. In additional embodiments, a securing mechanism such as a deformable tab system, a friction lock or the like may be included on or adjacent the outlet flange 149 for securing a vacuum transfer hose to the chute.

Figure 31:
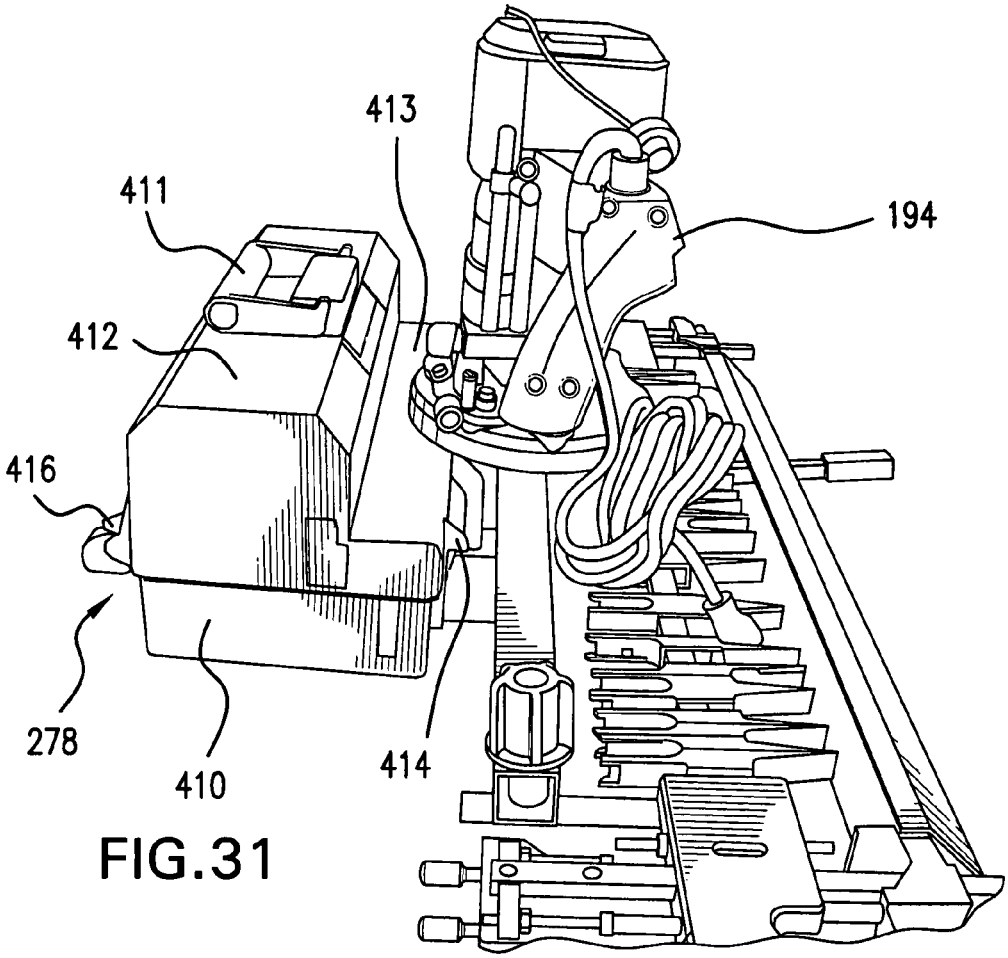
FIG. 31 is an isometric view of the jig apparatus of FIG. 30 with a router positioned on the bit depth adjustment housing.

Referring to FIG. 31, embodiments of the invention include a storage device 278 for organizing small accessories associated with the jig such as router bits, template guides, and alignment system blocks as well as other tools and guides. The storage device may include a tub 410 and a lid 412, and the lid may include a handle 411. In further embodiments, the front of the lid may be stepped 413 so that the user can place a router 194 on the bit height guide housing 276 without interfering with the storage device. The bit height guide and storage device could also be formed as a single unit. Embodiments of the storage device may be formed of plastic or any other appropriate material. The storage device may also include hooks 414 extending from the front of the device so that it can attach to the rear of the bit height guide for easy access by the craftsperson during use of the jig. Hooks 416 may also extend from the rear of the device for convenient storage on the front of the bit height guide when the jig is not in use.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages and that the form herein described is merely an explanatory embodiment the invention. It is the intention of the following claims to encompass and include such changes.

What is claimed is:

1. A jig apparatus for use with a router comprising:

a base comprising a base top surface and a base side surface;

a template removable mounted to the base, the template extending above the base top surface and comprising a template top surface adapted to support a base of the router for movement relative to the template and a guide surface;

a first workpiece support surface connected to the base top surface;

a first clamp assembly connected to the base and adapted to secure a workpiece against the first workpiece support surface;

a second workpiece support surface pivotally connected to the base side surface; and a second clamp assembly connected to the second workpiece support surface and adapted to secure a workpiece against the second workpiece support surface.

2. The jig apparatus of claim 1 wherein the template defines a guide for aiding in the formation of interconnecting workpieces.

3. The jig apparatus of claim 2 wherein the template comprises a guide for forming a tenon portion of a mortise and tenon joint.

4. The jig apparatus of claim 3 wherein the template further comprises a guide for forming a mortise portion of a mortise and tenon joint.

5. The jig apparatus of claim 3 wherein the template further comprises a guide for forming a pin portion of a dovetail joint.

6. The jig apparatus of claim 3 wherein the template further comprises a guide for forming a tail portion of a dovetail joint.

7. The jig apparatus of claim 1 wherein the first clamp assembly comprises a lock bar having a first end and a second end, wherein the lock bar is secured to the base by a first threaded rod at the first end and a second threaded rod at the second end.

8. The jig apparatus of claim 1 wherein the second workpiece support surface comprises a slot into which a portion of the second clamp assembly is inserted.

9. The jig apparatus of claim 1 further comprising a recessed zone formed adjacent an edge of the first workpiece support surface and an edge of the second workpiece support surface.

10. The jig apparatus of claim 9 further comprising a support block removably mountable in the recessed zone.

11. The jig apparatus of claim 1 wherein the base comprises:

a first end cap;

a second end cap; and a central section extending between the first end cap and the second end cap.

12. The jig apparatus of claim 11 wherein the first workpiece support surface is integrally formed with a top surface of the central section.

13. A jig apparatus for use with a router comprising:

a base comprising a base top surface and a base side surface;

a template removable mounted to the base, the template extending above the base top surface and comprising a template top surface adapted to support a base of the router for movement relative to the template and a guide surface;

a first workpiece support surface connected to the base top surface;

a first clamp assembly connected to the base and adapted to secure a workpiece against the first workpiece support surface;

a second workpiece support surface pivotably mounted to the base side surface such that the second workpiece support surface can be positioned at more than one angle relative to the first workpiece support surface; and a second clamp assembly connected to the second workpiece support surface and adapted to secure a workpiece against the second workpiece support surface.

14. The jig apparatus of claim 13 wherein the second workpiece support surface is pivotable relative to the first workpiece support surface between a first position and a second position.

15. The jig apparatus of claim 14 wherein the angle between the first workpiece support surface and the second workpiece support surface is ninety (90) degrees when the second workpiece surface is in the first position.

16. The jig apparatus of claim 15 wherein the angle between the first workpiece support surface and the second workpiece support surface is less than ninety (90) degrees when the second workpiece support surface is at the second position.

17. The jig apparatus of claim 13 wherein the first workpiece support surface extends generally horizontally across a top portion of the base.

18. The jig apparatus of claim 15 wherein the second workpiece support surface extends generally vertically across a front portion of the base when the second workpiece support surface is in the first position.

19. A jig apparatus for use with a router comprising:

a base comprising a base top surface and a base side surface;

a first template removable mounted to the base, the template extending above the base top surface and comprising a template top surface adapted to support a base of the router for movement relative to the template and a guide surface for aiding in the formation of a mortise and tenon joint for interconnecting workpieces;

a second template removable mounted to the base, the template extending above the base top surface and comprising a template top surface adapted to support a base of the router for movement relative to the template and a guide surface for aiding in the formation of a dovetail joint for interconnecting workpieces;

a first workpiece support surface connected to the base top surface;

a first clamp assembly connected to the base and adapted to secure a workpiece against the first workpiece support surface;

a second workpiece support surface pivotally connected to the base side surface; and a second clamp assembly connected to the second workpiece support surface and adapted to secure a workpiece against the second workpiece support surface.

20. The jig apparatus of claim 19 wherein the first workpiece support surface is integrally formed with the base.

* * * * *